US009957589B2

(12) United States Patent
Oishi et al.

(10) Patent No.: US 9,957,589 B2
(45) **Date of Patent: *May 1, 2018**

(54) COPPER-ALLOY PLATE FOR TERMINAL/CONNECTOR MATERIAL, AND METHOD FOR PRODUCING COPPER-ALLOY PLATE FOR TERMINAL/CONNECTOR MATERIAL

(71) Applicants: Mitsubishi Shindoh Co., Ltd., Tokyo (JP); MITSUBISHI MATERIALS CORPORATION, Tokyo (JP)

(72) Inventors: Keiichiro Oishi, Osaka (JP); Takashi Hokazono, Osaka (JP); Michio Takasaki, Osaka (JP); Yosuke Nakasato, Osaka (JP)

(73) Assignees: Mitsubishi Shindoh Co., Ltd., Tokyo (JP); MITSUBISHI MATERIALS CORPORATION, Tokyo (JP)

( * ) Notice: Subject to any disclaimer, the term of this patent is extended or adjusted under 35 U.S.C. 154(b) by 0 days. days.

This patent is subject to a terminal disclaimer.

(21) Appl. No.: 14/395,430

(22) PCT Filed: Mar. 19, 2013

(86) PCT No.: PCT/JP2013/057808

§ 371 (c)(1),
(2) Date: Oct. 17, 2014

(87) PCT Pub. No.: WO2014/115342

PCT Pub. Date: Jul. 31, 2014

(65) Prior Publication Data

US 2015/0318068 A1 Nov. 5, 2015

(30) Foreign Application Priority Data

Jan. 25, 2013 (WO) ..... PCT/JP2013/051602

(51) Int. Cl.
*C22C 9/04* (2006.01)
*C22F 1/08* (2006.01)
*H01B 1/02* (2006.01)

(52) U.S. Cl.
CPC ..... *C22C 9/04* (2013.01); *C22F 1/08* (2013.01); *H01B 1/026* (2013.01)

(58) Field of Classification Search
CPC ..... H01B 1/026; C22C 9/04; C22F 1/08
See application file for complete search history.

(56) References Cited

U.S. PATENT DOCUMENTS 5,893,953 A * 4/1999 Bhargava ..... C22F 1/08 148/680
8,992,706 B2 3/2015 Oishi
(Continued)

FOREIGN PATENT DOCUMENTS

JP 63-161135 A 7/1988
JP 01-189805 A 7/1989
(Continued)

OTHER PUBLICATIONS

E. O. Hall., The Deformation and Ageing of Mild Steel Proc. Phys. Soc. London, 64 (1951), pp. 747-753.
(Continued)

*Primary Examiner* — Keith Walker
*Assistant Examiner* — John A Hevey
(74) *Attorney, Agent, or Firm* — Griffin and Szipl PC

(57) ABSTRACT

The present invention relates to a copper alloy sheet for terminal and connector materials, which is excellent in terms of tensile strength, proof stress, Young's modulus, electric conductivity, bending workability, stress corrosion crack resistance, stress relaxation characteristics and solderability.

6 Claims, 1 Drawing Sheet

(56) References Cited

U.S. PATENT DOCUMENTS

| | | | | |
|---|---|---|---|---|
| 9,039,964 | B2 | 5/2015 | Oishi | |
| 2009/0224379 | A1 | 9/2009 | Miwa et al. | |
| 2010/0047112 | A1 | 2/2010 | Fugono et al. | |
| 2011/0265917 | A1 | 11/2011 | Oishi | |
| 2014/0166164 | A1 | 6/2014 | Oishi et al. | |
| 2015/0122380 | A1* | 5/2015 | Oishi | C22C 9/04 148/681 |

FOREIGN PATENT DOCUMENTS

| | | | | |
|---|---|---|---|---|
| JP | 06-184679 | A | | 7/1994 |
| JP | 2000-087158 | A | | 3/2000 |
| JP | 2002-530523 | A | | 9/2002 |
| JP | 2002-294368 | A | | 10/2002 |
| JP | 2005-163127 | A | | 6/2005 |
| JP | 2006-283060 | A | | 10/2006 |
| JP | 2006283060 | A | * | 10/2006 |
| JP | 2007-056365 | A | | 3/2007 |
| JP | 2007-100111 | A | | 4/2007 |
| JP | 2007-100146 | A | | 4/2007 |
| JP | 2007-270286 | A | | 10/2007 |
| JP | 2008-231492 | A | | 10/2008 |
| JP | 2009-062610 | A | | 3/2009 |
| JP | 2009242822 | A | | 10/2009 |
| JP | 5153949 | B1 | | 12/2012 |
| WO | 0029632 | A1 | | 5/2000 |
| WO | 20101079707 | A1 | | 7/2010 |
| WO | 20100134210 | A1 | | 11/2010 |
| WO | 2011/125555 | A1 | | 10/2011 |

OTHER PUBLICATIONS

N. J. Petch et al., The Cleavage Strength of Polycrystals Journal of the Iron and Steel Institute, 174 (1953), p. 25-28.

International Search Report issued in corresponding application PCT/JP2013/057808, completed Apr. 26, 2013 and dated May 14, 2013.

Written Opinion issued in corresponding application PCT/JP2013/057808, dated May 14, 2013.

Metals Handbook Tenth Edition, vol. 2 Oct. 1990, p. 408 (attached hereto as Appendix A).

English translation of the written opinion of the International Searching Authority in PCT/JP2013/057808, dated May 14, 2013.

International Search Report issued in related application PCT/JP2012/073641, completed Nov. 15, 2012 and dated Dec. 4, 2012.

Notice of Allowance issued in related Japanese National Stage application 2013-502310 drafted on May 27, 2013 and dated Jun. 4, 2013.

International Search Report issued in related application PCT/JP2012/073630, completed Nov. 15, 2012 and dated Dec. 4, 2012.

Notice of Allowance issued in related Japanese application 2013-502309, completed May 27, 2013 and dated Jun. 4, 2013.

Metals Handbook, Ninth Edition, vol. 14, 1988, pp. 812-813.

Recrystallization (metallurgy). Wikipedia.org. Last updated Sep. 2, 2015. Accessed Oct. 16, 2015.

Office action issued in co-pending U.S. Appl. No. 14/946,108, dated Sep. 8, 2016.

Office Action issued in co-pending U.S. Appl. No. 14/517,703, dated May 16, 2016.

Office Action issued in co-pending U.S. Appl. No. 14/946,108, dated Feb. 8, 2017.

* cited by examiner

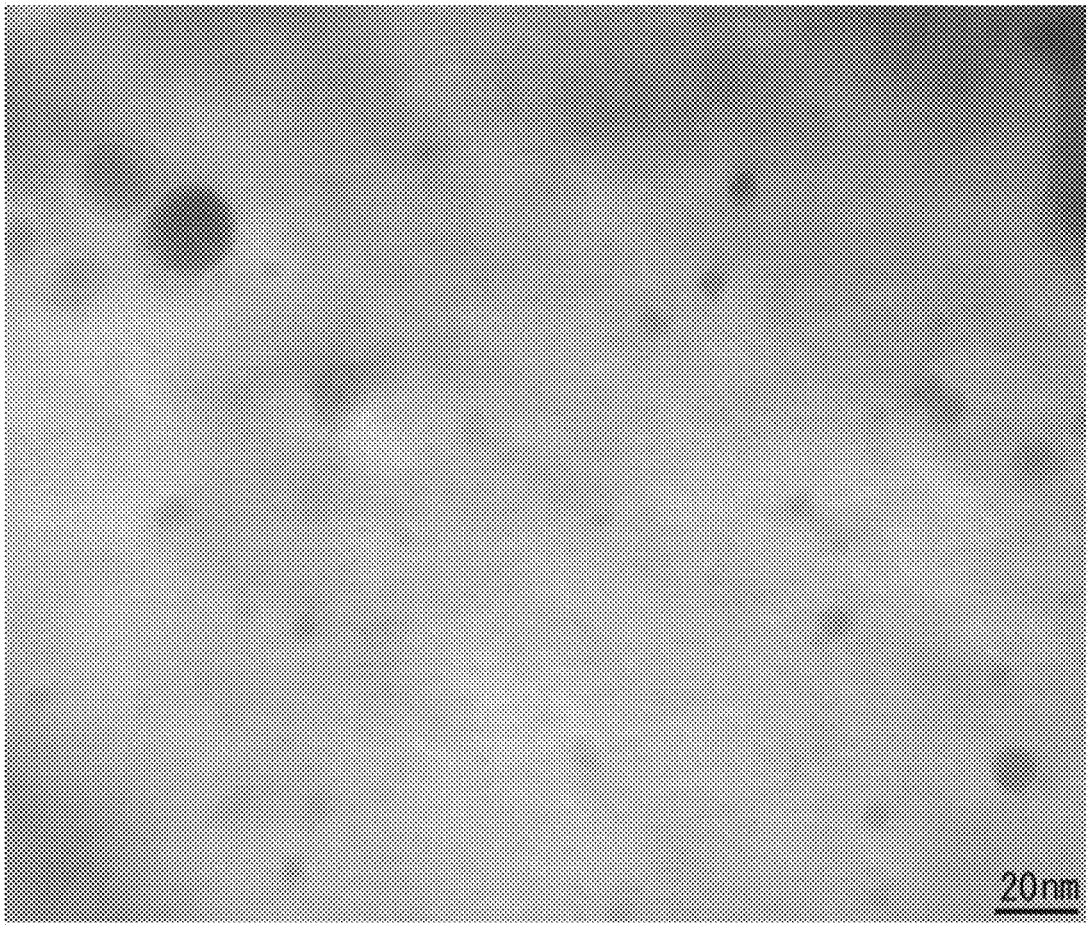
20nm

COPPER-ALLOY PLATE FOR TERMINAL/CONNECTOR MATERIAL, AND METHOD FOR PRODUCING COPPER-ALLOY PLATE FOR TERMINAL/CONNECTOR MATERIAL

This is a National Phase Application in the United States of International Patent Application No. PCT/JP2013/057808 filed Mar. 19, 2013, which claims priority on International Patent Application No. PCT/JP2013/051602, filed Jan. 25, 2013. The entire disclosures of the above patent applications are hereby incorporated by reference.

TECHNICAL FIELD

The present invention relates to a copper alloy sheet for terminal and connector materials, and a method for manufacturing a copper alloy sheet for terminal and connector materials, and particularly to a copper alloy sheet for terminal and connector materials which is excellent in terms of tensile strength, proof stress, Young's modulus, electric conductivity, bending workability, stress corrosion crack resistance, stress relaxation characteristics and solderability, and a method for manufacturing a copper alloy sheet for terminal and connector materials.

BACKGROUND ART

A copper alloy sheet having high electric conductivity and high strength has thus far been used as a constituent material for connectors, terminals, relays, springs, switches, semiconductors, lead frames and the like that are used in electric components, electronic components, vehicle components, communication devices, electric and electronic devices and the like. However, in response to a decrease in the size and weight and an improvement of the performance of such devices in recent years, there is a demand for extremely strict characteristic improvement with the constituent materials used for the above-described devices. For example, an extremely thin sheet is used in a spring contact section in a connector, and a high-strength copper alloy configuring the above-described extremely thin sheet is required to have high strength or a high degree of balance between elongation and strength to procure a thin thickness. Furthermore, the high-strength copper alloy is required to be excellent in terms of productivity and economic efficiency and to have no problems with electric conductivity, corrosion resistance (stress corrosion crack resistance, dezincification corrosion resistance and migration resistance), stress relaxation characteristics, solderability, and the like.

In addition, in the constituent material for connectors, terminals, relays, springs, switches, semiconductors, lead frames and the like that are used in electric components, electronic components, vehicle components, communication devices, electric and electronic devices and the like, there is a component and a section requiring higher strength or higher electric conductivity to satisfy the requirement of a thin thickness which is a precondition for excellent elongation and excellent bending workability. However, strength and electric conductivity are opposing characteristics, and thus the improvement of strength is generally followed by a decrease in electric conductivity. In the above-described circumstance, there is a component requiring a high-strength material having higher electric conductivity (approximately 30% IACS or higher, for example, approximately 36% IACS) at a tensile strength of, for example, 500 N/mm$^2$ or more. In addition, there is a component requiring superior stress relaxation characteristics and superior thermal resistance since the component is used under a high-temperature environment such as near a vehicle engine room.

Well-known examples of a copper alloy having high electric conductivity and high strength generally include beryllium copper, phosphor bronze, nickel silver, brass and Sn-added brass. The above-described general high-strength copper alloys have the following problems, and cannot satisfy the above-described requirements.

Beryllium copper has the highest strength among copper alloys, but beryllium is extremely harmful to human bodies (particularly, in a molten state, even an extremely small amount of beryllium vapor is extremely dangerous). Therefore, disposal (particularly, incineration disposal) of a beryllium copper member or a product including a beryllium copper member is difficult, and the initial cost for a dissolution facility used for manufacturing becomes extremely high. Therefore, to obtain predetermined characteristics, it becomes necessary to carry out a solution thermal treatment in the final phase of manufacturing, and thus there is a problem with economic efficiency including the manufacturing costs.

Since phosphor bronze and nickel silver have poor hot workability, and are not easily manufactured through hot rolling, it is common to manufacture phosphor bronze and nickel silver through transverse continuous casting. Therefore, the productivity is poor, the energy cost is high, and the yield is also poor. In addition, since phosphor bronze for springs or nickel silver for springs which is a typical copper alloy having high strength contains a large amount of expensive Sn and Ni, the electric conductivity is poor, and there is a problem with economic efficiency.

Brass and Sn-added brass are cheap, but cannot satisfy the strength, have poor stress relaxation characteristics and poor electric conductivity, and have a problem with corrosion resistance (stress corrosion and dezincification corrosion), and therefore brass and Sn-added brass are not suitable as a constituent material for the above-described products requiring a decrease in size and an improvement of performance.

Therefore, the above-described general copper alloys having high electric conductivity and high strength can be by no means satisfactory as a constituent material for components of a variety of devices having a tendency of size decrease, weight decrease and performance improvement as described above, and there is a strong demand for development of a novel copper alloy having high electric conductivity and high strength.

As an alloy for satisfying the above-described requirement of high electric conductivity and high strength, for example, a Cu—Zn—Sn alloy as described in Patent Document 1 is known. However, the alloy according to Patent Document 1 is also not sufficient in terms of electric conductivity and strength.

RELATED ART DOCUMENT

[Patent Document]

[Patent Document 1] Japanese Patent Application Laid-Open no. 2007-056365

DISCLOSURE OF THE INVENTION

Problem that the Invention is to Solve

The invention has been made to solve the above-described problems of the related art, and an object of the invention is to provide a copper alloy sheet for terminal and connector materials which is excellent in terms of tensile strength, proof stress, Young's modulus, electric conductivity, bending workability, stress corrosion crack resistance, stress relaxation characteristics and solderability.

Solutions to Solve the Problems

Paying attention to the Hall-fetch relationship saying that the 0.2% proof stress (that is strength when the permanent strain reaches 0.2%, and, hereinafter, will be sometimes referred to simply as "proof stress") increases in proportion to the inverse of square root of the crystal grain diameter D ($D^{-1/2}$) (refer to E. O. Hall, Proc. Phys. Soc. London. 64 (1951) 747 and N. J. Petch, J. Iron Steel Inst. 174 (1953) 25.), the present inventors considered that a high-strength copper alloy that can satisfy the above-described requirements of the times can be obtained by miniaturizing crystal grains, and carried out a variety of studies and experiments regarding the miniaturization of crystal grains.

As a result, the following finding was obtained.

Crystal grains can be miniaturized by recrystallizing a copper alloy in accordance with elements being added. When crystal grains (recrystallized grains) are miniaturized to a certain size or smaller, it is possible to significantly improve strength, mainly tensile strength and proof stress. That is, as the average crystal grain diameter decreases, the strength also increases.

Specifically, a variety of experiments were carried out regarding the influences of elements being added on the miniaturization of crystal grains. Thus, the following matters were clarified.

The addition of Zn and Sn to Cu has an effect that increases the number of nucleation sites of recrystallization nuclei. Furthermore, the addition of P, Ni, and furthermore, Co and Fe to a Cu—Zn—Sn alloy has an effect that suppresses grain growth. Therefore, it was clarified that a Cu—Zn—Sn—P—Ni-based alloy, a Cu—Zn—Sn—P—Ni—Co-based alloy, a Cu—Zn—Sn—P—Ni—Fe-based alloy and a Cu—Zn—Sn—P—Ni—Co—Fe-based alloy having fine crystal grains can be obtained by using the above-described effect.

That is, a decrease in stacking-fault energy by the addition of Zn and Sn which have divalent and tetravalent atomic valences respectively is considered to be one of the main causes for the increase in the number of nucleation sites of recrystallization nuclei. The suppression of the growth of crystal grains which maintains the generated fine recrystallized grains being fine is considered to result from the generation of fine precipitates by the addition of P, Ni, Co and Fe. However, the balance among strength, elongation and bending workability cannot be obtained simply by ultra-miniaturizing recrystallized grains. It was clarified that recrystallized grains are preferably miniaturized in a certain crystal grain miniaturization range to maintain the balance. Regarding the miniaturization or ultra-miniaturization of crystal grains, JIS H 0501 describes the minimum crystal grain size is 0.010 mm in a described standard photograph. Based on this description, it is considered that crystal grains can be said to be miniaturized in a copper alloy having an average crystal grain diameter of approximately 0.008 mm or less, and crystal grains can be said to be ultra-miniaturized in a copper alloy having an average crystal grain diameter of 0.004 mm (4 microns) or less.

The invention has been completed based on the above finding by the inventors. That is, the following inventions are provided to solve the above-described problems.

The invention provides a copper alloy sheet for terminal and connector materials containing 4.5 mass % to 12.0 mass % of Zn; 0.40 mass % to 0.9 mass % of Sn; 0.01 mass % to 0.08 mass % of P; and 0.20 mass % to 0.85 mass % of Ni with a remainder being Cu and inevitable impurities, in which a content of Zn [Zn] (mass %), a content of Sn [Sn] (mass %), a content of P [P] (mass %) and a content of Ni [Ni] (mass %) have a relationship of $11 \leq [Zn]+7.5\times[Sn]+16\times[P]+3.5\times[Ni] \leq 19$, and the copper alloy sheet is a copper alloy sheet for terminal and connector materials which further has a relationship of $7 \leq [Ni]/[P] \leq 40$ 40 with regard to a content of Ni and a content of P in a case in which the content of Ni is in a range of 0.35 mass % to 0.85 mass %, an average crystal grain diameter is in a range of 2.0 μm to 8.0 μm, an average particle diameter of circular or elliptical precipitates is in a range of 4.0 nm to 25.0 nm or a proportion of the number of precipitates having a particle diameter in a range of 4.0 nm to 25.0 nm in the precipitates is 70% or more, an electric conductivity is 29% IACS or more, a percentage of stress relaxation is 30% or less at 150° C. for 1000 hours as stress relaxation resistance, bending workability is $R/t \leq 0.5$ at W bending, solderability is excellent, and a Young's modulus is $100\times10^3$ N/mm$^2$ or more.

According to the copper alloy sheet for terminal and connector materials of the invention, since the average grain diameter of the crystal grains and the average particle diameter of the precipitates are in the predetermined preferred ranges, tensile strength, proof stress, Young's modulus, electric conductivity, bending workability, stress corrosion crack resistance, solderability and the like are excellent.

In a case in which the content of Ni is in a range of 0.35 mass % to 0.85 mass %, since a relationship of $7 \leq [Ni]/[P] \leq 40$ is satisfied, the percentage of stress relaxation becomes favorable.

Meanwhile, examples of the circular or elliptical precipitates include not only true circular or elliptical precipitates but also substantially circular or elliptical precipitates.

In addition, the invention provides a copper alloy sheet for terminal and connector materials containing 4.5 mass % to 12.0 mass % of Zn; 0.40 mass % to 0.9 mass % of Sn; 0.01 mass % to 0.08 mass % of P; 0.20 mass % to 0.85 mass % of Ni; and any one or both of 0.005 mass % to 0.08 mass % of Co and 0.004 mass % to 0.04 mass % of Fe with a remainder being Cu and inevitable impurities, in which a content of Zn [Zn] (mass %), a content of Sn [Sn] (mass %), a content of P [P] (mass %), a content of Co [Co] (mass %) and a content of Ni [Ni] (mass %) have a relationship of $11 \leq [Zn]+7.5\times[Sn]+16\times[P]+10\times[Co]+3.5\times[Ni] \leq 19$, and the copper alloy sheet is a copper alloy sheet for terminal and connector materials which further has a relationship of $7 \leq [Ni]/[P] \leq 40$ with regard to a content of Ni and a content of P in a case in which the content of Ni is in a range of 0.35 mass % to 0.85 mass %, an average crystal grain diameter is in a range of 2.0 μm to 8.0 μm, an average particle diameter of circular or elliptical precipitates is in a range of 4.0 nm to 25.0 nm or a proportion of the number of precipitates having a particle diameter in a range of 4.0 nm to 25.0 nm in the precipitates is 70% or more, an electric conductivity is 29% IACS or more, a percentage of stress relaxation is 30% or less at 150° C. for 1000 hours as stress relaxation resistance, bending workability is $R/t \leq 0.5$ at W bending, solderability is excellent and a Young's modulus is $100\times10^3$ N/mm$^2$ or more.

According to the copper alloy sheet for terminal and connector materials of the invention, since any one or both of 0.005 mass % to 0.08 mass % of Co and 0.004 mass % to 0.04 mass % of Fe are contained, it is possible to miniaturize the crystal grains and to increase the strength.

Furthermore, the invention provides a copper alloy sheet for terminal and connector materials containing 8.5 mass % to 12.0 mass % of Zn; 0.40 mass % to 0.9 mass % of Sn; 0.01 mass % to 0.08 mass % of P; and 0.40 mass % to 0.85 mass % of Ni with a remainder being Cu and inevitable impurities, in which a content of Zn [Zn] (mass %), a content of Sn [Sn] (mass %), a content of P [P] (mass %), and a content of Ni [Ni] (mass %) have a relationship of $17 \leq [Zn]+7.5\times[Sn]+16\times[P]+3.5\times[Ni] \leq 19$ and have a relationship of $7 \leq [Ni]/[P] \leq 40$ and $0.55 \leq [Ni]/[Sn] \leq 1.9$, an average crystal grain diameter is in a range of 2.0 μm to 8.0 μm, an average particle diameter of circular or elliptical precipitates is in a range of 4.0 nm to 25.0 nm or a proportion of the number of precipitates having a particle diameter in a range of 4.0 nm to 25.0 nm in the precipitates is 70% or more, an electric conductivity is 29% IACS or more, a percentage of stress relaxation is 30% or less at 150° C. for 1000 hours as stress relaxation resistance, bending workability is $R/t \leq 0.5$ at W bending, solderability is excellent, stress corrosion crack resistance is excellent and a Young's modulus is $100\times10^3$ N/mm$^2$ or more.

In addition, the invention provides a copper alloy sheet for terminal and connector materials containing 8.5 mass % to 12.0 mass % of Zn; 0.40 mass % to 0.9 mass % of Sn; 0.01 mass % to 0.08 mass % of P; 0.40 mass % to 0.85 mass % of Ni; and any one or both of 0.005 mass % to 0.08 mass % of Co and 0.004 mass % to 0.04 mass % of Fe with a remainder being Cu and inevitable impurities, in which a content of Zn [Zn] (mass %), a content of Sn [Sn] (mass %), a content of P [P] (mass %), a content of Co [Co] (mass %) and a content of Ni [Ni] (mass %) have a relationship of $17 \leq [Zn]+7.5\times[Sn]+16\times[P]+10\times[Co]+3.5\times[Ni] \leq 19$ and have a relationship of $7 \leq [Ni]/[P] \leq 40$ and $0.55 \leq [Ni]/[Sn] \leq 1.9$, an average crystal grain diameter is in a range of 2.0 μm to 8.0 μm, an average particle diameter of circular or elliptical precipitates is in a range of 4.0 nm to 25.0 nm or a proportion of the number of precipitates having a particle diameter in a range of 4.0 nm to 25.0 nm in the precipitates is 70% or more, an electric conductivity is 29% IACS or more, a percentage of stress relaxation is 30% or less at 150° C. for 1000 hours as stress relaxation resistance, bending workability is $R/t \leq 0.5$ at W bending, solderability is excellent, stress corrosion crack resistance is excellent and a Young's modulus is $100\times10^3$ N/mm$^2$ or more.

According to the copper alloy sheet for terminal and connector materials of the invention, since the amount of Zn is set in a range of 8.5 mass % to 12.0 mass %, the amount of Ni is set in a range of 0.40 mass % to 0.85 mass %, the relationship of $17 \leq [Zn]+7.5\times[Sn]+16\times[P]+10\times[Co]+3.5\times[Ni] \leq 19$ is satisfied, and a relationship of $7 \leq [Ni]/[P] \leq 40$ and $0.55 \leq [Ni]/[Sn] \leq 1.9$ is satisfied, high strength can be obtained, and it is possible to improve the balance among strength, stress relaxation resistance, bending workability, stress corrosion crack resistance and Young's modulus.

The above-described four copper alloy sheets for terminal and connector materials according to the invention, specifically, have an electric conductivity of 29% IACS or more, a percentage of stress relaxation of 30% or less at 150° C. for 1000 hours as stress relaxation resistance, bending workability of $R/t \leq 0.5$, excellent solderability, and a Young's modulus of $100\times10^3$ N/mm$^2$ or more.

The above-described four copper alloy sheets for terminal and connector materials according to the invention are manufactured using a manufacturing step including a cold finish rolling step for cold-rolling a copper alloy material in which an average crystal grain diameter is in a range of 2.0 μm to 8.0 μm, an average particle diameter of circular or elliptical precipitates is in a range of 4.0 nm to 25.0 nm or a proportion of a number of precipitates having a particle diameter in a range of 4.0 nm to 25.0 nm in the precipitates is 70% or more, when the electric conductivity is represented by C (% IACS), tensile strength, proof stress and elongation in a direction forming 0 degrees with respect to a rolling direction are represented by Pw (N/mm$^2$), Py (N/mm$^2$) and L (%) respectively, $C \geq 29$, $Pw \geq 500$, $3200 \leq [Pw\times\{(100+L)/100\}\times C^{1/2}] \leq 4100$ or $C \geq 29$, $Py \geq 480$, $3100 \leq [Py\times\{(100+L)/100\}\times C^{1/2}] \leq 4000$ after the cold finish rolling step, and a ratio of tensile strength in the direction forming 90 degrees with respect to the rolling direction to tensile strength in a direction forming 0 degrees with respect to the rolling direction is in a range of 0.95 to 1.05, or a ratio of proof stress in the direction forming 90 degrees with respect to the rolling direction to proof stress in a direction forming 0 degrees with respect to the rolling direction is in a range of 0.95 to 1.05.

In this case, since the balance among electric conductivity, tensile strength and elongation is excellent, and the tensile strength and the proof stress are isotropic, the copper alloy sheets for terminal and connector materials are suitable for constituent materials for connectors, terminals, relays, springs, switches, semiconductors, lead frames and the like.

Meanwhile, in the invention, the copper alloy material including crystal grains having a predetermined grain diameter and precipitates having a predetermined particle diameter is cold-rolled, but it is still possible to recognize non-rolled crystal grains and non-rolled precipitates even after cold rolling. Therefore, it is possible to measure the grain diameter of the non-rolled crystal grains and the particle diameter of the non-rolled precipitates after rolling. In addition, since the crystal grains and the precipitates maintain the same volumes even after being rolled, the average crystal grain diameter of the crystal grains and the average particle diameter of the precipitates do not change before and after the cold rolling.

In addition, in the invention, the recovery thermal treatment step may be carried out as necessary after the cold finish rolling step.

In a case in which the recovery thermal treatment step is carried out after the cold finish rolling step, $C \geq 29$, $Pw \geq 500$, $R/t \leq 0.5$, $3200 \leq [Pw\times\{(100+L)/100\}\times C^{1/2}] \leq 4100$ or $C \geq 29$, $Py \geq 480$, $R/t \leq 0.5$, $3100 \leq [Py\times\{(100+L)/100\}\times C^{1/2}] \leq 4000$ after the recovery thermal treatment step, and the ratio of tensile strength in a direction forming 90 degrees with respect to the rolling direction to tensile strength in a direction forming 0 degrees with respect to the rolling direction is in a range of 0.95 to 1.05, or the ratio of proof stress in a direction forming 90 degrees with respect to the rolling direction to proof stress in a direction forming 0 degrees with respect to the rolling direction may be in a range of 0.95 to 1.05.

In this case, since the recovery thermal treatment is carried out, the percentage of stress relaxation, the Young's modulus, spring bending elastic limit and elongation improve.

The method for manufacturing the above-described four copper alloy sheets for terminal and connector materials according to the invention includes a hot rolling step; a cold rolling step; a recrystallization thermal treatment step; and a cold finish rolling step in this order, a hot rolling initial temperature is in a range of 800° C. to 940° C. in the hot rolling step, a cooling rate of a copper alloy material in a temperature range of a temperature after final rolling to 350°

C. or 650° C. to 350° C. is 1° C./second or more, a percentage of cold working is 55% or more in the cold rolling step, the recrystallization thermal treatment step includes a heating step for heating the copper alloy material to a predetermined temperature, a holding step for holding the copper alloy material at a predetermined temperature for a predetermined time after the heating step, and a cooling step for cooling the copper alloy material to a predetermined temperature after the holding step, and, in the recrystallization thermal treatment step, when a peak temperature of the copper alloy material is represented by Tmax (° C.), a holding time in a temperature range of a temperature 50° C. lower than the peak temperature of the copper alloy material to the peak temperature is represented by tm (min), and the percentage of cold working in the cold rolling step is represented by RE (%), $550 \leq Tmax \leq 790$, $0.04 \leq tm \leq 2$, and $460 \leq \{Tmax - 40 \times tm^{-1/2} - 50 \times (1 - RE/100)^{1/2}\} \leq 580$.

Furthermore, depending on the sheet thickness of the copper alloy sheet, a cold rolling step and an annealing step forming a pair may be carried out once or a plurality of times between the hot rolling step and the cold rolling step.

In the method for manufacturing a copper alloy sheet for terminal and connector materials according to the invention, the recovery thermal treatment step is carried out after the cold finish rolling step, and, in the recovery thermal treatment step, when a peak temperature of the copper alloy material is represented by Tmax2 (° C.), a holding time in a temperature range of a temperature 50° C. lower than the peak temperature of the copper alloy material to the peak temperature is represented by tm2 (min), and the percentage of cold working in the cold finish rolling step is represented by RE2(%), $160 \leq Tmax \leq 2650$, $0.02 \leq tm2 \leq 200$, and $60 \leq \{Tmax2 - 40 \times tm2^{-1/2} - 50 \times (1 - RE2/100)^{1/2}\} \leq 360$.

Meanwhile, depending on use, there are cases in which the copper alloy sheet for terminal and connector materials according to the invention is Sn-plated after finish rolling, and, since Sn is melted during plating such as molten Sn plating or reflow Sn plating, and the temperature of the material surface increases, it is possible to replace the recovery thermal treatment step with the above-described plating treatment step even when the conditions of the recovery thermal treatment are not satisfied.

It is possible to improve the percentage of stress relaxation, the Young's modulus, the spring bending elastic limit and elongation by carrying out the recovery thermal treatment step.

Advantage of the Invention

According to the invention, the tensile strength, proof stress, Young's modulus, electric conductivity, bending workability, stress corrosion crack resistance, solderability and the like of the copper alloy sheet for terminal and connector materials are excellent.

BRIEF DESCRIPTION OF THE DRAWING

FIG. 1 is a transmission electron microscopic photograph of a copper alloy sheet of Alloy No. 2 (Test No. T18).

BEST MODE FOR CARRYING OUT THE INVENTION

Copper alloy sheets for terminal and connector materials according to embodiments of the invention will be described.

In the present specification, when indicating an alloy composition, a chemical symbol in parenthesis, such as [Cu], is considered to indicate the content value (mass %) of the corresponding element. Also, in the specification, a plurality of computation formulae will be proposed using the above-described method for indicating the content value. However, a content of Co of 0.001 mass % or less and a content of Ni of 0.01 mass % or less have little influence on the characteristics of the copper alloy sheet. Therefore, in the respective computation formulae described below, the content of Co of 0.001 mass % or less and the content of Ni of 0.01 mass % or less will be considered as 0 in computation.

In addition, each inevitable impurity also has little influence on the characteristics of the copper alloy sheet at its content as an inevitable impurity, and therefore the inevitable impurity will not be included in the respective computation formulae described below. For example, 0.01 mass % or less of Cr will be considered as an inevitable impurity.

In addition, in the specification, as an index indicating the balance among the contents of Zn, Sn, P, Co and Ni, a composition index f1 will be specified as follows.

$$\text{Composition index } f1 = [Zn] + 7.5 \times [Sn] + 16 \times [P] + 10 \times [Co] + 3.5 \times [Ni]$$

In addition, in the specification, as an index indicating the thermal treatment conditions in the recrystallization thermal treatment step and the recovery thermal treatment step, a thermal treatment index It will be specified as follows.

When the peak temperatures of the copper alloy material during the respective thermal treatments are represented by Tmax (° C.), the holding time in a temperature range of a temperature 50° C. lower than the peak temperature of the copper alloy material to the peak temperature is represented by tm (min), and the percentage of cold working of cold rolling carried out between each of the thermal treatments (the recrystallization thermal treatment step or the recovery thermal treatment step) and a step accompanying recrystallization which is carried out before each of the thermal treatments (hot rolling or thermal treatment) is represented by RE (%), the thermal treatment index It will be specified as follows.

$$\text{Thermal treatment index } It = Tmax - 40 \times tm^{-1/2} - 50 \times (1 - RE/100)^{1/2}$$

In addition, as indexes indicating the balance among electric conductivity, tensile strength and elongation, balance indexes f2 and f21 will be specified as follows.

When the electric conductivity is represented by C (% IACS), the tensile strength is represented by Pw ($N/mm^2$), the proof stress is represented by Py ($N/mm^2$), and the elongation is represented by L (%), the balance indexes f2 and f21 will be specified as follows.

$$\text{Balance index } f2 = Pw \times \{(100 + L)/100\} \times C^{1/2}$$

That is, the balance index f2 is the product of Pw, (100+L)/100 and $C^{1/2}$.

$$\text{Balance index } f21 = Py \times \{(100 + L)/100\} \times C^{1/2}$$

That is, the balance index f21 is the product of Py, (100+L)/100 and $C^{1/2}$.

The copper alloy sheet for terminal and connector materials according to a first embodiment is obtained through the cold finish rolling of a copper alloy material. The average crystal grain diameter of the copper alloy material is in a range of 2.0 μm to 8.0 μm. Circular or elliptical precipitates are present in the copper alloy material, and the average particle diameter of the precipitates is in a range of 4.0 nm to 25.0 nm or the proportion of the number of precipitates having a particle diameter in a range of 4.0 nm to 25.0 nm in the precipitates is 70% or more. In addition, the copper alloy sheet for terminal and connector materials contains 4.5 mass % to 12.0 mass % of Zn, 0.40 mass % to 0.9 mass % of Sn, 0.01 mass % to 0.08 mass % of P and 0.20 mass % to 0.85 mass % of Ni with a remainder of Cu and inevitable impurities. The content of Zn [Zn] (mass %), the content of Sn [Sn] (mass %), the content of P [P] (mass %) and the content of Ni [Ni] (mass %) have a relationship of $11 \leq [Zn]+7.5\times[Sn]+16\times[P]+3.5\times[Ni] \leq 19$, and have a relationship of $7 \leq [Ni]/[P] \leq 40$ in a case in which the content of Ni is in a range of 0.35 mass % to 0.85 mass %.

Since the average grain diameter of the crystal grains in the copper alloy material before cold rolling and the average particle diameter of the precipitates are in the above-described predetermined preferred ranges in the copper alloy steel sheet for terminal and connector materials, tensile strength, proof stress, Young's modulus, electric conductivity, bending workability, stress corrosion crack resistance, solderability and the like are excellent. In addition, in a case in which the content of Ni is in a range of 0.35 mass % to 0.85 mass %, since $7 \leq [Ni]/[P] \leq 40$ is satisfied, the percentage of stress relaxation is more favorable.

The preferred ranges of the average grain diameter of the crystal grains and the average particle diameter of the precipitates will be described below.

The copper alloy sheet for terminal and connector materials according to a second embodiment is obtained through the cold finish rolling of a copper alloy material. The average crystal grain diameter of the copper alloy material is in a range of 2.0 μm to 8.0 μm. Circular or elliptical precipitates are present in the copper alloy material, and the average particle diameter of the precipitates is in a range of 4.0 nm to 25.0 nm or the proportion of the number of precipitates having a particle diameter in a range of 4.0 nm to 25.0 nm in the precipitates is 70% or more. In addition, the copper alloy sheet for terminal and connector materials contains 4.5 mass % to 12.0 mass % of Zn, 0.40 mass % to 0.9 mass % of Sn, 0.01 mass % to 0.08 mass % of P, 0.20 mass % to 0.85 mass % of Ni and any one or both of 0.005 mass % to 0.08 mass % of Co and 0.004 mass % to 0.04 mass % of Fe with a remainder of Cu and inevitable impurities. The content of Zn [Zn] (mass %), the content of Sn [Sn] (mass %), the content of P [P] (mass %), the content of Co [Co] (mass %) and the content of Ni [Ni] (mass %) have a relationship of $11 \leq [Zn]+7.5\times[Sn]+16\times[P]+10\times[Co]+3.5\times[Ni] \leq 19$, and have a relationship of $7 \leq [Ni]/[P] \leq 40$ in a case in which the content of Ni is in a range of 0.35 mass % to 0.85 mass %.

Since any one or both of 0.005 mass % to 0.08 mass % of Co and 0.004 mass % to 0.04 mass % of Fe are contained, the crystal grains are miniaturized, and the strength can be increased. In addition, since $7 \leq [Ni]/[P] \leq 40$ is satisfied in a case in which the content of Ni is in a range of 0.35 mass % to 0.85 mass %, the percentage of stress relaxation is also favorable.

The copper alloy sheet for terminal and connector materials according to a third embodiment is obtained through the cold finish rolling of a copper alloy material. The average crystal grain diameter of the copper alloy material is in a range of 2.0 μm to 8.0 μm. Circular or elliptical precipitates are present in the copper alloy material, and the average particle diameter of the precipitates is in a range of 4.0 nm to 25.0 nm or the proportion of the number of precipitates having a particle diameter in a range of 4.0 nm to 25.0 nm in the precipitates is 70% or more. In addition, the copper alloy sheet for terminal and connector materials contains 8.5 mass % to 12.0 mass % of Zn, 0.40 mass % to 0.9 mass % of Sn, 0.01 mass % to 0.08 mass % of P, and 0.40 mass % to 0.85 mass % of Ni with a remainder being Cu and inevitable impurities, and the content of Zn [Zn] (mass %), the content of Sn [Sn] (mass %), the content of P [P] (mass %), and the content of Ni [Ni] (mass %) have a relationship of $17 \leq [Zn]+7.5\times[Sn]+16\times[P]+3.5\times[Ni] \leq 19$ and have a relationship of $7 \leq [Ni]/[P] \leq 40$ and $0.55 \leq [Ni]/[Sn] \leq 1.9$.

The copper alloy sheet for terminal and connector materials according to a fourth embodiment is obtained through the cold finish rolling of a copper alloy material. The average crystal grain diameter of the copper alloy material is in a range of 2.0 μm to 8.0 μm. Circular or elliptical precipitates are present in the copper alloy material, and the average particle diameter of the precipitates is in a range of 4.0 nm to 25.0 nm or the proportion of the number of precipitates having a particle diameter in a range of 4.0 nm to 25.0 nm in the precipitates is 70% or more. In addition, the copper alloy sheet for terminal and connector materials contains 8.5 mass % to 12.0 mass % of Zn, 0.40 mass % to 0.9 mass % of Sn, 0.01 mass % to 0.08 mass % of P, 0.40 mass % to 0.85 mass % of Ni, and any one or both of 0.005 mass % to 0.08 mass % of Co and 0.004 mass % to 0.04 mass % of Fe with a remainder being Cu and inevitable impurities, and the content of Zn [Zn] (mass %), the content of Sn [Sn] (mass %), the content of P [P] (mass %), the content of Co [Co] (mass %), and the content of Ni [Ni] (mass %) have a relationship of $17 \leq [Zn]+7.5\times[Sn]+16\times[P]+10\times[Co]+3.5\times[Ni]19$ and have a relationship of $7 \leq [Ni]/[P] \leq 40$ and $0.55 \leq [Ni]/[Sn] \leq 1.9$.

Since the amount of Zn is set in a range of 8.5 mass % to 12.0 mass %, the amount of Ni is set in a range of 0.40 mass % to 0.85 mass %, the relationship of $17 \leq [Zn]+7.5\times[Sn]+16\times[P]+10\times[Co]+3.5\times[Ni] \leq 19$ is satisfied, and $7 \leq [Ni]/[P] \leq 40$ and $0.55 \leq [Ni]/[Sn] \leq 1.9$ are satisfied, higher strength can be obtained, and it is possible to improve the balance among strength, stress relaxation resistance, bending workability, stress corrosion crack resistance, and Young's modulus.

Next, a preferred manufacturing step for the copper alloy sheet for terminal and connector materials according to the embodiment will be described.

The manufacturing step sequentially includes a hot rolling step, a first cold rolling step, an annealing step, a second cold rolling step, a recrystallization thermal treatment step, and the above-described cold finish rolling step. Ranges for manufacturing conditions necessary for the respective steps are set, and the ranges are referred to as the set condition ranges. Meanwhile, since the copper alloy sheet for terminal and connector materials according to the embodiment is manufactured using the manufacturing step including the cold finish rolling as described above, hereinafter, the copper alloy sheet for terminal and connector materials will also be referred to as the rolled sheet as appropriate.

The composition of an ingot used for the hot rolling is adjusted so that the copper alloy sheet for terminal and connector materials contains 4.5 mass % to 12.0 mass % of Zn, 0.40 mass % to 0.9 mass % of Sn, 0.01 mass % to 0.08 mass % of P, and 0.20 mass % to 0.85 mass % of Ni with a remainder being Cu and inevitable impurities, the composition index f1 is in a range of $11 \leq f1 \leq 19$, and $7 \leq [Ni]/[P] \leq 40$ is satisfied in a case in which the content of Ni is in a range of 0.35 mass % to 0.85 mass %. An alloy having the above-described composition will be referred to as the first invention alloys.

In addition, the composition of an ingot used for the hot rolling is adjusted so that the copper alloy sheet for terminal and connector materials contains 4.5 mass % to 12.0 mass % of Zn, 0.40 mass % to 0.9 mass % of Sn, 0.01 mass % to 0.08 mass % of P, 0.20 mass % to 0.85 mass % of Ni, and any one or both of 0.005 mass % to 0.08 mass % of Co and 0.004 mass % to 0.04 mass % of Fe with a remainder being Cu and inevitable impurities, the composition index f1 is in a range of $11 \leq f1 \leq 19$, and $7 \leq [Ni]/[P] \leq 40$ is satisfied in a case in which the content of Ni is in a range of 0.35 mass % to 0.85 mass %. An alloy having the above-described composition will be referred to as the second invention alloy.

Furthermore, the composition of an ingot used for the hot rolling is adjusted so that the copper alloy sheet for terminal and connector materials contains 8.5 mass % to 12.0 mass % of Zn, 0.40 mass % to 0.9 mass % of Sn, 0.01 mass % to 0.08 mass % of P, and 0.40 mass % to 0.85 mass % of Ni with a remainder being Cu and inevitable impurities, the composition index f1 is in a range of 1719, and $7 \leq [Ni]/[P] \leq 40$ and $0.55 \leq [Ni]/[Sn] \leq 1.9$ are satisfied. An alloy having the above-described composition will be referred to as the third invention alloy.

In addition, the composition of an ingot used for the hot rolling is adjusted so that the copper alloy sheet for terminal and connector materials contains 8.5 mass % to 12.0 mass % of Zn, 0.40 mass % to 0.9 mass % of Sn, 0.01 mass % to 0.08 mass % of P, 0.40 mass % to 0.85 mass % of Ni, and any one or both of 0.005 mass % to 0.08 mass % of Co and 0.004 mass % to 0.04 mass % of Fe with a remainder being Cu and inevitable impurities, the composition index f1 is in a range of $17 \leq f1 \leq 19$, and $7 \leq [Ni]/[P] \leq 40$ and $0.55 \leq [Ni]/[Sn] \leq 1.9$ are satisfied. An alloy having the above-described composition will be referred to as the fourth invention alloy.

The first invention alloy, the second invention alloy, the third invention alloy and the fourth invention alloy will be collectively referred to as the invention alloys.

In the hot rolling step, the hot rolling initial temperature is in a range of 800° C. to 940° C., and the cooling rate of a rolled material in a temperature range of a temperature after final rolling to 350° C. or in a temperature range of 650° C. to 350° C. is 1° C./second or more.

In the first cold rolling step, the percentage of cold working is 55% or more.

The annealing step has conditions that satisfy $D0 \leq D1 \times 4 \times (RE/100)$ when the crystal grain diameter after the recrystallization thermal treatment step is represented by D1, the crystal grain diameter before the recrystallization thermal treatment step and after the annealing step is represented by D0, and the percentage of cold working of the second cold rolling between the recrystallization thermal treatment step and the annealing step is represented by RE (%) as described below. The conditions are that, for example, in a case in which the annealing step includes a heating step of heating the copper alloy material to a predetermined temperature, a holding step of holding the copper alloy material at a predetermined temperature for a predetermined time after the heating step and a cooling step of cooling the copper alloy material to a predetermined temperature after the holding step, when a peak temperature of the copper alloy material is represented by Tmax (° C.), a holding time in a temperature range of a temperature 50° C. lower than the peak temperature of the copper alloy material to the peak temperature is represented by tm (min), and the percentage of cold working in the first cold rolling step is represented by RE (%), $420 \leq Tmax \leq 800$, $0.04 \leq tm \leq 600$, and $390 \leq \{Tmax - 40 \times tm^{-1/2} - 50 \times (1 - RE/100)^{1/2}\} \leq 580$.

It is important that the annealing step satisfies $D0 \leq D1 \times 4 \times (RE/100)$, and, needless to say, the annealing step may be a batch-type thermal treatment or may be carried out at a temperature in a range of 420° C. to 580° C. for longer than 600 minutes.

The first cold rolling step and the annealing step may not be carried out in a case in which the sheet thickness of the rolled sheet after the cold finish rolling step is thick, and the first cold rolling step and the annealing step may be carried out a plurality of times in a case in which the sheet thickness is thin. Whether or not the first cold rolling step and the annealing step are carried out or the number of times of the first cold rolling step and the annealing step are determined by the relationship between the sheet thickness after the hot rolling step and the sheet thickness after the cold finish rolling step.

The recrystallization thermal treatment step includes a heating step of heating the copper alloy material to a predetermined temperature, a holding step of holding the copper alloy material at a predetermined temperature for a predetermined time after the heating step and a cooling step of cooling the copper alloy material to a predetermined temperature after the holding step.

Here, when the peak temperature of the copper alloy material is represented by Tmax (° C.), and the holding time in a temperature range of a temperature 50° C. lower than the peak temperature of the copper alloy material to the peak temperature is represented by tm (min), the recrystallization thermal treatment step satisfies the following conditions.

(1) $550 \leq$ peak temperature $Tmax \leq 790$ (2) $0.04 \leq$ holding time $tm \leq 2$ (3) $460 \leq$ thermal treatment index $It \leq 580$ There are also cases in which a recovery thermal treatment step is carried out after the recrystallization thermal treatment step as described below, but the recrystallization thermal treatment step becomes the final thermal treatment in which the copper alloy material is recrystallized.

After the recrystallization thermal treatment step, the copper alloy material has a metallic structure in which the average crystal grain diameter is in a range of 2.0 μm to 8.0 μm, circular or elliptical precipitates are present, the average particle diameter of the precipitates is in a range of 4.0 nm to 25.0 nm or the proportion of precipitates having a particle diameter in a range of 4.0 nm to 25.0 nm in the precipitates is 70% or more.

In the cold finish rolling step, the percentage of cold working is in a range of 20% to 65%.

The recovery thermal treatment step may be carried out after the cold finish rolling step. In addition, depending on use, there are cases in which the copper alloy sheet for terminal and connector materials according to the embodiment is plated with Sn after finish rolling, Sn is melted during plating such as molten Sn plating or reflow Sn plating, and the surface temperature of the material increases, and therefore it is possible to replace the recovery thermal treatment step with a heating process step during the plating treatment.

The recovery thermal treatment step includes a heating step of heating the copper alloy material to a predetermined temperature, a holding step of holding the copper alloy material at a predetermined temperature for a predetermined time after the heating step and a cooling step of cooling the copper alloy material to a predetermined temperature after the holding step.

Here, when the peak temperature of the copper alloy material is represented by Tmax (° C.), and the holding time in a temperature range of a temperature 50° C. lower than the peak temperature of the copper alloy material to the peak temperature is represented by tm (min), the recrystallization thermal treatment step satisfies the following conditions.

(1) 160≤peak temperature Tmax≤650

(2) 0.02≤holding time tm≤200

(3) 60≤thermal treatment index It≤360

Next, the reasons for adding the respective elements will be described.

Zn is an important element that configures the invention, has a divalent atomic valence, decreases the stacking-fault energy, increases the number of generation sites of recrystallization nuclei during annealing, and miniaturizes or ultra-miniaturizes recrystallized grains. In addition, the formation of a solid solution of Zn improves tensile strength, proof stress, spring characteristics and the like without impairing bending workability, improves the thermal resistance of the matrix, improves stress relaxation characteristics and stress relaxation characteristics, and improves solderability and migration resistance. Zn also has economic merits of a cheap metal cost and a decrease in the specific gravity of the copper alloy. While depending on the relationship with other elements being added, such as Sn, in order to exhibit the above-described effects, the content of Zn needs to be at least 4.5 mass % or more, is preferably 5.0 mass % or more, and optimally 5.5 mass % or more. On the other hand, while depending on the relationship with other elements being added, such as Sn, even when more than 12.0 mass % of Zn is contained, regarding the miniaturization of crystal grains and the improvement of the strength, the exhibition of the significant effects commensurate with the content begins to stop such that the electric conductivity decreases, the Young's modulus decreases, the elongation and the bending workability deteriorate, the thermal resistance and the stress relaxation characteristics degrade, the sensitivity of stress corrosion crack increases, and the solderability also deteriorates. The content of Zn is preferably 11 mass % or less. When the content of Zn is in the set range of the present application, and optimally in a range of 5.0 mass % to 11 mass %, the thermal resistance of the matrix improves, particularly, the stress relaxation characteristics improve due to the interaction with Ni, Sn and P, and excellent bending workability, high strength, high Young's modulus, and desired electric conductivity are provided. Even when the content of Zn having a divalent atomic valence is within the above-described range, if Zn is solely added, it is difficult to miniaturize crystal grains, and therefore, in order to miniaturize crystal grains to a predetermined grain diameter, it is necessary to consider the value of the composition index f1 along with the co-addition of Zn with Sn, Ni and P described below. Similarly, in order to improve thermal resistance, stress relaxation characteristics, strength and spring characteristics, it is necessary to consider the value of the composition index f1 along with the co-addition of Zn with Sn, Ni and P described below.

Meanwhile, when the content of Zn is 8.5 mass % or more, and furthermore, 9 mass % or more, high tensile strength and high proof stress can be obtained; however, as the amount of Zn increases, bending workability, stress relaxation characteristics, and stress corrosion crack resistance deteriorate, and, additionally, Young's modulus decreases as described above. In order to make the above-described characteristics superior by improving the characteristics, the interaction with Ni or Sn and the value of the composition index f1 become important.

Sn is an important element that configures the invention, has a tetravalent atomic valence, decreases the stacking-fault energy, increases the number of generation sites of recrystallization nuclei during annealing in cooperation with Zn being contained, and miniaturizes or ultra-miniaturizes recrystallized grains. Particularly, when 4.5 mass % or more, preferably 5.0 mass % or more and more preferably 5.5 mass % or more of divalent Zn is added together, the effect of Sn is significantly exhibited in spite of a small amount of Sn being contained. In addition, Sn forms a solid solution in the matrix, improves tensile strength, proof stress, spring characteristics and the like, improves the thermal resistance of the matrix, improves stress relaxation characteristics, and also improves stress corrosion crack resistance. In order to exhibit the above-described effects, the content of Sn needs to be at least 0.40 mass % or more, preferably 0.45 mass % or more, and optimally 0.50 mass % or more. On the other hand, Sn being contained deteriorates electric conductivity, and, while also depending on the relationship with other elements such as Zn, when the content of Sn exceeds 0.9 mass %, a high electric conductivity of 29% IACS or more that is approximately 30% or more of the electric conductivity of pure copper cannot be obtained, bending workability, Young's modulus, solderability, stress relaxation characteristics and stress corrosion crack resistance are degraded. The content of Sn is preferably 0.85 mass % or less, and optimally 0.80 mass % or less.

Cu is a major element that configures the invention alloys, and thus is treated as a remainder. However, in order to ensure the electric conductivity and the stress corrosion crack resistance which are dependent on the concentration of Cu, and to hold stress relaxation characteristics, elongation, Young's modulus and solderability for achieving the invention, the content of Cu is preferably 87 mass % or more. On the other hand, in order to obtain high strength, the content of Cu is preferably set to 94 mass % or less.

P has a pentavalent atomic valence, and has an action that miniaturizes crystal grains and an action that suppresses the growth of recrystallized grains; however, since the content of P is small, the latter action is greater. Some of P compounds with Ni described below and, furthermore, Co or Fe so as to form precipitates, thereby further intensifying the effect that suppress the growth of recrystallized grains. In order to suppress the growth of recrystallized grains, circular and elliptical precipitates need to be present, the average particle diameter of the precipitates needs to be in a range of 4.0 nm to 25.0 nm or the proportion of the number of precipitated grains having a particle diameter in a range of 4.0 nm to 25.0 nm in precipitated grains needs to be 70% or more. Precipitates belonging to the above-described range have a greater action or effect that suppresses the growth of recrystallized grains during annealing than precipitation strengthening, and is differentiated from a strengthening action that is brought about simply by precipitation. In addition, the above-described precipitates have an effect that improves the stress relaxation characteristics. Additionally, P has an effect that significantly improves stress relaxation characteristics which is one of the main subjects of the application due to the interaction with Ni along with Zn and Sn being contained in the ranges of the application.

In order to exhibit the above-described effect, the content of P needs to be at least 0.010 mass % or more, is preferably 0.015 mass % or more, and optimally 0.020 mass % or more. On the other hand, even when more than 0.080 mass % of P is contained, the effect of the precipitates that suppressed the growth of recrystallized grains is saturated, and conversely, when precipitates are excessively present, elongation and bending workability degrade. The content of P is preferably 0.070 mass % or less.

Some of Ni bonds with P or bonds with P and Co so as to form a compound, and the rest of Ni forms a solid solution.

The interaction of Ni with P, Zn and Sn which are contained in the concentration ranges specified in the application improves stress relaxation characteristics, increases the Young's modulus of the alloy, and improves solderability and stress corrosion crack resistance, and the compound being formed suppresses the growth of recrystallized grains. In order to exhibit the above-described actions, the content of Ni needs to be at least 0.20 mass % or more. Particularly, the effect that improves stress relaxation characteristics is significantly exhibited when the content of Ni is 0.35 mass %, and the effect becomes more significant when the content of Ni is 0.40 mass % or more, and furthermore 0.50 mass % or more. On the other hand, since an increase in the amount of Ni impairs electric conductivity, and also saturates stress relaxation characteristics, the content of Ni is 0.85 mass % or less, and optimally 0.80 mass % or less. In addition, regarding the relationship with Sn, in order to satisfy a relational formulae of the composition described below and to particularly improve stress relaxation characteristics, Young's modulus and bending workability, the content of Ni is preferably in a range of 0.5 times to 0.55 times the content of Sn, and more preferably 0.6 times or more the content of Sn. This is because, regarding atomic concentration, when the content of Ni is equal to or slightly more than the content of Sn, stress relaxation characteristics improve. On the other hand, the content of Ni is preferably suppressed to 2 times or less the content of Sn, more preferably 1.9 times or less the content of Sn, and optimally 1.8 times or less the content of Sn in consideration of the relationship with strength, electric conductivity and stress relaxation characteristics. In summary, in order to obtain excellent stress relaxation characteristics, high strength and high electric conductivity, [Ni]/[Si] is 0.5 or more, and preferably 0.55 or more, and is 2 or less, and preferably 1.9 or less.

In a case in which it is necessary to provide particularly high strength to terminals and connectors, an alloy having favorable characteristics such as stress relaxation characteristics, stress corrosion crack resistance, bending workability and Young's modulus is obtained when $17 \leq [Zn]+7.5\times[Sn]+16\times[P]+10\times[Co]+3.5\times[Ni] \leq 19$ described below is satisfied, in a case in which the content of Zn is 8.5 mass % or more, the content of Ni is preferably in a range of 0.4 mass % to 0.85 mass %, more preferably in a range of 0.45 mass % to 0.85 mass %, and still more preferably in a range of 0.5 mass % to 0.85 mass %, and [Ni]/[Sn] is 0.55 or more, preferably 0.6 or more and 1.9 or less and preferably 1.8 or less. In order to improve the above-described characteristics, it is necessary to increase the amount of Ni as the content of Zn increases, and, in another expression, regarding the relationship between Zn and Ni, when a relational formulae [Ni]/[Zn+1.5] is 0.04 or more, an alloy having favorable balance between high strength and other characteristics is obtained.

Meanwhile, the blending ratio of Ni to P is important, and, in order to improve stress relaxation characteristics, when the content of Ni is in a range of 0.35 mass % to 0.85 mass % or 0.4 mass % to 0.85 mass %, [Ni]/[P] is preferably 7 or more, and more preferably 8 or more. In addition, bending workability becomes favorable when [Ni]/[P] is 8 or more. The upper limit may be 40 or less, and is preferably 30 or less, and the strength becomes higher when [Ni]/[P] is 30 or less.

Some of Co bonds with P or bonds with P and Ni so as to form a compound, and the rest of Co forms a solid solution. Co suppresses the growth of recrystallized grains, and improves stress relaxation characteristics. In order to exhibit the effect, the content of Co needs to be 0.005 mass % or more, and is preferably 0.010 mass % or more. On the other hand, even when 0.08 mass % or more of Co is contained, the effect becomes saturated, the effect that suppresses the growth of crystal grains becomes excessive, it becomes impossible to obtain crystal grains having a desired size, and electric conductivity degrades depending on manufacturing steps. Furthermore, since the number of precipitates increases or the grain diameters of precipitates become small, bending workability degrades, and mechanical properties become likely to be anisotropic. The content of Co is preferably 0.04 mass % or less, and optimally 0.03 mass % or less.

In order to further exhibit the effect of Co that suppresses the growth of crystal grains and to suppress the degradation of the electric conductivity to the minimum extent, [Co]/[P] is 0.15 or more, and preferably 0.3 or more. On the other hand, the upper limit is 2.5 or less, and preferably 2 or less.

Fe can be used in the same manner as Co. That is, when the content of Fe is 0.004 mass % or more, similarly to when Co is contained, due to the formation of a Fe—Ni—P or Fe—Ni—Co—P compound, the effect that suppresses the growth of crystal grains is exhibited, and strength and stress relaxation characteristics are improved. However, the grain diameter of the Fe—Ni—P compound or the like being formed is smaller than that of the Ni—Co—P compound. As described below, it is necessary to satisfy the conditions that the average particle diameter of the precipitates is in a range of 4.0 nm to 25.0 nm or the proportion of precipitates having a particle diameter in a range of 4.0 nm to 25.0 nm in the precipitates is 70% or more. Furthermore, since the number of precipitate grains also has an influence, the upper limit of Fe is 0.04 mass %, and preferably 0.03 mass %. When Fe is contained in a combination of P—Ni or P—Co—Ni, the form of the compound becomes P—Ni—Fe or P—Co—Ni—Fe. When the concentration of Fe is managed in the preferred range, particularly, a material having high strength, high electric conductivity and favorable balance between bending workability and stress relaxation characteristics is obtained.

Therefore, Fe can be effectively used to procure the object of the invention.

In addition, in the copper alloy sheet for terminal and connector materials according to the first embodiment and the copper alloy sheet for terminal and connector materials according to the second embodiment, the electric conductivity is 29% IACS or more, the percentage of stress relaxation is 30% or less at 150° C. for 1000 hours as the stress relaxation resistance, bending workability is $R/t \leq 0.5$ at W bending, solderability is excellent and a Young's modulus is $100\times10^3$ N/mm$^2$ or more.

Furthermore, in the copper alloy sheet for terminal and connector materials according to the third embodiment and the copper alloy sheet for terminal and connector materials according to the fourth embodiment, the electric conductivity is 29% IACS or more, the percentage of stress relaxation is 30% or less at 150° C. for 1000 hours as the stress relaxation resistance, bending workability is $R/t \leq 0.5$ at W bending, solderability is excellent, stress corrosion crack resistance is excellent and a Young's modulus is $100\times10^3$ N/mm$^2$ or more.

Next, the respective characteristics will be described.

Since terminals and connectors are required to have strict bending workability such as box bending along with high strength, bending workability of $R/t \leq 0.5$ in terms of W bending becomes an essential condition. Particularly, in use for terminals and connectors, bending workability is preferably $R/t \leq 0.5$ at W bending with respect to bending in directions both parallel and perpendicular to a rolling direction. Meanwhile, in order to obtain a large contact pressure and a large spring pressure in terminals and connectors with a small displacement, the Young's modulus needs to be 100 $kN/mm^2$, and is preferably 110 $kN/mm^2$ or more. Meanwhile, the upper limit is forcibly expressed to be 150 $kN/mm^2$ or less. In addition, when used at, for example, places near vehicle engine rooms, the temperature of terminals and connectors are increased up to approximately 100° C., the percentage of stress relaxation needs to be at least 30% or less in a state in which a stress of 80% of the proof stress of an alloy is added at 150° C. for 1000 hours. This is because, when the percentage of stress relaxation becomes great, substantially, strength (contact pressure and spring pressure) is impaired as much as the percentage of stress relaxation. Furthermore, generally, the surfaces of terminals and connectors are plated with Sn for corrosion resistance, contact resistance and joining. Molten Sn plating or reflow Sn plating is carried out on a copper alloy sheet in a coil (strip) shape, or Sn plating is carried out after a terminal or connector shape is formed. Therefore, in terminal and connector use, Sn platability, that is, solderability needs to be favorable. Meanwhile, Sn platability has no problems particularly in a coil shape; however, in a case in which Sn plating, particularly, Pb-free solder plating is carried out after the copper alloy sheet is molded into a terminal or a connector, there are cases in which plating is carried out not immediately after molding but after a certain period of time elapses for production aspects, and therefore there is a concern that platability or solderability may deteriorate due to surface oxidation occurring during the above-described period of time. In terms of materials, there is a demand for a copper alloy having favorable solderability, being highly resistant to surface oxidation even after surface oxidation has somewhat proceeded, and having favorable solderability after being left in the atmosphere. There are a variety of methods for evaluating solderability, but it is appropriate to evaluate solderability using a period of time within which solder becomes soaked from the viewpoint of industrial production.

Meanwhile, in order to obtain the balance between strength and elongation, high strength, favorable spring characteristics, high electric conduction, favorable stress relaxation characteristics, high Young's modulus and favorable solderability, it is necessary to consider not only the mixing amounts of Zn, Sn, P, Ni, Co and Fe but also the correlations between the respective elements. While the stacking-fault energy can be decreased by Zn having a divalent atomic valence and Sn having a tetravalent atomic valence being contained, both of which are added in a large amount, the miniaturization of crystal grains by the synergetic effect of P, Ni, Co and Fe being contained, the balance between strength and elongation, the difference in strength and bending workability between in a direction forming 0 degrees and in a direction forming 90 degrees with respect to the rolling direction, electric conductivity, stress relaxation characteristics, stress corrosion crack resistance and the like should be taken into consideration. It was clarified by the inventors' studies that the respective elements needs to satisfy $11 \leq [Zn]+7.5\times[Sn]+16\times[P]+10\times[Co]+3.5\times[Ni] \leq 19$ within the ranges of the contents of the invention alloys. Meanwhile, regarding Fe, when the content thereof is small, and the coefficient is small, there is little influence on the relational formulae, and therefore Fe can be ignored. When the above-described relationship is satisfied, a material that is excellent in terms of strength, bending workability, stress relaxation characteristics, electric conductivity, Young's modulus and the like, and has obtained a high degree of balance among the above-described characteristics can be obtained (Composition index $f1=[Zn]+7.5\times[Sn]+16\times[P]+10\times[Co]+3.5\times[Ni]$).

That is, in order for a final rolled material to be highly electrically conductive with an electric conductivity of 29% IACS or more and have favorable strength with tensile strength of 500 $N/mm^2$ or more, proof stress of 480 $N/mm^2$ or more, high Young's modulus of $100\times10^3$ $N/mm^2$ or more, high thermal resistance, high stress relaxation characteristics with a percentage of stress relaxation of 30% or less at 150° C. for 1000 hours, a small average crystal grain diameter, slightly anisotropic strength, excellent bending workability of $R/t \leq 0.5$ at W bending, favorable elongation and favorable solderability, it is necessary to satisfy $11 \leq f1 \leq 19$. Regarding $11 \leq f1 \leq 19$, the lower limit particularly affects the miniaturization of crystal grains, strength, stress relaxation characteristics, and thermal resistance, and is preferably 11.5 or more. In addition, the upper limit particularly affects electric conduction, bending workability, Young's modulus, stress relaxation characteristics, stress corrosion crack resistance and solderability, and is preferably 18.5 or less, and optimally 18 or less. When Zn, Sn, Ni, P, co and Fe which are major elements are managed in narrower ranges, a rolled material obtains a higher degree of balance among electric conduction, strength and elongation.

In addition, for example, in a case in which high strength, that is, tensile strength of 550 $N/mm^2$ or more is required, the content of Zn is preferably 8.5 mass % or more, and particularly preferably 9 mass % or more with $17 \leq [Zn]+7.5\times[Sn]+16\times[P]+10\times[Co]+3.5\times[Ni] \leq 19$ being satisfied. However, while the strength of the alloy increases, stress relaxation characteristics, stress corrosion crack resistance and bending workability deteriorate, and Young's modulus becomes small. In order to obtain favorable stress relaxation characteristics, favorable stress corrosion crack resistance and favorable bending workability, and to obtain a more preferred Young's modulus of $110\times10^3$ $N/mm^2$ or more, the content of Ni is preferably in a range of 0.4 mass % to 0.85 mass %, more preferably in a range of 0.45 mass % to 0.85 mass %, still more preferably in a range of 0.5 mass % 0.85 mass %; [Ni]/[P] is 7 or more, preferably 8 or more, and is 40 or less, preferably 30 or less; [Ni]/[Sn] is 0.55 or more, preferably 0.6 or more, and is 1.9 or less, preferably 1.8 or less. In addition, in the relationship between Zn and Ni, a relational formulae [Ni]/[Zn+1.5] is preferably 0.04 or more.

Regarding the spring bending elastic limit, the maximum surface stress value, that is, the value of Kb0.1 is desirably 400 $N/mm^2$ or more when repeated flexural deformation is provided, and when the permanent displacement amount becomes 0.1 mm as described in JIS H3130 7.4. Meanwhile, the lower limit of the electric conductivity is approximately 30% or more of that of pure copper in the present use for terminals and connectors, and, when quantified, is 29% IACS or more, preferably 31% IACS or more, and optimally 34% IACS or more. The upper limit of the electric conductivity is not particularly required to exceed 44% IACS for members that are the subjects of the application, and members having high strength, high Young's modulus, more favorable stress relaxation characteristics, excellent bending workability and excellent solderability are useful. Depending on use, there are cases in which spot welding is carried out, and, when the electric conductivity is too high, a disadvantage may be, sometimes, caused, and therefore the electric conductivity is preferably set to 44% IACS or less, and more preferably set to 42% IACS or less.

Meanwhile, regarding the ultra-miniaturization of crystal grains, it is possible to ultra-miniaturize recrystallized grains up to 1.5 μm in an alloy within the composition range of the invention alloys. However, when crystal grains in the present alloy are miniaturized up to 1.5 μm, the proportion of crystal grain boundaries formed in a width of approximately several atoms increases, and elongation, bending workability and stress relaxation characteristics deteriorate. Therefore, in order to have high strength, high elongation and favorable stress relaxation characteristics, the average crystal grain diameter needs to be 2.0 μm or more, is preferably 2.5 μm or more, and more preferably 3.0 μm or more. On the other hand, as the size of crystal grains increases, more favorable elongation and more favorable bending workability appear, but it becomes impossible to obtain desired tensile strength and desired proof stress. The average crystal grain diameter needs to be at least 8.0 μm or less. The average crystal grain diameter is more preferably 7.5 μm or less, and, when strength is considered to be important, 6.0 μm or less, and optimally 5.0 μm or less. On the other hand, in a case in which stress relaxation characteristics are required, when crystal grains are too fine, since stress relaxation characteristics become poor, the average crystal grain diameter is preferably 2.5 μm or more, and more preferably 3.0 μm or more. As described above, when the average crystal grain diameter is also set in a narrower range, it is possible to obtain a high degree of excellent balance among bending workability, elongation, strength, electric conduction and stress relaxation characteristics.

Meanwhile, for example, when a rolled material that has been cold-rolled at a percentage of cold working of 55% or more is annealed, while the time also has an influence, if the temperature exceeds a certain threshold temperature, recrystallization nuclei are generated mainly in crystal grain boundaries in which process strain is accumulated. While the alloy composition also has an influence, in the case of the present invention alloys, recrystallized grains generated after nucleation are recrystallized grains having a grain diameter of 1 μm or 2 μm or less; however, there is no case in which the entire processed structure is changed into recrystallized grains at once even when the rolled material is heated. In order to change all or, for example, 97% or more of the processed structure into recrystallized grains, a temperature higher than the temperature at which the nucleation for recrystallization begins or a time longer than the time in which the nucleation for recrystallization begins are required. During this annealing, the initially-generated recrystallized grains grow as the temperature and the time increase, and the crystal grain diameter increases. In order to maintain a small diameter of recrystallized grains, it is necessary to suppress the growth of recrystallized grains. In order to achieve the object, P and Ni or Co and Fe are contained. In order to suppress the growth of recrystallized grains, things such as pins that suppress the growth of recrystallized grains are required, and, in the invention alloy, the equivalent of the pin is a compound made up of P, Ni, Co and Fe which is optimal for playing a role of the pin. In order for the compound to play a role of the pin, the properties of the compound and the grain diameter of the compound are important. That is, it was found from the study results that, basically, the compound made up of P, Ni, Co and Fe rarely impairs elongation within the composition ranges of the invention, and, particularly, when the grain diameter of the compound is in a range of 4.0 nm to 25.0 nm, the growth of crystal grains is effectively suppressed with elongation rarely impaired. Furthermore, it was clarified from the properties of the compound that, irrespective of Co and Fe being contained, when [Ni]/[P] exceeds 7, stress relaxation characteristics become favorable, and bending workability and isotropy (the difference in characteristics between 0 degrees and 90 degrees) become favorable, and furthermore, when [Ni]/[P] exceeds 8, a greater effect is generated, and the effect becomes more significant. Similarly, when [Ni]/[P] is smaller than 40, stress relaxation characteristics become favorable, strength increases, isotropy becomes favorable, and furthermore, when [Ni]/[P] is smaller than 30, a greater effect is generated, and the effect becomes more significant. Meanwhile, in a case in which P, Ni and Co or Fe are added together, the precipitates being formed have an average grain diameter in a range of 4.0 nm to 20.0 nm; the grain diameter of the precipitates decreases as the content of Co or Fe increases; and the precipitated grain diameter increases as the content of Ni increases. In addition, in a case in which P and Ni are added together, the precipitated grain diameter is as large as 5.0 nm to 25.0 nm. In a case in which P and Ni are added together, the effect that suppresses the growth of crystal grains becomes weak, and the influence on elongation is smaller. Meanwhile, in a case in which P and Ni are added together, the compounding state of the precipitates is considered to be mainly $Ni_3P$ or $Ni_2P$, and, in a case in which P, Ni and Co or Fe are added together, the compounding state of the precipitates is considered to be $Ni_xCo_yP$ or $Ni_xFe_yP$ (x and y are changed by the contents of Ni, Co and Fe). Meanwhile, the precipitates obtained in the application have a positive action on stress relaxation characteristics. Meanwhile, in a case in which the grain diameter of the precipitates is small, and the compound is made up of Co or Fe and P as well as Ni, when the Co content is 0.08 mass % or the Fe content exceeds 0.04 mass %, the amount of the precipitates becomes too large, and the action that suppresses the growth of recrystallized grains is too great such that the grain diameter of the recrystallized grains becomes small, and conversely, stress relaxation characteristics and bending workability deteriorate.

The properties of the precipitates are important, and a combination of P—Ni, P—Co—Ni, P—Fe—Ni, or P—Co—Fe—Ni is preferable, and, when, for example, Mn, Mg, Cr and the like also form a compound with P and are contained in a certain amount or more, the composition of the precipitates changes, and there is a concern that elongation may be impaired.

Therefore, it is necessary to manage elements such as Cr at a concentration at which the elements do not have any influence. The conditions are that the concentration of each element is at least 0.03 mass % or less, and preferably 0.02 mass % or less, or the total content of elements such as Cr which compound with P is 0.04 mass % or less, and preferably 0.03 mass % or less. When Cr and the like are contained, the composition and structure of the precipitates are changed so that there are huge influences, particularly, on elongation, bending workability and solderability. Meanwhile, when the total content of elements such as Cr which compound with P is 0.04 mass % or less, there is little influence on the relational formulae of f1. In addition, in the composition of a drawn copper product, it is common to consider that Ag is contained in Cu, and there are cases in which elements such as O, S, Mg, Ti, Si, As, Ga, Zr, In, Sb, Pb, Bi and Te as well as Ag are inevitably incorporated, but there is little influence on the relational formulae of f1 and the characteristics as long as the total content of the above-described elements is 0.2 mass % or less.

As an index that indicates an alloy having a high degree of balance among strength, elongation and electric conduction, it is possible to evaluate how high the product of the above-described elements is. When the electric conductivity is represented by C (% IACS), the tensile strength is represented by Pw ($N/mm^2$), and the elongation is represented by L (%) with an assumption that the electric conductivity is in a range of 29% IACS to 44% IACS that is the forcibly-expressed upper limit, the product of Pw, (100+L)/100 and $C^{1/2}$ of a material after the recrystallization thermal treatment is in a range of 2700 to 3500. The balance among the strength, elongation and electric conduction of a rolled material after the recrystallization thermal treatment and the like have a large influence on a rolled material after cold finish rolling, a rolled material after Sn plating and characteristics after the final recovery thermal treatment (after low-temperature annealing). That is, when the product of Pw, (100+L)/100 and $C^{1/2}$ is less than 2700, the final rolled material cannot be an alloy having a high degree of balance among a variety of characteristics. The product is preferably 2750 or more (balance index $f2=Pw\times\{(100+L)/100\}\times C^{1/2}$).

In addition, in a rolled material after cold finish rolling, a rolled material that has been subjected to a recovery thermal treatment after cold finish rolling, or a rolled material that has been subjected to reflow Sn plating or molten Sn plating, in a W bend test, cracking does not occur at R/t=0.5 (R represents the curvature radius at a bent portion, and t represents the thickness of the rolled material), and optimally, cracking does not occur at R/t=0, and, with an assumption that the tensile strength is 500 $N/mm^2$ or more and the electric conductivity is in a range of 29% IACS to 44% IACS, the balance index f2 is in a range of 3200 to 4100. In a rolled material after a recovery thermal treatment, in order to have superior balance, the balance index f2 is 3300 or more, and furthermore, desirably 3400 or more. Alternately, since there are many cases in which the proof stress is considered to be more important than the tensile strength for use, the proof stress Py is used instead of the tensile strength Pw, and the product of the proof stress Py and (100+L)/100, $C^{1/2}$ is preferably in a range of 3100 to 4000, more preferably in a range of 3200 to 4000, and optimally in a range of 3300 to 4000 (balance index $f21=Py\times\{(100+L)/100\}\times C^{1/2}$). Meanwhile, in the invention alloys, the proof stress is equivalent to 0.94 to 0.97 of the tensile strength.

Here, the criterion of the W bend test refers to the fact that, when the test is carried out using test specimens sampled in parallel and perpendicular to the rolling direction, cracking does not occur in both test specimens. In addition, for the tensile strength and the proof stress being used in both balance indexes f2 and f21, values of the test specimen sampled in parallel to the rolling direction were employed. This is because the tensile strength and proof stress of the test specimen sampled in parallel to the rolling direction are equal to or smaller than the tensile strength and proof stress of the perpendicularly-sampled test specimen. However, generally, the bending workability of the test specimen sampled in perpendicular to the rolling direction is poorer than the bending workability of the test specimen sampled in parallel.

Furthermore, in the case of the invention alloys, it is possible to increase the tensile strength and the proof stress through work hardening with no significant impairment of bending workability, that is, no occurrence of cracking at R/t of 0.5 or less at W bending by adding a percentage of working in a range of 20% to 65% and preferably in a range of 30% to 55% in the cold finish rolling step. Generally, when the metallic structure of a cold-finish-rolled material is observed, a shape in which crystal grains are elongated in the rolling direction and are compressed in the thickness direction is exhibited, and differences in tensile strength, proof stress and bending workability are caused in the test specimen sampled in the rolling direction and the test specimen sampled in the vertical direction. Regarding the specific metallic structure, crystal grains are elongated crystal grains in a cross-section in parallel to a rolled surface, and are compressed crystal grains in the thickness direction in a horizontal cross-section, and a rolled material sampled perpendicular to the rolling direction has higher tensile strength and higher proof stress than a rolled material sampled in the parallel direction, and the ratio exceeds 1.05, and, sometimes, reaches 1.1. As the ratio becomes higher than 1, the bending workability of the test specimen sampled perpendicular to the rolling direction deteriorates. There are also rare cases in which the proof stress, conversely, reaches less than 0.95. A variety of members such as terminals and connectors that are the subjects of the application are frequently used in the rolling direction and the vertical direction, that is, in both directions in parallel and perpendicular to the rolling direction in actual use, that is, when a rolled material is worked into a product, and it is desirable that there is no differences in characteristics such as tensile strength, proof stress and bending workability in the rolling direction and in the vertical direction on an actually-used surface and a product-worked surface. In the present invention product, the interaction among Zn, Sn, P, Ni and Co, that is, a relational formula $11\leq f1\leq 19$ is satisfied, the average crystal grain diameter is set in a range of 2.0 μm to 8.0 μm, the sizes of the precipitates formed of P, Ni and furthermore Co or Fe and the proportions among the elements are controlled to predetermined values, and the differences in the tensile strength and proof stress of the rolled material sampled in a direction forming 0 degrees with respect to the rolling direction and the rolled material sampled in a direction forming 90 degrees with respect to the rolling direction is removed by producing a rolled material using a manufacturing step described below. Meanwhile, crystal grains are preferably fine from the viewpoint of strength, the roughness of a bending-worked surface and the generation of wrinkles; however, when crystal grains are too fine, the proportion of crystal grain boundaries in the metallic structure increases, and conversely, the bending workability deteriorates. Therefore, the average crystal grain diameter is preferably 7.5 μm or less, preferably 6.0 μm or less in a case in which strength is considered to be important, and optimally 5.0 μm or less. The lower limit is preferably 2.5 μm or more, preferably 3.0 μm or more in a case in which the stress relaxation characteristics is considered to be important, and more preferably 3.5 μm or more. When the proportion of the tensile strength or proof stress in a direction forming 0 degrees with respect to the rolling direction to the tensile strength or proof stress in a direction forming 90 degrees is in a range of 0.95 to 1.05, and furthermore, when a relational formula of $11\leq f1\leq 19$ is satisfied, and the average crystal grain diameter is set in a more preferred state, the value in a range of 0.98 to 1.03, at which the tensile strength and the proof stress are less anisotropic, is achieved. As can be determined from the metallic structure, when a test specimen is sampled in a direction forming 90 degrees with respect to the rolling direction and subjected to a bend test, the bending workability also becomes poorer than that of a test specimen sampled in a direction forming 0 degrees; however, in the invention alloys, the tensile strength and the proof stress are isotropic, and almost the same excellent bending workability is obtained in a direction forming 90 degrees and in the direction forming 0 degrees.

However, when the content of Zn is 8.5 mass %, and furthermore, exceeds 9 mass %, and $17\leq f1\leq 19$ is satisfied, the tensile strength and the proof stress are anisotropic both in a direction forming 0 degrees and in a direction forming 90 degrees, and the bending workability becomes poor in a direction forming 90 degrees. Particularly, this tendency becomes significant when the final percentage of cold rolling is increased. The balance characteristics f2 and f21 are improved by providing a composition in which the content of Ni is set in a range of 0.4 mass % to 0.85 mass %, preferably in a range of 0.45 mass % to 0.85 mass %, and more preferably in a range of 0.5 mass % to 0.85 mass %, [Ni]/[P] is set in a range of 7 to 40, and [Ni]/[Sn] is set in a range of 0.55 to 1.9.

The initial temperature of hot rolling is set to 800° C. or higher, and preferably set to 840° C. or higher in order to form the solid solutions of the respective elements. The initial temperature is set to 940° C. or lower, and preferably set to 920° C. or lower from the viewpoint of energy cost and hot ductility. In addition, in order to form more solid solutions of P, Ni, Co and, furthermore, Fe, a rolled material is preferably cooled at a cooling rate of 1° C./second or more in a temperature range of the temperature of the rolled material when final rolling ends to 350° C. or in a temperature range of 650° C. to 350° C. so as to at least prevent the precipitates from becoming coarse precipitates that impair elongation. When a rolled material is cooled at a cooling rate of 1° C./second or less, the precipitates of P, Ni, Co and, furthermore, Fe which are in a solid solution form begin to precipitate, and the precipitates become coarsened during the cooling step. When the precipitates become coarsened in a hot rolling stage, it is difficult to remove the precipitates in the subsequent thermal treatments such as the annealing step, and the elongation of the final rolled product is impaired.

In addition, a recrystallization thermal treatment step in which the percentage of cold working before the recrystallization thermal treatment step is 55% or more, the peak temperature is in a range of 550° C. to 790° C., the holding time in a range of "the peak temperature—50° C." to the peak temperature is in a range of 0.04 minutes to 2 minutes, and the thermal treatment index It satisfies 460≤It≤580 is carried out.

In order to obtain target recrystallized grains which do not include mixed grains and are uniform and fine in the recrystallization thermal treatment step, since decreasing the stacking-fault energy is not sufficient, it is necessary to accumulate strain by cold rolling, specifically, strain in crystal grain boundaries in order to increase the number of generation sites of recrystallization nuclei. In order to accumulate strain, the percentage of cold working in cold rolling before the recrystallization thermal treatment step needs to be 55% or more, is preferably 60% or more, and optimally 65% or more. On the other hand, when the percentage of cold working in cold rolling before the recrystallization thermal treatment step is excessively increased, since problems of strain and the like occur, the percentage of cold working is desirably 97% or less, and optimally 93% or less. That is, in order to increase the number of generation sites of recrystallization nuclei by physical actions, it is effective to increase the percentage of cold working, and finer recrystallized grains can be obtained by adding a high percentage of working within a range in which strain of a product is acceptable.

In addition, in order to obtain fine and uniform crystal grains that are the final target, it is necessary to specify a relationship between the crystal grain diameter after the annealing step that is a thermal treatment one step before the recrystallization thermal treatment step and the percentage of working of the second cold rolling before the recrystallization thermal treatment step. That is, when the crystal grain diameter after the recrystallization thermal treatment step is represented by D1, the crystal grain diameter before the recrystallization thermal treatment step and after the annealing step is represented by D0, and the percentage of cold working of cold rolling between the annealing step and the recrystallization thermal treatment step is represented by RE (%), D0≤D1×4×(RE/100) is satisfied at RE in a range of 55 to 97. Meanwhile, the numeric formula can be applied with RE in a range of 40 to 97. In order to realize the miniaturization of crystal grains and to make recrystallized grains after the recrystallization thermal treatment step fine and more uniform, the crystal grain diameter after the annealing step is preferably within the product of four times the crystal grain diameter after the recrystallization thermal treatment step and RE/100. Since the number of nucleation sites of recrystallized nuclei increases as the percentage of cold working increases, fine and more uniform recrystallized grains can be obtained even when the crystal grain diameter after the annealing step has a size three times or more the crystal grain diameter after the recrystallization thermal treatment step.

When the crystal grain diameter after the annealing step is large, mixed grains are formed after the recrystallization thermal treatment step, and the characteristics after the cold finish rolling step deteriorate; however, when the percentage of cold working of cold rolling between the annealing step and the recrystallization thermal treatment step is increased, the characteristics after the cold finish rolling step do not deteriorate even when the crystal grain diameter after the annealing step is somewhat large.

In addition, the recrystallization thermal treatment step is preferably a short-time thermal treatment in which the peak temperature is in a range of 550° C. to 790° C., the holding time in a range of "the peak temperature-50° C." to the peak temperature is in a range of 0.04 minutes to 2 minutes, more preferably, the peak temperature is in a range of 580° C. to 780° C., the holding time in a range of "the peak temperature-50° C." to the peak temperature is in a range of 0.05 minutes to 1.5 minutes, and the thermal treatment index It needs to satisfy a relationship of 460≤It≤580. In the relational formula of 460≤It≤580, the lower limit side is preferably 470 or more, and more preferably 480 or more, and the upper limit side is preferably 570 or less, and more preferably 560 or less.

Meanwhile, the recrystallization thermal treatment step can also be carried out in a batch-type annealing format under the above-described thermal treatment conditions as long as the average crystal grain diameter and the grain diameter of the precipitates are within the predetermined size ranges, and the recrystallization thermal treatment step can be carried out at a temperature in a range of 410° C. to 580° C. by holding the material for one hour to 24 hours.

Regarding the precipitates of P and Ni that suppress the growth of recrystallized grains, or Co and Fe, depending on cases, it is necessary that, in the stage of the recrystallization thermal treatment step, circular or elliptical precipitates are present, the average particle diameter of the precipitates is in a range of 4.0 nm to 25.0 nm or the proportion of the number of precipitates having a particle diameter in a range of 4.0 nm to 25.0 nm in the precipitated particles is 70% or more. The average particle diameter is preferably in a range of 5.0 nm to 20.0 nm or the proportion of precipitates having a particle diameter in a range of 4.0 nm to 25.0 nm in the precipitated particles is preferably 80% or more. When the average grain diameter of the precipitates decreases, the recrystallized grains become small due to the precipitate strengthening of the precipitates and the excessive effect that suppresses the growth of crystal grains so that the strength of the rolled material increases, but the bending workability deteriorates. In addition, when the size of the precipitates exceeds 50 nm, and, for example, reaches 100 nm, the effect that suppresses the growth of crystal grains also almost disappears, and the bending workability deteriorates. Further, the circular or elliptical precipitates include not only true circular or elliptical precipitates but also approximately circular or elliptical precipitates.

When the peak temperature, the holding time or the thermal treatment index It remains below the lower limits of the ranges in terms of the conditions of the recrystallization thermal treatment step, non-recrystallized portions remain, or ultrafine crystal grains having an average crystal grain diameter of less than 2.0 μm are formed. In addition, when annealing is carried out with the peak temperature, the holding time or the thermal treatment index It above the upper limits of the ranges that are the conditions of the recrystallization thermal treatment step, the excessive precipitates form solid solutions again, the predetermined effect that suppresses the growth of crystal grains does not work, and a fine metallic structure having an average crystal grain diameter of 8 μm or less cannot be obtained. In addition, the electric conduction deteriorates due to the excessive formation of the solid solutions of the precipitates.

The conditions of the recrystallization thermal treatment step are conditions to obtain the target recrystallized grain diameter and to prevent the excessive re-formation of solid solutions or the coarsening of the precipitates, and, when an appropriate thermal treatment within the numeric formulae is carried out, the effect that suppresses the growth of recrystallized grains is obtained, and the solid solutions of an appropriate amount of P and Ni or Co or Fe are formed again, thereby, conversely, improving the elongation of the rolled material. That is, when the temperature of the rolled material begins to exceed 500° C., the precipitates of P and Ni or Co or Fe begin to form solid solutions of the precipitates again, and, mainly, small precipitates having a grain diameter of 4 nm or less which have an adverse influence on bending workability disappear. As the temperature and time of the thermal treatment increase, the proportion of precipitates that form solid solutions increases. Since the precipitates are mainly used for the effect that suppresses recrystallized grains, when a lot of fine precipitates with a grain diameter of 4 nm or less or a lot of coarse precipitates having a grain diameter of 25 nm or more remain as the precipitates, the bending workability or elongation of the rolled material is impaired. Meanwhile, when cooling the rolled material in the recrystallization thermal treatment step, the rolled material is preferably cooled under a condition of 1° C./second or more in a temperature range of "the peak temperature—50° C." to 350° C. When the cooling rate is slow, coarse precipitates appear, and the elongation of the rolled material is impaired.

Furthermore, a recovery thermal treatment step in which the peak temperature is in a range of 160° C. to 650° C., the holding time in a range of "the peak temperature—50° C." to the peak temperature is in a range of 0.02 minutes to 200 minutes, and the thermal treatment index It satisfies a relationship of $60 \leq It \leq 360$ may be carried out after cold finish rolling.

The recovery thermal treatment step is a thermal treatment for improving the percentage of stress relaxation, spring bending elastic limit, bending workability and elongation of the rolled material or recovering the electric conductivity decreased by cold rolling through a short-time recovery thermal treatment at a low temperature without causing recrystallization. Meanwhile, regarding the thermal treatment index It, the lower limit side is preferably 100 or more, and more preferably 130 or more, and the upper limit side is preferably 345 or less, and more preferably 330 or less. When the recovery thermal treatment step is carried out, the percentage of stress relaxation becomes approximately ½, the stress relaxation characteristics improve, the spring bending elastic limit improves by 1.5 times to 2 times, and the electric conductivity improves by 0.5% IACS to 1% IACS compared with before the thermal treatment.

Meanwhile, in the Sn plating step such as molten Sn plating or reflow Sn plating, the invention alloy is molded into a rolled material, or a terminal or a connector, depending on cases, at a temperature in a range of approximately 200° C. to 300° C. for a short period of time, and then heated. Even when the Sn plating step is carried out after the recovery thermal treatment, there is little influence on the characteristics after the recovery thermal treatment. On the other hand, a heating step during the Sn plating step can replace the recovery thermal treatment step, and improves the stress relaxation characteristics, spring strength and bending workability of the rolled material.

As an embodiment of the invention, the manufacturing step sequentially including the hot rolling step, the first cold rolling step, the annealing step, the second cold rolling step, the recrystallization thermal treatment step and the cold finish rolling step has been exemplified, but the steps up to the recrystallization thermal treatment step may not be carried out. In the metallic structure of the copper alloy material before the cold finish rolling step, the average crystal grain diameter may be in a range of 2.0 μm to 8.0 μm, circular or elliptical precipitates may be present, the average particle diameter of the precipitates may be in a range of 4.0 nm to 25.0 nm, or the proportion of the number of precipitates having a particle diameter in a range of 4.0 nm to 25.0 nm in the precipitates may be 70% or more, and, for example, a copper alloy material having the above-described metallic structure may be obtained through steps such as hot extrusion, forging or a thermal treatment.

Examples

Specimens were produced using the first invention alloy, the second invention alloy, the third invention alloy, the fourth invention alloy and a copper alloy having a composition for comparison, and various manufacturing steps. Meanwhile, the third invention alloy is included in the first invention alloy, and the fourth invention alloy is included in the second invention alloy.

Tables 1 and 2 describe the compositions of the first invention alloy, the second invention alloy, the third invention alloy, the fourth invention alloy and the copper alloy for comparison which were produced as the specimens. Here, in a case in which the content of Co is 0.001 mass % or less, a case in which the content of Ni is 0.01 mass % or less, and a case in which the content of Fe is 0.003 mass % or less, the cells are left blank.

TABLE 1

| | Alloy | Alloy composition (mass %) | | | | | | | | | | |
|---|---|---|---|---|---|---|---|---|---|---|---|---|
| | No. | Cu | Zn | Sn | P | Co | Ni | Fe | Others | f1 | Ni/P | Ni/Sn |
| First invention alloy | 1 | Rem. | 6.3 | 0.58 | 0.04 | | 0.58 | | | 13.32 | 14.5 | 1.00 |
| Second invention alloy | 2 | Rem. | 6.7 | 0.60 | 0.04 | 0.03 | 0.39 | | | 13.51 | 9.75 | 0.65 |
| | 3 | Rem. | 7.8 | 0.62 | 0.05 | | 0.64 | 0.020 | | 15.49 | 12.8 | 1.03 |
| | 5 | Rem. | 6.5 | 0.54 | 0.05 | 0.02 | 0.80 | 0.008 | | 14.35 | 16.0 | 1.48 |
| First invention alloy | 6 | Rem. | 5.4 | 0.80 | 0.06 | | 0.62 | | | 14.53 | 10.3 | 0.78 |
| Fourth invention alloy | 7 | Rem. | 10.1 | 0.47 | 0.05 | 0.010 | 0.71 | | | 17.01 | 14.2 | 1.51 |
| | 8 | Rem. | 10.5 | 0.53 | 0.05 | 0.010 | 0.59 | 0.006 | | 17.44 | 11.8 | 1.11 |
| Third invention alloy | 9 | Rem. | 9.7 | 0.69 | 0.04 | | 0.57 | | | 17.51 | 14.3 | 0.83 |
| First invention alloy | 12 | Rem. | 7.6 | 0.62 | 0.03 | | 0.24 | | | 13.57 | 8.00 | 0.39 |
| Second invention alloy | 14 | Rem. | 6.1 | 0.77 | 0.04 | | 0.25 | 0.008 | | 13.39 | 6.25 | 0.33 |
| First invention alloy | 15 | Rem. | 7.6 | 0.51 | 0.05 | | 0.65 | | | 14.50 | 13.0 | 1.28 |
| | 16 | Rem. | 5.5 | 0.62 | 0.05 | | 0.71 | | | 13.44 | 14.2 | 1.15 |
| Second invention alloy | 161 | Rem. | 5.6 | 0.59 | 0.04 | 0.01 | 0.69 | 0.006 | | 13.18 | 17.3 | 1.17 |
| | 162 | Rem. | 5.6 | 0.56 | 0.04 | 0.01 | 0.52 | | | 12.36 | 13.0 | 0.93 |
| | 163 | Rem. | 5.3 | 0.57 | 0.03 | 0.01 | 0.39 | | | 11.52 | 13.0 | 0.68 |
| | 166 | Rem. | 9.2 | 0.53 | 0.04 | 0.02 | 0.54 | | | 15.91 | 13.5 | 1.02 |
| | 167 | Rem. | 6.4 | 0.80 | 0.04 | 0.01 | 0.45 | | | 14.72 | 11.3 | 0.56 |
| | 168 | Rem. | 7.0 | 0.42 | 0.04 | 0.01 | 0.77 | | | 13.59 | 19.3 | 1.83 |
| | 169 | Rem. | 6.6 | 0.62 | 0.04 | 0.01 | 0.54 | | | 13.88 | 13.5 | 0.87 |
| | 17 | Rem. | 7.5 | 0.63 | 0.03 | | 0.28 | 0.030 | | 13.69 | 9.33 | 0.44 |
| | 172 | Rem. | 6.4 | 0.51 | 0.05 | 0.02 | 0.53 | 0.008 | | 13.08 | 10.6 | 1.04 |
| Fourth invention alloy | 180 | Rem. | 11.1 | 0.52 | 0.04 | 0.01 | 0.77 | 0.007 | | 18.44 | 19.3 | 1.48 |
| | 181 | Rem. | 10.5 | 0.58 | 0.06 | 0.01 | 0.47 | | | 17.56 | 7.8 | 0.81 |
| | 182 | Rem. | 10.0 | 0.73 | 0.04 | | 0.43 | 0.008 | | 17.62 | 10.8 | 0.59 |
| | 183 | Rem. | 11.3 | 0.60 | 0.04 | 0.01 | 0.56 | | | 18.50 | 14.0 | 0.93 |
| Third invention alloy | 184 | Rem. | 11.1 | 0.41 | 0.04 | | 0.76 | | | 17.48 | 19.0 | 1.85 |
| Fourth invention alloy | 185 | Rem. | 9. 8 | 0.58 | 0.02 | 0.03 | 0.71 | | | 17.26 | 35.5 | 1.22 |

TABLE 2

| | Alloy | Alloy composition (mass %) | | | | | | | | | | |
|---|---|---|---|---|---|---|---|---|---|---|---|---|
| | No. | Cu | Zn | Sn | P | Co | Ni | Fe | Others | f1 | Ni/P | Ni/Sn |
| Comparative example | 21 | Rem. | 8.2 | 0.60 | 0.03 | 0.02 | 0.13 | | | 13.84 | 4.33 | 0.22 |
| | 22 | Rem. | 6.8 | 0.61 | 0.007 | 0.04 | 0.36 | | | 13.15 | 51.4 | 0.59 |
| | 23 | Rem. | 7.8 | 0.63 | 0.04 | 0.11 | 0.25 | | | 15.14 | 6.25 | 0.40 |
| | 24 | Rem. | 6.9 | 0.66 | 0.11 | 0.07 | 0.55 | | | 16.24 | 5.00 | 0.83 |
| | 25 | Rem. | 7.2 | 0.63 | 0.04 | | 0.14 | | | 13.06 | 3.50 | 0.22 |
| | 26 | Rem. | 3.9 | 0.60 | 0.04 | 0.03 | 0.53 | | | 11.20 | 13.3 | 0.88 |
| | 34 | Rem. | 5.0 | 0.41 | 0.02 | | 0.90 | | | 11.55 | 45.0 | 2.20 |
| | 28 | Rem. | 6.9 | 0.33 | 0.03 | | 0.44 | | | 11.40 | 14.7 | 1.33 |
| | 29 | Rem. | 7.0 | 0.51 | 0.07 | | 0.38 | | | 13.28 | 5.43 | 0.75 |
| | 30 | Rem. | 8.5 | 0.96 | 0.03 | | 0.23 | | | 16.99 | 7.67 | 0.24 |
| | 31 | Rem. | 5.8 | 0.41 | 0.03 | | 0.30 | | | 10.41 | 10.0 | 0.73 |
| | 35 | Rem. | 5.1 | 0.44 | 0.03 | | 0.44 | | | 10.42 | 14.7 | 1.00 |
| | 36 | Rem. | 5.5 | 0.41 | 0.03 | 0.02 | 0.35 | | | 10.48 | 11.7 | 0.85 |
| | 38 | Rem. | 7.6 | 0.78 | 0.04 | | 0.35 | | Cr: 0.05 | 15.32 | 8.75 | 0.45 |
| | 39 | Rem. | 30.2 | | | | | | | | | |
| | 40 | Rem. | 12.8 | 0.47 | 0.03 | | 0.45 | | | 18.38 | 15.0 | 0.96 |
| | 41 | Rem. | 11.4 | 0.79 | 0.03 | | 0.52 | | | 19.63 | 17.3 | 0.66 |
| | 42 | Rem. | 10.9 | 0.78 | 0.05 | 0.02 | 0.55 | | | 19.68 | 11.0 | 0.71 |
| | 43 | Rem. | 11.2 | 0.72 | 0.03 | 0.01 | 0.14 | | | 17.67 | 4.7 | 0.19 |
| | 44 | Rem. | 10.4 | 0.61 | 0.07 | 0.01 | 0.42 | | | 17.67 | 6.0 | 0.69 |
| | 45 | Rem. | 10.2 | 0.45 | 0.015 | 0.01 | 0.66 | | | 16.23 | 44.0 | 1.47 |
| | 46 | Rem. | 11.5 | 0.30 | 0.04 | 0.02 | 0.52 | | | 16.41 | 13.0 | 1.73 |

Alloy Nos. 21, 25 and 43 have a smaller content of Ni than the composition range of the invention alloys.

Alloy No. 22 has a smaller content of P than the composition range of the invention alloys.

Alloy No. 23 has a larger content of Co than the composition range of the invention alloys.

Alloy No. 24 has a larger content of P than the composition range of the invention alloys.

Alloy No. 26 has a smaller content of Zn than the composition range of the invention alloys.

Alloy Nos. 28 and 46 have a smaller content of Sn than the composition range of the invention alloys.

Alloy No. 29 has a content of Ni of 0.38 mass % and a smaller [Ni]/[P] than the range of the invention alloys.

Alloy No. 30 has a larger content of Sn than the composition range of the invention alloys.

Alloy Nos. 31, 35 and 36 have a smaller composition index f1 than the composition range of the invention alloys.

Alloy No. 34 has a larger content of Ni than the composition range of the invention alloys.

Alloy No. 38 contains Cr.

Alloy No. 39 is ordinary brass, and has not been subjected to a recovery thermal treatment.

Alloy No. 40 has a larger content of Zn than the composition range of the invention alloys.

Alloy Nos. 41 and 42 have a larger composition index f1 than the composition range of the invention alloys.

Alloy No. 44 has a content of Ni of 0.42 mass %, a content of P of 0.07 mass %, and a smaller [Ni]/[P] than the range of the invention alloys.

Alloy No. 45 has a content of Ni of 0.66 mass %, a content of P of 0.015 mass %, and a larger [Ni]/[P] than the range of the invention alloys.

Three types (A, B and C) of manufacturing steps of specimens were carried out, and manufacturing conditions were further changed in the respective manufacturing steps. The manufacturing step A was carried out in an actual mass production facility, and the manufacturing steps B and C were carried out in an experiment facility. Table 3 describes the manufacturing conditions of the respective manufacturing steps.

TABLE 3

| | | Hot rolling step Initial tempera- | Cooling | Milling step | First cold rolling step | Annealing step | Second cold rolling step | | Recrystallization thermal treatment step | | Cold finish rolling step | | Recovery thermal treatment step | |
|---|---|---|---|---|---|---|---|---|---|---|---|---|---|---|
| Step No. | | ture, sheet thickness | step Cooling rate | Sheet thick-ness | Sheet thick-ness | Thermal treatment condition | Sheet thick-ness | Red | Thermal treatment condition | It | Sheet thick-ness | Red | Thermal treatment condition | It |
| A1 | Example | 860° C., 13 mm | 3° C./ second | 12 mm | 1.6 mm | 470° C. × 4 Hr | 0.48 mm | 70% | 690° C. × 0.09 min | 529 | 0.3 mm | 37.5% | 420° C. × 0.05 min | 202 |
| A11 | Example | 860° C., 13 mm | 3° C./ second | 12 mm | 1.6 mm | 470° C. × 4 Hr | 0.56 mm | 65% | 690° C. × 0.09 min | 527 | 0.3 mm | 46.4% | 420° C. × 0.05 min | 204 |
| A2 | Example | 860° C., 13 mm | 3° C./ second | 12 mm | 1.6 mm | 470° C. × 4 Hr | 0.48 mm | 70% | 660° C. × 0.08 min | 491 | 0.3 mm | 37.5% | 420° C. × 0.05 min | 202 |
| A3 | Example | 860° C., 13 mm | 3° C./ second | 12 mm | 1.6 mm | 470° C. × 4 Hr | 0.48 mm | 70% | 720° C. × 0.1 min | 566 | 0.3 mm | 37.5% | 420° C. × 0.05 min | 202 |
| A31 | Example | 860° C., 13 mm | 3° C./ second | 12 mm | 1.6 mm | 470° C. × 4 Hr | 0.56 mm | 65% | 690° C. × 0.09 min | 527 | 0.3 mm | 46.4% | 420° C. × 0.05 min | 204 |
| A4 | Comparative example | 860° C., 13 mm | 3° C./ second | 12 mm | 1.6 mm | 470° C. × 4 Hr | 0.48 mm | 70% | 630° C. × 0.07 min | 451 | 0.3 mm | 37.5% | 420° C. × 0.05 min | 202 |
| A41 | Comparative example | 860° C., 13 mm | 3° C./ second | 12 mm | 1.6 mm | 470° C. × 4 Hr | 0.46 mm | 71% | 630° C. × 0.07 min | 452 | 0.3 mm | 34.8% | 420° C. × 0.05 min | 201 |
| A5 | Comparative example | 860° C., 13 mm | 3° C./ second | 12 mm | 1.6 mm | 470° C. × 4 Hr | 0.48 mm | 70% | 780° C. × 0.07 min | 601 | 0.3 mm | 37.5% | 420° C. × 0.05 min | 202 |
| A6 | Example | 860° C., 13 mm | 3° C./ second | 12 mm | 1.6 mm | 470° C. × 4 Hr | 0.48 mm | 70% | 690° C. × 0.09 min | 529 | 0.3 mm | 37.5% | N/A | |
| A7 | Example | 860° C., 13 mm | 3° C./ second | 12 mm | 1.6 mm | 470° C. × 4 Hr | 0.48 mm | 70% | 690° C. × 0.09 min | 529 | 0.3 mm | 37.5% | Condi-tion 1 | |
| A8 | Example | 860° C., 13 mm | 3° C./ second | 12 mm | 1.6 mm | 470° C. × 4 Hr | 0.48 mm | 70% | 690° C. × 0.09 min | 529 | 0.3 mm | 37.5% | Condi-tion 2 | |
| A9 | Example | 860° C., 13 mm | 3° C./ second | 12 mm | 1.6 mm | 470° C. × 4 Hr | 0.48 mm | 70% | 450° C. × 4 Hr | 529 | 0.3 mm | 37.5% | 420° C. × 0.05 min | 202 |
| B1 | Example | 860° C., 8 mm | 3° C./ second | Pickling | 1.6 mm | 610° C. × 0.23 min | 0.48 mm | 70% | 690° C. × 0.09 min | 529 | 0.3 mm | 37.5% | 420° C. × 0.05 min | 202 |
| B21 | Comparative example | 860° C., 8 mm | 0.3° C./ second | Pickling | 1.6 mm | 610° C. × 0.23 min | 0.48 mm | 70% | 690° C. × 0.09 min | 529 | 0.3 mm | 37.5% | 420° C. × 0.05 min | 202 |
| B31 | Example | 860° C., 8 mm | 3° C./ second | Pickling | 1.2 mm | 470° C. × 4 Hr | 0.48 mm | 60% | 690° C. × 0.09 min | 525 | 0.3 mm | 37.5% | 420° C. × 0.05 min | 202 |
| B32 | Comparative example | 860° C., 8 mm | 3° C./ second | Pickling | 0.8 mm | 470° C. × 4 Hr | 0.48 mm | 40% | 690° C. × 0.09 min | 518 | 0.3 mm | 37.5% | 420° C. × 0.05 min | 202 |
| B41 | Example | 860° C., 8 mm | 3° C./ second | Pickling | 1.6 mm | 510° C. × 4 Hr | 0.48 mm | 70% | 690° C. × 0.09 min | 529 | 0.3 mm | 37.5% | 420° C. × 0.05 min | 202 |
| B42 | Comparative example | 860° C., 8 mm | 3° C./ second | Pickling | 1.6 mm | 580° C. × 4 Hr | 0.48 mm | 70% | 690° C. × 0.09 min | 529 | 0.3 mm | 37.5% | 420° C. × 0.05 min | 202 |

TABLE 3-continued

| Step No. | | Hot rolling step Initial temperature, sheet thickness | Cooling step Cooling rate | Milling step Sheet thickness | First cold rolling step Sheet thickness | Annealing step Thermal treatment condition | Second cold rolling step Sheet thickness | Red | Recrystallization thermal treatment step Thermal treatment condition | It | Cold finish rolling step Sheet thickness | Red | Recovery thermal treatment step Thermal treatment condition | It |
|---|---|---|---|---|---|---|---|---|---|---|---|---|---|---|
| B43 | Example | 860° C., 8 mm | 3° C./second | Pickling | N/A | N/A | 0.48 mm | 94% | 690° C. × 0.09 min | 544 | 0.3 mm | 37.5% | 420° C. × 0.05 min | 202 |
| C1 | Example | 860° C., 8 mm | 3° C./second | Pickling | 1.6 mm | 610° C. × 0.23 min | 0.48 mm | 70% | 690° C. × 0.09 min | 529 | 0.3 mm | 37.5% | 540° C. × 0.04 min | 301 |
| C3 | Example | 860° C., 8 mm | 3° C./second | Pickling | 1.6 mm | 610° C. × 0.23 min | 0.56 mm | 65% | 690° C. × 0.09 min | 527 | 0.3 mm | 46.4% | 540° C. × 0.04 min | 303 |

In Steps A4, A41 and A5, the thermal treatment index It is outside the set condition range of the invention.

In Step B21, the cooling rate after hot rolling is outside the preferred set condition range of the invention.

In Step B32, the Red. of the second cold rolling step is outside the preferred set condition range of the invention.

Step B42 is outside the preferred set condition of the invention: $D0 \leq D1 \times 4 \times (RE/100)$.

In Manufacturing Step A (A1, A11, A2, A3, A31, A4, A41, A5, A6, A7, A8 and A9), raw materials were melted in a mid-frequency melting furnace with an inside volume of 10 tons, and ingots having a cross-section with a thickness of 190 mm and a width of 630 mm were manufactured through semi-continuous casting. The ingots were respectively cut into a length of 1.5 m, and then a hot rolling step (sheet thickness 13 mm)—a cooling step—a milling step (sheet thickness 12 mm)—a first cold rolling step (sheet thickness 1.6 mm)—an annealing step (held at 470° C. for four hours)—a second cold rolling step (a sheet thickness of 0.48 mm and a percentage of cold working of 70%; however, a sheet thickness of 0.46 mm and a percentage of cold working of 71% for A41, and sheet thicknesses of 0.56 mm and percentages of cold working of 65% for A11 and A31)—a recrystallization thermal treatment step—a cold finish rolling step (a sheet thickness of 0.3 mm and a percentage of cold working of 37.5%; however, a percentage of cold working of 34.8% for A41, and percentages of cold working of 46.4% for A11 and A31)—a recovery thermal treatment step were carried out.

The hot rolling initial temperature in the hot rolling step was set to 860° C., the ingots were hot-rolled to a sheet thickness of 13 mm, and then showered using water for cooling in the cooling step. In the specification, the hot rolling initial temperature and the ingot heating temperature have the same meaning. The average cooling rate in the cooling step refers to an average cooling rate in a temperature range of the temperature of the rolled material after final hot rolling to 350° C. or in a temperature range of the temperature of the rolled material of 650° C. to 350° C., and the average cooling rate was measured at the rear end of a rolled sheet. The measured average cooling rate was 3° C./second.

The showering using water for cooling in the cooling step was carried out in the following manner. A shower facility is provided at a place that is above a transporting roller that transports the rolled material during hot rolling and is away from a hot rolling roller. When the final path of hot rolling ends, the rolled material is transported to the shower facility using the transportation roller, and sequentially cooled from the front end to the rear end while being made to pass a place in which showering is carried out. In addition, the cooling rate was measured in the following manner. The temperature of the rolled material was measured at the rear end portion (accurately, a location that is 90% of the length of the rolled material from the rolling front end in the longitudinal direction of the rolled material) of the rolled material in the final pass of hot rolling, the temperature was measured immediately before sending the rolled material to the shower facility after the end of the final pass, and at a point in time when the showering ended, and the cooling rate was computed based on the temperature measured at these times and time intervals at which the temperatures were measured. The temperature was measured using a radiation thermometer. As the radiation thermometer, an infrared thermometer Fluke-574 manufactured by Takachihoseiki Co., Ltd. was used. In order to measure the temperature, the rolled material is put into an air cooling state until the rear end of the rolled material reaches the shower facility and shower water is applied to the rolled material, and the cooling rate at this time becomes slow. In addition, as the final sheet thickness decreases, it takes a longer time for the rolled material to reach the shower facility, and therefore the cooling rate becomes slow.

The annealing step includes a heating step of heating the rolled material to a predetermined temperature, a holding step of holding the rolled material after the heating step at a predetermined temperature for a predetermined time, and a cooling step of cooling the rolled material after the holding step to a predetermined temperature. The peak temperature was set to 470° C., and the holding time was set to four hours.

In the recrystallization thermal treatment step, the peak temperature Tmax (° C.) of the rolled material and the holding time tm (min) in a temperature range of a temperature 50° C. lower than the peak temperature of the rolled material to the peak temperature were changed to (690° C.—0.09 min), (660° C.—0.08 min), (720° C.—0.1 min), (630° C.—0.07 min) and (780° C.—0.07 min). Meanwhile, the recrystallization thermal treatment in Step A9 was carried out in a batch annealing format under conditions of holding the rolled material at 450° C. for four hours.

In addition, the percentage of cold working in the cold finish rolling step was set to 37.5% (however, 34.8% for A41, and 46.4% for A11 and A31) as described above.

In the recovery thermal treatment step, the peak temperature Tmax (° C.) of the rolled material was set to 420 (° C.), and the holding time tm (min) in a temperature range of a temperature 50° C. lower than the peak temperature of the rolled material to the peak temperature was set to 0.05 minutes. However, in Manufacturing Step A6, the recovery thermal treatment step was not carried out. In addition, A7 and A8 are specimens obtained by immersing the specimens obtained in A6 and A1 in an oil bath at 350° C. for 3 seconds, and cooling the specimens in the air. The above-described thermal treatment is a thermal treatment condition corresponding to molten Sn plating treatment (Condition 1 in the recovery thermal treatment column in Table 3 is that the specimen obtained in Step A6 was immersed in an oil bath at 350° C. for 3 seconds, and cooling the specimens in the air, and Condition 2 is that the specimen obtained in Step A1 was immersed in an oil bath at 350° C. for 3 seconds, and cooling the specimens in the air).

In addition, Manufacturing Steps B (B1, B21, B31, B32, B41, B42 and B43) were carried out in the following manner.

An ingot for laboratory tests having a thickness of 40 mm, a width of 120 mm and a length of 190 mm was cut out from the ingot in Manufacturing Step A, and then a hot rolling step (sheet thickness 8 mm)—a cooling step (cooling through shower using water)—a pickling step—a first cold rolling step—an annealing step—a second cold rolling step (sheet thickness 0.48 mm)—a recrystallization thermal treatment step—a cold finish rolling step (sheet thickness 0.3 mm, percentage of working 37.5%)—a recovery thermal treatment step were carried out.

In the hot rolling step, the ingot was heated to 860° C., and hot-rolled to a thickness of 8 mm. The cooling rate (a cooling rate from the temperature of the rolled material after hot rolling to 350° C. or from a temperature of the rolled material of 650° C. to 350° C.) in the cooling step was mainly 3° C./second, and was 0.3° C./second for some parts.

After the cooling step, the surface was pickled, the ingot was cold-rolled to 1.6 mm, 1.2 mm or 0.8 mm in the first cold rolling step, and the conditions for the annealing step were changed to (held at 610° C. for 0.23 minutes) (held at 470° C. for four hours), (held at 510° C. for four hours), and (held at 580° C. for four hours). After that, the ingot was rolled to 0.48 mm in the second cold rolling step.

The recrystallization thermal treatment step was carried out under conditions of Tmax of 690° C. and a holding time tm of 0.09 minutes. In addition, the ingot was cold-rolled to 0.3 mm (percentage of cold working: 37.5%) in the cold finish rolling step, and the recovery thermal treatment step was carried out under conditions of Tmax of 420° C. and a holding time tm of 0.05 minutes.

Meanwhile, in B43 step, the first cold rolling step and the annealing step were not carried out, the ingot was rolled to a thickness of 0.48 mm in the second cold rolling step, and a recrystallization thermal treatment was carried out under conditions of Tmax of 690° C. and a holding time tm of 0.09 minutes. In addition, the ingot was cold-rolled to 0.3 mm in the cold finish rolling step, and a recovery thermal treatment step was carried out under conditions of Tmax of 420° C. and a holding time tm of 0.05 minutes.

In Manufacturing Step B and Manufacturing Step C described below, a step corresponding to the short-time thermal treatment carried out in a continuous annealing line or the like in Manufacturing Step A was replaced by the immersion of the rolled material in a salt bath, the peak temperature was set to the solution temperature in the salt bath, the immersion time was set to a holding time, and the ingot was cooled in the air after being immersed. Meanwhile, as the salt (solution), a mixture of BaCl, KCl and NaCl was used.

Furthermore, Manufacturing Step C (C1 and C3) was carried out in the following manner as a laboratory test. The ingot was melted and cast in an electric furnace in a laboratory so as to obtain predetermined components, thereby obtaining an ingot for laboratory test having a thickness of 40 mm, a width of 120 mm and a length of 190 mm. After that, test specimens were manufactured using the same steps as in Manufacturing Step B. That is, an ingot was heated to 860° C., hot-rolled to a thickness of 8 mm, and cooled at a cooling rate of 3° C./second in a temperature range of the temperature of the rolled material after hot rolling or a temperature of the rolled material of 650° C. to 350° C. after hot rolling. After cooling, the surface was pickled, and the ingot was cold-rolled to 1.6 mm in the first cold rolling step. After cold rolling, the annealing step was carried out under conditions of 610° C. and 0.23 minutes after cold rolling, and C1 was cold-rolled to 0.48 mm and C3 was cold-rolled to a sheet thickness of 0.56 mm in the second cold rolling step. The recrystallization thermal treatment step was carried out under conditions of Tmax of 690° C. and a holding time tm of 0.09 minutes. In addition, the ingot was cold-rolled to 0.3 mm (percentage of cold working of C1: 37.5%, percentage of cold working of C3: 46.4%) in the cold finish rolling step, and the recovery thermal treatment step was carried out under conditions of Tmax of 540° C. and a holding time tm of 0.04 minutes.

To evaluate the copper alloys produced using the above-described methods, tensile strength, proof stress, elongation, electric conductivity, bending workability, percentage of stress relaxation, stress corrosion crack resistance and the spring bending elastic limit were measured. In addition, the average crystal grain diameters were measured by observing the metallic structures. In addition, the average grain diameters of precipitates and the proportions of the number of precipitates having a grain diameter of a predetermined value or less in precipitates of all sizes were measured.

The results of the respective tests are described in Tables 4 to 18. Here, the test results of the respective test Nos. are described in three tables such as Tables 4, 5 and 6. Further, since the recovery thermal treatment step was not carried out in Manufacturing Step A6, data after the cold finish rolling step are described in the column for data after the recovery thermal treatment step.

In addition, FIG. 1 illustrates a transmission electron microscopic photograph of a copper alloy sheet for terminal and connector materials of Alloy No. 2 (Test No. T18). The average grain diameter of the precipitates is 7 nm, and the precipitates are uniformly distributed.

TABLE 4

| Test No | Alloy No. | Step No. | Average crystal grain diameter after annealing step DO (μm) | After recrystallization thermal treatment step: Average crystal grain diameter D1 (μm) | Precipitated particles: Average grain diameter (nm) | Precipitated particles: Proportion of particles in a range of 4 nm to 25 nm (%) | After recovery thermal treatment step: Characteristics of rolled material (0 degree direction): Tensile strength (N/mm$^2$) | Proof stress (N/mm$^2$) | Elongation (%) | Electric conductivity (% IACS) | Young's modulus (kN/mm$^2$) |
|---|---|---|---|---|---|---|---|---|---|---|---|
| T1 | 1 | A1 | 5 | 3.8 | 10.0 | 94 | 528 | 515 | 9 | 36.2 | 127 |
| T2 | | A11 | | 3.8 | 10.0 | 94 | 577 | 560 | 5 | 36.0 | 128 |
| T3 | | A2 | | 3.2 | 9.4 | 92 | 539 | 522 | 8 | 36.5 | 128 |
| T4 | | A4 | | 1.8 | 3.6 | 65 | 553 | 538 | 4 | 36.7 | 124 |
| T5 | | A3 | | 5.0 | 13.0 | 88 | 511 | 503 | 9 | 35.8 | 126 |
| T6 | | A31 | | 5.0 | 13.0 | 88 | 558 | 545 | 7 | 35.6 | 126 |
| T7 | | A5 | | 13.0 | 60.0 | 20 | 473 | 455 | 10 | 35.1 | 122 |
| T8 | | A6 | | 3.8 | 10.0 | 94 | 542 | 521 | 4 | 35.0 | 121 |
| T9 | | A7 | | 3.8 | 10.0 | 94 | 535 | 516 | 6 | 35.4 | 124 |
| T10 | | A8 | | 3.8 | 10.0 | 94 | 526 | 512 | 10 | 36.4 | 127 |
| T11 | | A9 | | 4.0 | 11.0 | 93 | 523 | 508 | 8 | 36.4 | 126 |
| T12 | | B1 | 5 | 3.9 | 11.0 | 94 | 526 | 515 | 8 | 36.1 | 127 |
| T13 | | B21 | | 8.5 | 27.0 | 65 | 490 | 473 | 7 | 36.0 | 124 |
| T14 | | B31 | 5 | 4.1 | 12.0 | 92 | 519 | 507 | 8 | 36.1 | 126 |
| T15 | | B32 | 5 | 4.5 | 26.0 | 68 | 511 | 496 | 6 | 36.2 | 122 |
| T16 | | B41 | 6 | 4.1 | 13.0 | 91 | 519 | 504 | 8 | 36.3 | 124 |
| T17 | | B42 | 19 | 4.7 | 27.0 | 69 | 511 | 492 | 6 | 36.4 | 122 |
| T171 | | B43 | | 3.5 | 9.5 | 92 | 533 | 519 | 8 | 36.0 | 125 |
| T18 | 2 | A1 | 4.5 | 3.4 | 7.0 | 91 | 537 | 526 | 9 | 36.9 | 125 |
| T19 | | A11 | | 3.4 | 7.0 | 91 | 588 | 568 | 5 | 36.6 | 125 |
| T20 | | A2 | | 2.7 | 6.3 | 87 | 550 | 538 | 8 | 37.4 | 126 |
| T21 | | A4 | | 1.8 | 3.5 | 40 | 575 | 553 | 6 | 38.0 | 123 |
| T22 | | A3 | | 4.4 | 11.0 | 92 | 522 | 507 | 10 | 36.4 | 124 |
| T23 | | A31 | | 4.4 | 11.0 | 92 | 566 | 547 | 6 | 36.2 | 123 |
| T24 | | A5 | | 10.5 | 45.0 | 25 | 471 | 456 | 11 | 35.6 | 121 |
| T25 | | A7 | | 3.4 | 7.0 | 91 | 543 | 530 | 6 | 36.2 | 122 |
| T26 | | A8 | | 3.4 | 7.0 | 91 | 535 | 527 | 9 | 36.9 | 125 |
| T27 | | A9 | | 3.6 | 7.0 | 90 | 532 | 522 | 8 | 37.0 | 124 |
| T28 | | A41 | | 1.8 | 3.5 | 45 | 557 | 536 | 7 | 38.0 | 123 |

TABLE 5

| Test No. | Alloy No. | Step No. | After recovery thermal treatment step: Balance index f2 | Balance index f21 | Characteristics of rolled material (90 degree direction): Tensile strength (N/mm$^2$) | Proof stress (N/mm$^2$) | 90 degree/0 degree tensile strength ratio | 90 degree/0 degree proof stress ratio | Bending workability: 90 degree direction Bad Way | 0 degree direction Good Way |
|---|---|---|---|---|---|---|---|---|---|---|
| T1 | 1 | A1 | 3463 | 3377 | 534 | 518 | 1.011 | 1.006 | S | S |
| T2 | | A11 | 3635 | 3528 | 595 | 577 | 1.031 | 1.030 | A | S |
| T3 | | A2 | 3517 | 3406 | 545 | 525 | 1.011 | 1.006 | S | S |
| T4 | | A4 | 3484 | 3390 | 583 | 567 | 1.054 | 1.054 | B | S |
| T5 | | A3 | 3333 | 3280 | 523 | 513 | 1.023 | 1.020 | S | S |
| T6 | | A31 | 3562 | 3479 | 572 | 560 | 1.025 | 1.028 | A | S |
| T7 | | A5 | 3083 | 2965 | 497 | 482 | 1.051 | 1.059 | A | S |
| T8 | | A6 | 3335 | 3206 | 555 | 528 | 1.024 | 1.013 | S | S |
| T9 | | A7 | 3374 | 3254 | 542 | 522 | 1.013 | 1.012 | S | S |
| T10 | | A8 | 3491 | 3398 | 531 | 516 | 1.010 | 1.008 | S | S |
| T11 | | A9 | 3408 | 3310 | 532 | 515 | 1.017 | 1.014 | S | S |
| T12 | | B1 | 3413 | 3342 | 532 | 516 | 1.011 | 1.002 | S | S |
| T13 | | B21 | 3146 | 3037 | 514 | 493 | 1.049 | 1.042 | A | S |
| T14 | | B31 | 3368 | 3290 | 529 | 516 | 1.019 | 1.018 | S | S |
| T15 | | B32 | 3259 | 3163 | 538 | 525 | 1.053 | 1.058 | B | S |
| T16 | | B41 | 3377 | 3279 | 526 | 515 | 1.013 | 1.022 | A | S |
| T17 | | B42 | 3268 | 3146 | 541 | 521 | 1.059 | 1.059 | B | S |
| T171 | | B43 | 3454 | 3363 | 545 | 527 | 1.023 | 1.015 | S | S |
| T18 | 2 | A1 | 3556 | 3483 | 544 | 528 | 1.013 | 1.004 | S | S |
| T19 | | A11 | 3735 | 3608 | 605 | 582 | 1.029 | 1.025 | A | S |
| T20 | | A2 | 3633 | 3553 | 565 | 546 | 1.027 | 1.015 | S | S |
| T21 | | A4 | 3757 | 3613 | 608 | 588 | 1.057 | 1.063 | C | B |
| T22 | | A3 | 3464 | 3365 | 538 | 522 | 1.031 | 1.030 | S | S |

TABLE 5-continued

| | | | After recovery thermal treatment step | | | | | | | |
|---|---|---|---|---|---|---|---|---|---|---|
| | | | | | Characteristics of rolled material (90 degree direction) | | 90 degree/0 degree | 90 degree/0 degree | Bending workability | |
| Test No. | Alloy No. | Step No. | Balance index f2 | Balance index f21 | Tensile strength ($N/mm^2$) | Proof stress ($N/mm^2$) | tensile strength ratio | proof stress ratio | 90 degree direction Bad Way | 0 degree direction Good Way |
| T23 | | A31 | 3610 | 3489 | 585 | 568 | 1.034 | 1.038 | A | S |
| T24 | | A5 | 3119 | 3020 | 500 | 482 | 1.062 | 1.057 | B | S |
| T25 | | A7 | 3463 | 3380 | 560 | 542 | 1.031 | 1.023 | S | S |
| T26 | | A8 | 3542 | 3489 | 541 | 525 | 1.011 | 0.996 | S | S |
| T27 | | A9 | 3495 | 3429 | 543 | 526 | 1.021 | 1.008 | S | S |
| T28 | | A41 | 3674 | 3535 | 588 | 565 | 1.056 | 1.054 | B | B |

TABLE 6

| | | | After recovery thermal treatment step | | | | | | | | |
|---|---|---|---|---|---|---|---|---|---|---|---|
| | | | Percentage | | Stress corrosion crack resistance | | | Spring bending elastic limit | | | |
| Test No. | Alloy No. | Step No. | of stress relaxation | (%) | Stress corrosion 1 | Stress corrosion 2 | Stress corrosion 3 | 0 degree direction ($N/mm^2$) | 90 degree direction ($N/mm^2$) | Solderability −1 | −2 | −11 |
| T1 | 1 | A1 | S | 15 | A | A | S | 487 | 507 | S | S | S |
| T2 | | A11 | S | 17 | A | A | S | 526 | 538 | S | S | S |
| T3 | | A2 | A | | A | A | S | 480 | 505 | S | S | S |
| T4 | | A4 | B | | A | A | | 523 | 542 | | | |
| T5 | | A3 | S | 14 | A | A | S | | | | | |
| T6 | | A31 | S | 15 | A | A | S | 515 | 526 | S | S | S |
| T7 | | A5 | A | | A | A | | | | | | |
| T8 | | A6 | A | | A | A | S | | | S | S | S |
| T9 | | A7 | A | 20 | A | A | S | 440 | 478 | | | |
| T10 | | A8 | S | 15 | A | A | S | 485 | 504 | | | |
| T11 | | A9 | S | 18 | A | A | S | 483 | 506 | S | S | S |
| T12 | | B1 | S | 15 | A | A | S | | | S | S | S |
| T13 | | B21 | A | | A | A | | | | | | |
| T14 | | B31 | S | | A | A | | | | | | |
| T15 | | B32 | B | | A | A | S | | | | | |
| T16 | | B41 | A | | A | A | S | | | | | |
| T17 | | B42 | B | | A | A | S | | | | | |
| T171 | | A43 | S | 17 | A | A | S | 493 | 518 | S | S | S |
| T18 | 2 | A1 | A | 22 | A | A | S | 493 | 510 | S | S | S |
| T19 | | A11 | A | 23 | A | A | | | | S | S | S |
| T20 | | A2 | A | | A | A | | 506 | 524 | | | |
| T21 | | A4 | B | | A | A | | 533 | 554 | | | |
| T22 | | A3 | A | 20 | A | A | S | | | S | S | S |
| T23 | | A31 | A | 22 | A | A | | | | | | |
| T24 | | A5 | A | | A | A | | | | | | |
| T25 | | A7 | A | 28 | A | A | | 435 | 477 | | | |
| T26 | | A8 | A | 22 | A | A | | 490 | 515 | | | |
| T27 | | A9 | A | 25 | A | A | S | 487 | 505 | S | S | S |
| T28 | | A41 | B | | A | A | | 517 | 530 | | | |

TABLE 7

| | | | Average | After recrystallization thermal treatment step | | | After recovery thermal treatment step | | | | |
|---|---|---|---|---|---|---|---|---|---|---|---|
| | | | crystal grain | Average | Precipitated particles | | Characteristics of rolled | | | | |
| | | | diameter after | crystal grain | Average | Proportion of | material (0 degree direction) | | | Electric | |
| Test No. | Alloy No. | Step No. | annealing step D0 (μm) | diameter D1 (μm) | grain diameter (nm) | particles in a range of 4 nm to 25 nm (%) | Tensile strength ($N/mm^2$) | Proof stress ($N/mm^2$) | Elonga-tion (%) | conduc-tivity (% IACS) | Young's modulus ($kN/mm^2$) |
| T29 | 3 | A1 | 4 | 3.3 | 7.0 | 90 | 543 | 527 | 7 | 34.2 | 127 |
| T30 | | A11 | | 3.3 | 7.0 | 90 | 590 | 571 | 4 | 34.0 | 129 |
| T31 | | A2 | | 2.8 | 6.0 | 87 | 555 | 539 | 7 | 34.4 | 127 |

TABLE 7-continued

| Test No. | Alloy No. | Step No. | Average crystal grain diameter after annealing step D0 (μm) | After recrystallization thermal treatment step: Average crystal grain diameter D1 (μm) | Precipitated particles: Average grain diameter (nm) | Precipitated particles: Proportion of particles in a range of 4 nm to 25 nm (%) | After recovery thermal treatment step: Characteristics of rolled material (0 degree direction): Tensile strength (N/mm$^2$) | Proof stress (N/mm$^2$) | Elongation (%) | Electric conductivity (% IACS) | Young's modulus (kN/mm$^2$) |
|---|---|---|---|---|---|---|---|---|---|---|---|
| T32 | | A4 | | 1.9 | 3.5 | 50 | 575 | 560 | 3 | 34.6 | 125 |
| T33 | | A3 | | 4.2 | 12.0 | 94 | 527 | 516 | 8 | 34.0 | 126 |
| T34 | | A31 | | 4.2 | 12.0 | 94 | 573 | 559 | 6 | 33.8 | 125 |
| T35 | | A5 | | 10.0 | 40.0 | 25 | 486 | 467 | 8 | 33.4 | 122 |
| T36 | | A6 | | 3.3 | 7.0 | 90 | 556 | 533 | 4 | 33.5 | 121 |
| T37 | | A7 | | 3.3 | 7.0 | 90 | 553 | 532 | 5 | 33.7 | 125 |
| T38 | | A8 | | 3.3 | 7.0 | 90 | 543 | 527 | 7 | 34.2 | 127 |
| T39 | | A9 | | 3.5 | 7.0 | 88 | 540 | 525 | 6 | 34.4 | 127 |
| T40 | | B1 | 4 | 3.3 | 7.0 | 90 | 541 | 525 | 7 | 34.1 | 126 |
| T41 | | B21 | | 7.0 | 25.0 | 65 | 488 | 475 | 7 | 34.3 | 125 |
| T42 | | B31 | 4 | 3.5 | 9.0 | 89 | 543 | 528 | 6 | 34.2 | 126 |
| T43 | | B32 | 4 | 4.0 | Mixed grains | | 531 | 513 | 5 | 34.2 | 124 |
| T44 | | B41 | 5 | 3.8 | 10.0 | 89 | 537 | 519 | 6 | 34.3 | 126 |
| T45 | | B42 | 16 | 5.0 | Mixed grains | | 510 | 491 | 4 | 34.4 | 125 |
| T46 | | A41 | | 1.8 | 3.4 | 50 | 558 | 543 | 4 | 34.6 | 125 |
| T47 | 5 | A1 | 5.2 | 3.8 | 9.0 | 94 | 524 | 510 | 9 | 35.2 | 130 |
| T48 | | A11 | | 3.8 | 9.0 | 94 | 570 | 552 | 5 | 35.0 | 130 |
| T49 | | A2 | | 3.3 | 7.0 | 91 | 540 | 527 | 7 | 35.5 | 131 |
| T50 | | A3 | | 5.4 | 16.0 | 90 | 512 | 500 | 10 | 34.5 | 128 |
| T51 | | A31 | | 5.4 | 16.0 | 90 | 557 | 544 | 6 | 34.4 | 127 |
| T52 | | A5 | | 14.0 | 55.0 | 15 | 468 | 450 | 8 | 33.8 | 126 |
| T53 | | A6 | | 3.8 | 9.0 | 94 | 542 | 520 | 5 | 34.0 | 123 |
| T54 | | A7 | | 3.8 | 9.0 | 94 | 540 | 519 | 6 | 34.2 | 126 |
| T55 | | A8 | | 3.8 | 9.0 | 94 | 523 | 508 | 10 | 35.4 | 130 |
| T56 | | B1 | 5.4 | 3.8 | 10.0 | 90 | 526 | 515 | 9 | 35.0 | 129 |
| T57 | | B21 | | 8.5 | 17.0 | 65 | 490 | 473 | 7 | 35.7 | 128 |
| T58 | | B31 | 5.2 | 4.0 | 12.0 | 88 | 522 | 505 | 9 | 35.2 | 128 |
| T59 | | B32 | 5.2 | 5.4 | Mixed grains | | 518 | 498 | 6 | 35.5 | 127 |
| T60 | | B41 | 7.0 | 4.5 | 12.0 | 89 | 516 | 497 | 9 | 35.8 | 130 |
| T61 | | B42 | 22.0 | 6.0 | Mixed grains | | 500 | 480 | 7 | 35.7 | 127 |
| T611 | | B43 | | 3.5 | 9.0 | 90 | 534 | 520 | 8 | 34.9 | 128 |

TABLE 8

| Test No. | Alloy No. | Step No. | After recovery thermal treatment step: Balance index f2 | Balance index f21 | Characteristics of rolled material (90 degree direction): Tensile strength (N/mm$^2$) | Proof stress (N/mm$^2$) | 90 degree/0 degree tensile strength ratio | 90 degree/0 degree proof stress ratio | Bending workability: 90 degree direction Bad Way | 0 degree direction Good Way |
|---|---|---|---|---|---|---|---|---|---|---|
| T29 | 3 | A1 | 3398 | 3298 | 553 | 537 | 1.018 | 1.019 | S | S |
| T30 | | A11 | 3578 | 3463 | 608 | 587 | 1.031 | 1.028 | A | S |
| T31 | | A2 | 3483 | 3383 | 567 | 553 | 1.022 | 1.026 | A | S |
| T32 | | A4 | 3484 | 3393 | 606 | 589 | 1.054 | 1.052 | B | A |
| T33 | | A3 | 3319 | 3249 | 538 | 526 | 1.021 | 1.019 | S | S |
| T34 | | A31 | 3531 | 3445 | 587 | 575 | 1.024 | 1.029 | A | S |
| T35 | | A5 | 3033 | 2915 | 512 | 491 | 1.053 | 1.051 | A | S |
| T36 | | A6 | 3347 | 3208 | 577 | 550 | 1.038 | 1.032 | A | S |
| T37 | | A7 | 3371 | 3243 | 573 | 548 | 1.036 | 1.030 | S | S |
| T38 | | A8 | 3398 | 3298 | 553 | 537 | 1.018 | 1.019 | S | S |
| T39 | | A9 | 3357 | 3264 | 552 | 536 | 1.022 | 1.021 | S | S |
| T40 | | B1 | 3380 | 3280 | 552 | 535 | 1.020 | 1.019 | S | S |
| T41 | | B21 | 3058 | 2977 | 513 | 496 | 1.051 | 1.044 | A | S |
| T42 | | B31 | 3366 | 3273 | 557 | 539 | 1.026 | 1.021 | A | S |
| T43 | | B32 | 3261 | 3150 | 565 | 547 | 1.064 | 1.066 | B | S |
| T44 | | B41 | 3334 | 3222 | 549 | 530 | 1.022 | 1.021 | S | S |
| T45 | | B42 | 3111 | 2995 | 538 | 518 | 1.055 | 1.055 | B | S |

TABLE 8-continued

| | | | After recovery thermal treatment step | | | | | | | |
|---|---|---|---|---|---|---|---|---|---|---|
| | | | | | Characteristics of rolled material (90 degree direction) | | 90 degree/0 degree | 90 degree/0 degree | Bending workability | |
| Test No. | Alloy No. | Step No. | Balance index f2 | Balance index f21 | Tensile strength ($N/mm^2$) | Proof stress ($N/mm^2$) | tensile strength ratio | proof stress ratio | 90 degree direction Bad Way | 0 degree direction Good Way |
| T46 | | A41 | 3414 | 3322 | 587 | 569 | 1.052 | 1.048 | A | A |
| T47 | 5 | A1 | 3389 | 3298 | 532 | 517 | 1.015 | 1.014 | S | S |
| T48 | | A11 | 3541 | 3429 | 585 | 566 | 1.026 | 1.025 | A | S |
| T49 | | A2 | 3443 | 3360 | 552 | 532 | 1.022 | 1.009 | S | S |
| T50 | | A3 | 3308 | 3231 | 522 | 510 | 1.020 | 1.020 | S | S |
| T51 | | A31 | 3463 | 3382 | 575 | 560 | 1.032 | 1.029 | A | S |
| T52 | | A5 | 2939 | 2825 | 494 | 475 | 1.056 | 1.056 | B | S |
| T53 | | A6 | 3318 | 3184 | 556 | 530 | 1.026 | 1.019 | A | S |
| T54 | | A7 | 3347 | 3217 | 555 | 532 | 1.028 | 1.025 | S | S |
| T55 | | A8 | 3423 | 3325 | 530 | 517 | 1.013 | 1.018 | S | S |
| T56 | | B1 | 3392 | 3321 | 537 | 524 | 1.021 | 1.017 | S | S |
| T57 | | B21 | 3133 | 3024 | 516 | 497 | 1.053 | 1.051 | A | S |
| T58 | | B31 | 3376 | 3266 | 536 | 520 | 1.027 | 1.030 | S | S |
| T59 | | B32 | 3272 | 3145 | 545 | 523 | 1.052 | 1.050 | B | S |
| T60 | | B41 | 3365 | 3241 | 533 | 512 | 1.033 | 1.030 | A | S |
| T61 | | B42 | 3197 | 3069 | 528 | 507 | 1.056 | 1.056 | B | S |
| T611 | | B43 | 3407 | 3318 | 545 | 531 | 1.021 | 1.021 | S | S |

TABLE 9

| | | | After recovery thermal treatment step | | | | | | | | | |
|---|---|---|---|---|---|---|---|---|---|---|---|---|
| | | | Percentage | | Stress corrosion crack resistance | | | Spring bending elastic limit | | | | |
| Test | Alloy | Step | of stress relaxation | | Stress corrosion | Stress corrosion | Stress corrosion | 0 degree direction | 90 degree direction | Solderability | | |
| No. | No. | No. | | (%) | 1 | 2 | 3 | ($N/mm^2$) | ($N/mm^2$) | −1 | −2 | −11 |
| T29 | 3 | A1 | S | 15 | A | A | S | 500 | 520 | S | S | S |
| T30 | | A11 | S | 16 | A | A | | | | S | S | S |
| T31 | | A2 | S | | A | A | | | | | | |
| T32 | | A4 | B | | A | A | | | | | | |
| T33 | | A3 | S | 13 | A | A | | | | S | S | S |
| T34 | | A31 | S | 14 | A | A | S | | | S | S | S |
| T35 | | A5 | B | | A | A | | | | | | |
| T36 | | A6 | A | | A | A | S | | | S | S | S |
| T37 | | A7 | A | 23 | A | A | | | | | | |
| T38 | | A8 | S | 15 | A | A | | | | | | |
| T39 | | A9 | S | 18 | A | A | S | | | S | S | S |
| T40 | | B1 | S | | A | A | S | 490 | 515 | S | S | S |
| T41 | | B21 | A | | A | A | | | | | | |
| T42 | | B31 | S | | A | A | | | | | | |
| T43 | | B32 | B | | A | A | | | | | | |
| T44 | | B41 | A | | A | A | | | | | | |
| T45 | | B42 | B | | A | A | | | | | | |
| T46 | | A41 | B | | A | A | | | | | | |
| T47 | 5 | A1 | S | 13 | A | A | S | 485 | 500 | S | S | S |
| T48 | | A11 | S | 14 | A | A | S | | | S | S | S |
| T49 | | A2 | S | | A | A | | 500 | 520 | | | |
| T50 | | A3 | S | 13 | A | A | | | | | | |
| T51 | | A31 | S | 13 | A | A | S | | | S | S | S |
| T52 | | A5 | A | | A | A | | | | | | |
| T53 | | A6 | A | | A | A | S | | | S | S | S |
| T54 | | A7 | S | 18 | A | A | | | | | | |
| T55 | | A8 | S | 13 | A | A | | | | | | |
| T56 | | B1 | S | 14 | A | A | S | 482 | 502 | S | S | S |
| T57 | | B21 | A | | A | A | | | | | | |
| T58 | | B31 | S | | A | A | | | | | | |
| T59 | | B32 | A | | A | A | | | | | | |
| T60 | | B41 | S | | A | A | | | | | | |
| T61 | | B42 | A | | A | A | | | | | | |
| T611 | | B43 | S | 15 | A | A | S | 488 | 510 | S | S | S |

TABLE 10

| Test No. | Alloy No. | Step No. | Average crystal grain diameter after annealing step D0 (μm) | After recrystallization thermal treatment step: Average crystal grain diameter D1 (μm) | Precipitated particles: Average grain diameter (nm) | Precipitated particles: Proportion of particles in a range of 4 nm to 25 nm (%) | After recovery thermal treatment step: Characteristics of rolled material (0 degree direction): Tensile strength (N/mm$^2$) | Proof stress (N/mm$^2$) | Elongation (%) | Electric conductivity (% IACS) | Young's modulus (kN/mm$^2$) |
|---|---|---|---|---|---|---|---|---|---|---|---|
| T62 | 6 | A1 | 4.5 | 4.3 | 10.0 | 95 | 525 | 510 | 9 | 35.2 | 128 |
| T63 | | A11 | | 4.3 | 10.0 | 95 | 574 | 558 | 5 | 35.2 | 128 |
| T64 | | A3 | | 5.0 | 14.0 | 90 | 512 | 498 | 10 | 35.0 | 127 |
| T65 | | A31 | | 5.0 | 14.0 | 90 | 557 | 542 | 6 | 34.8 | 126 |
| T66 | | A6 | | 4.3 | 10.0 | 95 | 535 | 512 | 4 | 34.3 | 120 |
| T67 | | A7 | | 4.3 | 10.0 | 95 | 532 | 515 | 5 | 34.5 | 123 |
| T68 | | A8 | | 4.3 | 10.0 | 95 | 525 | 509 | 9 | 35.2 | 128 |
| T690 | 7 | A1 | 4.0 | 3.5 | 11.0 | 94 | 568 | 557 | 8 | 31.7 | 121 |
| T691 | | A11 | | 3.5 | 11.0 | 94 | 616 | 599 | 7 | 31.5 | 120 |
| T692 | | A2 | | 3.2 | 9.5 | 92 | 584 | 570 | 5 | 31.8 | 119 |
| T693 | | A3 | | 5.0 | 14.0 | 90 | 550 | 540 | 9 | 31.5 | 121 |
| T694 | | A31 | | 5.0 | 14.0 | 90 | 594 | 575 | 7 | 31.4 | 121 |
| T695 | | A5 | | 9.0 | 55.0 | 20 | 514 | 489 | 9 | 31.0 | 117 |
| T696 | | A6 | | 3.5 | 11.0 | 94 | 583 | 568 | 3 | 30.7 | 116 |
| T697 | | A7 | | 3.5 | 11.0 | 94 | 578 | 565 | 4 | 31.2 | 117 |
| T698 | | A8 | | 3.5 | 11.0 | 94 | 567 | 554 | 8 | 31.8 | 120 |
| T699 | | A9 | | 3.6 | 11.0 | 93 | 565 | 553 | 7 | 31.7 | 120 |
| T700 | | B1 | | 3.6 | 11.0 | 93 | 566 | 555 | 7 | 31.7 | 121 |
| T701 | | B21 | | 8.0 | 30.0 | 55 | 516 | 503 | 8 | 31.5 | 119 |
| T702 | | B31 | | 3.8 | 13.0 | 90 | 558 | 544 | 6 | 31.6 | 122 |
| T703 | | B32 | | 4.5 | 27.0 | 65 | 552 | 533 | 5 | 31.6 | 118 |
| T704 | | B41 | | 4.0 | 13.0 | 90 | 560 | 538 | 6 | 31.7 | 120 |
| T705 | | B42 | | 5.0 | 30.0 | 65 | 537 | 516 | 4 | 31.8 | 118 |
| T706 | | B43 | | 3.3 | 9.5 | 92 | 573 | 561 | 7 | 31.5 | 120 |
| T710 | 8 | A1 | 4.0 | 3.2 | 8.0 | 94 | 578 | 567 | 7 | 31.2 | 118 |
| T711 | | A2 | | 2.8 | 6.0 | 85 | 597 | 583 | 5 | 31.3 | 116 |
| T712 | | A3 | | 3.8 | 12.0 | 92 | 561 | 540 | 8 | 31.1 | 118 |
| T713 | | A31 | | 3.8 | 12.0 | 92 | 604 | 587 | 7 | 31.0 | 118 |
| T714 | | A4 | | 1.8 | 4.0 | 55 | 612 | 588 | 3 | 31.5 | 116 |
| T715 | | A7 | | 3.2 | 8.0 | 94 | 595 | 570 | 3 | 30.6 | 114 |
| T716 | | A8 | | 3.2 | 8.0 | 94 | 577 | 564 | 5 | 31.3 | 116 |
| T717 | | A9 | | 3.2 | 8.0 | 93 | 578 | 564 | 7 | 31.3 | 117 |

TABLE 11

| Test No. | Alloy No. | Step No. | After recovery thermal treatment step: Balance index f2 | Balance index f21 | Characteristics of rolled material (90 degree direction): Tensile strength (N/mm$^2$) | Proof stress (N/mm$^2$) | 90 degree/0 degree tensile strength ratio | 90 degree/0 degree proof stress ratio | Bending workability: 90 degree direction Bad Way | 0 degree direction Good Way |
|---|---|---|---|---|---|---|---|---|---|---|
| T62 | 6 | A1 | 3395 | 3298 | 533 | 518 | 1.015 | 1.016 | S | S |
| T63 | | A11 | 3576 | 3476 | 590 | 575 | 1.028 | 1.030 | A | S |
| T64 | | A3 | 3332 | 3241 | 523 | 505 | 1.021 | 1.014 | S | S |
| T65 | | A31 | 3483 | 3389 | 573 | 558 | 1.029 | 1.030 | S | S |
| T66 | | A6 | 3259 | 3119 | 551 | 524 | 1.030 | 1.023 | S | S |
| T67 | | A7 | 3281 | 3176 | 547 | 526 | 1.028 | 1.021 | S | S |
| T68 | | A8 | 3395 | 3292 | 532 | 518 | 1.013 | 1.018 | S | S |
| T690 | 7 | A1 | 3454 | 3387 | 583 | 568 | 1.026 | 1.020 | S | S |
| T691 | | A11 | 3699 | 3597 | 640 | 607 | 1.039 | 1.013 | A | S |
| T692 | | A2 | 3458 | 3375 | 606 | 585 | 1.038 | 1.026 | A | A |
| T693 | | A3 | 3365 | 3304 | 564 | 550 | 1.025 | 1.019 | S | S |
| T694 | | A31 | 3562 | 3448 | 617 | 590 | 1.039 | 1.026 | A | S |
| T695 | | A5 | 3119 | 2968 | 544 | 512 | 1.058 | 1.047 | A | S |
| T696 | | A6 | 3327 | 3242 | 605 | 575 | 1.038 | 1.012 | A | S |
| T697 | | A7 | 3358 | 3282 | 598 | 570 | 1.035 | 1.009 | A | S |
| T698 | | A8 | 3453 | 3374 | 581 | 565 | 1.025 | 1.020 | S | S |
| T699 | | A9 | 3404 | 3331 | 582 | 562 | 1.030 | 1.016 | A | S |
| T700 | | B1 | 3410 | 3344 | 582 | 567 | 1.028 | 1.022 | S | S |
| T701 | | B21 | 3128 | 3049 | 545 | 529 | 1.056 | 1.052 | A | S |
| T702 | | B31 | 3325 | 3242 | 575 | 555 | 1.030 | 1.020 | A | S |

TABLE 11-continued

| | | | After recovery thermal treatment step | | | | | | | |
|---|---|---|---|---|---|---|---|---|---|---|
| | | | | | Characteristics of rolled material (90 degree direction) | | 90 degree/0 degree | 90 degree/0 degree | Bending workability | |
| Test No. | Alloy No. | Step No. | Balance index f2 | Balance index f21 | Tensile strength (N/mm$^2$) | Proof stress (N/mm$^2$) | tensile strength ratio | proof stress ratio | 90 degree direction Bad Way | 0 degree direction Good Way |
| T703 | | B32 | 3258 | 3146 | 584 | 560 | 1.058 | 1.051 | B | A |
| T704 | | B41 | 3342 | 3211 | 578 | 552 | 1.032 | 1.026 | S | S |
| T705 | | B42 | 3149 | 3026 | 568 | 543 | 1.058 | 1.052 | B | S |
| T706 | | B43 | 3441 | 3369 | 592 | 577 | 1.033 | 1.029 | S | S |
| T710 | 8 | A1 | 3455 | 3389 | 595 | 580 | 1.029 | 1.023 | A | S |
| T711 | | A2 | 3507 | 3425 | 621 | 599 | 1.040 | 1.027 | A | A |
| T712 | | A3 | 3379 | 3252 | 575 | 552 | 1.025 | 1.022 | S | S |
| T713 | | A31 | 3598 | 3497 | 628 | 604 | 1.040 | 1.029 | A | S |
| T714 | | A4 | 3538 | 3399 | 650 | 614 | 1.062 | 1.044 | B | B |
| T715 | | A7 | 3390 | 3248 | 618 | 576 | 1.039 | 1.011 | A | S |
| T716 | | A8 | 3390 | 3313 | 593 | 575 | 1.028 | 1.020 | A | S |
| T717 | | A9 | 3460 | 3376 | 597 | 578 | 1.033 | 1.025 | A | S |

TABLE 12

| | | | After recovery thermal treatment step | | | | | | | | | |
|---|---|---|---|---|---|---|---|---|---|---|---|---|
| | | | Percentage | | Stress corrosion crack resistance | | | Spring bending elastic limit | | | | |
| Test | Alloy | Step | of stress relaxation | | Stress corrosion | Stress corrosion | Stress corrosion | 0 degree direction | 90 degree direction | Solderability | | |
| No. | No. | No. | | (%) | 1 | 2 | 3 | (N/mm$^2$) | (N/mm$^2$) | −1 | −2 | −11 |
| T62 | 6 | A1 | S | 14 | A | A | S | 480 | 495 | S | S | S |
| T63 | | A1 | S | 15 | A | A | | | | | | |
| T64 | | A3 | S | 13 | A | A | S | | | S | S | S |
| T65 | | A31 | S | 15 | A | A | | | | | | |
| T66 | | A6 | A | | A | A | S | | | S | S | S |
| T67 | | A7 | A | 21 | A | A | | | | | | |
| T68 | | A8 | S | 14 | A | A | | | | | | |
| T690 | 7 | A1 | S | 15 | A | A | S | 527 | 550 | S | S | S |
| T691 | | A1 | S | 17 | A | A | A | 562 | 590 | | | |
| T692 | | A2 | S | | A | A | A | | | | | |
| T693 | | A3 | S | 14 | A | A | S | 507 | 530 | | | |
| T694 | | A31 | S | 15 | A | A | S | | | S | S | S |
| T695 | | A5 | B | | A | A | A | | | | | |
| T696 | | A6 | A | | A | A | A | | | S | S | S |
| T697 | | A7 | A | 22 | A | A | A | | | | | |
| T698 | | A8 | S | 16 | A | A | S | 522 | 550 | | | |
| T699 | | A9 | S | 17 | A | A | S | 515 | 542 | S | S | S |
| T700 | | B1 | S | 16 | A | A | S | 525 | 548 | S | S | S |
| T701 | | B21 | B | | A | A | S | | | | | |
| T702 | | B31 | S | | A | A | S | 510 | 533 | | | |
| T703 | | B32 | B | | A | A | A | | | | | |
| T704 | | B41 | A | | A | A | S | | | | | |
| T705 | | B42 | B | | A | A | A | | | | | |
| T706 | | B43 | S | 17 | A | A | S | 533 | 558 | S | S | S |
| T710 | 8 | A1 | S | 17 | A | A | A | 540 | 565 | S | S | S |
| T711 | | A2 | S | | A | B | B | | | | | |
| T712 | | A3 | S | 17 | A | A | S | | | S | S | S |
| T713 | | A31 | S | 18 | A | A | A | 562 | 585 | | | |
| T714 | | A4 | B | | B | B | C | | | | | |
| T715 | | A7 | A | 24 | A | A | A | 495 | 530 | | | |
| T716 | | A8 | S | 18 | A | A | S | 535 | 562 | | | |
| T717 | | A9 | A | 19 | A | A | A | 533 | 560 | S | S | S |

TABLE 13

| Test No. | Alloy No. | Step No. | Average crystal grain diameter after annealing step D0 (μm) | After recrystallization thermal treatment step: Average crystal grain diameter D1 (μm) | Precipitated particles: Average grain diameter (nm) | Precipitated particles: Proportion of particles in a range of 4 nm to 25 nm (%) | After recovery thermal treatment step: Characteristics of rolled material (0 degree direction): Tensile strength (N/mm$^2$) | Proof stress (N/mm$^2$) | Elongation (%) | Electric conductivity (% IACS) | Young's modulus (kN/mm$^2$) |
|---|---|---|---|---|---|---|---|---|---|---|---|
| T720 | 9 | A1 | | 3.5 | 11.0 | 94 | 585 | 568 | 7 | 30.7 | 117 |
| T721 | | A2 | | 3.2 | 9.5 | 92 | 602 | 578 | 5 | 30.8 | 116 |
| T722 | | A3 | | 5.0 | 14.0 | 92 | 569 | 551 | 8 | 31.8 | 116 |
| T723 | | A31 | | 5.0 | 14.0 | 93 | 615 | 588 | 5 | 33.8 | 118 |
| T724 | | A6 | | 3.5 | 11.0 | 94 | 605 | 581 | 3 | 30.0 | 117 |
| T725 | | A7 | | 3.5 | 11.0 | 94 | 600 | 580 | 4 | 30.1 | 117 |
| T726 | | A8 | | 3.5 | 11.0 | 94 | 584 | 566 | 6 | 30.8 | 118 |
| T727 | | A9 | | 3.6 | 11.0 | 93 | 581 | 563 | 7 | 30.6 | 117 |
| T728 | | B1 | | 3.5 | 11.0 | 94 | 584 | 566 | 7 | 30.8 | 117 |
| T729 | | B43 | | 3.3 | 10.0 | 93 | 590 | 570 | 6 | 30.7 | 116 |
| T73 | 12 | C1 | | 3.9 | 13.0 | 95 | 536 | 520 | 9 | 37.0 | 123 |
| T74 | 14 | C1 | | 3.5 | 8.5 | 90 | 537 | 520 | 8 | 38.1 | 124 |
| T75 | 15 | C1 | | 3.7 | 12.0 | 94 | 538 | 525 | 8 | 34.7 | 126 |
| T76 | 16 | C1 | | 5.5 | 14.0 | 95 | 512 | 500 | 9 | 36.0 | 130 |
| T77 | | C3 | | | 14.0 | 94 | 554 | 535 | 5 | 35.8 | 130 |
| T78 | 161 | C1 | | 4.2 | 8.0 | 90 | 522 | 507 | 8 | 36.3 | 129 |
| T79 | 162 | C1 | | 5.0 | 9.0 | 92 | 513 | 501 | 9 | 39.1 | 128 |
| T80 | | C3 | | | 10.0 | 92 | 560 | 543 | 5 | 38.9 | 128 |
| T81 | 163 | C1 | | 5.2 | 12.0 | 95 | 505 | 490 | 9 | 40.3 | 122 |
| T82 | 166 | C1 | | 3.5 | 6.0 | 85 | 547 | 530 | 7 | 33.2 | 123 |
| T83 | 167 | C1 | | 3.5 | 10.0 | 92 | 546 | 529 | 8 | 34.8 | 125 |
| T84 | 168 | C1 | | 4.5 | 12.0 | 95 | 507 | 494 | 9 | 36.7 | 129 |
| T85 | 169 | C1 | | 3.8 | 11.0 | 95 | 533 | 519 | 9 | 35.2 | 125 |
| T86 | | C3 | | | 12.0 | 94 | 580 | 561 | 5 | 35.1 | 124 |
| T87 | 17 | C1 | | 2.8 | 4.9 | 82 | 539 | 515 | 7 | 36.1 | 121 |
| T88 | 172 | C1 | 5.0 | 3.2 | 6.5 | 87 | 531 | 520 | 8 | 36.3 | 125 |
| T880 | 180 | C1 | | 3.0 | 7.5 | 93 | 590 | 575 | 7 | 30.3 | 114 |
| T881 | 181 | C1 | | 3.2 | 8.0 | 94 | 582 | 559 | 6 | 31.1 | 113 |
| T882 | 182 | C1 | | 3.0 | 7.0 | 90 | 588 | 565 | 7 | 31.0 | 109 |
| T883 | 183 | C1 | | 2.8 | 8.0 | 93 | 593 | 564 | 6 | 30.2 | 112 |
| T884 | 184 | C1 | | 3.6 | 10.0 | 90 | 555 | 529 | 6 | 31.1 | 114 |
| T885 | 185 | C1 | | 4.0 | 12.0 | 90 | 561 | 537 | 7 | 31.3 | 118 |

TABLE 14

| Test No. | Alloy No. | Step No. | After recovery thermal treatment step: Balance index f2 | Balance index f21 | Characteristics of rolled material (90 degree direction): Tensile strength (N/mm$^2$) | Proof stress (N/mm$^2$) | 90 degree/0 degree tensile strength ratio | 90 degree/0 degree proof stress ratio | Bending workability: 90 degree direction Bad Way | 0 degree direction Good Way |
|---|---|---|---|---|---|---|---|---|---|---|
| T720 | 9 | A1 | 3468 | 3367 | 602 | 577 | 1.029 | 1.016 | A | S |
| T721 | | A2 | 3508 | 3368 | 628 | 597 | 1.043 | 1.033 | A | S |
| T722 | | A3 | 3465 | 3356 | 586 | 562 | 1.030 | 1.020 | S | S |
| T723 | | A31 | 3754 | 3589 | 642 | 604 | 1.044 | 1.027 | A | S |
| T724 | | A6 | 3413 | 3278 | 631 | 600 | 1.043 | 1.033 | A | S |
| T725 | | A7 | 3423 | 3309 | 624 | 591 | 1.040 | 1.019 | A | S |
| T726 | | A8 | 3436 | 3330 | 600 | 574 | 1.027 | 1.014 | A | S |
| T727 | | A9 | 3439 | 3332 | 601 | 574 | 1.034 | 1.020 | A | S |
| T728 | | B1 | 3468 | 3361 | 600 | 576 | 1.027 | 1.018 | A | S |
| T729 | | B43 | 3465 | 3348 | 608 | 582 | 1.031 | 1.021 | A | S |
| T73 | 12 | C1 | 3554 | 3448 | 548 | 531 | 1.022 | 1.021 | S | S |
| T74 | 14 | C1 | 3580 | 3466 | 552 | 533 | 1.028 | 1.025 | S | S |
| T75 | 15 | C1 | 3423 | 3340 | 550 | 531 | 1.022 | 1.011 | S | S |
| T76 | 16 | C1 | 3348 | 3270 | 516 | 505 | 1.008 | 1.010 | S | S |
| T77 | | C3 | 3480 | 3361 | 570 | 552 | 1.029 | 1.032 | S | S |
| T78 | 161 | C1 | 3397 | 3299 | 530 | 514 | 1.015 | 1.014 | S | S |
| T79 | 162 | C1 | 3496 | 3415 | 523 | 508 | 1.019 | 1.014 | S | S |
| T80 | | C3 | 3667 | 3556 | 580 | 561 | 1.036 | 1.033 | A | S |
| T81 | 163 | C1 | 3494 | 3391 | 511 | 495 | 1.012 | 1.010 | S | S |
| T82 | 166 | C1 | 3372 | 3268 | 565 | 545 | 1.033 | 1.028 | A | S |

TABLE 14-continued

| | | | After recovery thermal treatment step | | | | | | | |
|---|---|---|---|---|---|---|---|---|---|---|
| | | | | | Characteristics of rolled material (90 degree direction) | | 90 degree/0 degree | 90 degree/0 degree | Bending workability | |
| Test No. | Alloy No. | Step No. | Balance index f2 | Balance index f21 | Tensile strength ($N/mm^2$) | Proof stress ($N/mm^2$) | tensile strength ratio | proof stress ratio | 90 degree direction Bad Way | 0 degree direction Good Way |
| T83 | 167 | C1 | 3479 | 3370 | 558 | 536 | 1.022 | 1.013 | S | S |
| T84 | 168 | C1 | 3348 | 3262 | 519 | 504 | 1.024 | 1.020 | S | S |
| T85 | 169 | C1 | 3447 | 3356 | 542 | 524 | 1.017 | 1.010 | S | S |
| T86 | | C3 | 3608 | 3490 | 598 | 578 | 1.031 | 1.030 | A | S |
| T87 | 17 | C1 | 3465 | 3311 | 557 | 530 | 1.033 | 1.029 | A | S |
| T88 | 172 | C1 | 3455 | 3384 | 547 | 534 | 1.030 | 1.027 | S | S |
| T880 | 180 | C1 | 3475 | 3387 | 614 | 588 | 1.041 | 1.023 | A | S |
| T881 | 181 | C1 | 3440 | 3304 | 608 | 583 | 1.045 | 1.043 | A | S |
| T882 | 182 | C1 | 3503 | 3366 | 614 | 584 | 1.044 | 1.034 | A | S |
| T883 | 183 | C1 | 3454 | 3285 | 619 | 585 | 1.044 | 1.037 | A | A |
| T884 | 184 | C1 | 3281 | 3127 | 579 | 551 | 1.043 | 1.042 | A | S |
| T885 | 185 | C1 | 3358 | 3215 | 583 | 552 | 1.039 | 1.028 | A | S |

TABLE 15

| | | | After recovery thermal treatment step | | | | | | | | | |
|---|---|---|---|---|---|---|---|---|---|---|---|---|
| | | | Percentage | | Stress corrosion crack resistance | | | Spring bending elastic limit | | | | |
| Test | Alloy | Step | of stress relaxation | | Stress corrosion | Stress corrosion | Stress corrosion | 0 degree direction | 90 degree direction | Solderability | | |
| No. | No. | No. | | (%) | 1 | 2 | 3 | ($N/mm^2$) | ($N/mm^2$) | −1 | −2 | −11 |
| T720 | 9 | A1 | S | 18 | A | A | A | 530 | 555 | S | S | S |
| T721 | | A2 | A | | A | A | B | | | | | |
| T722 | | A3 | S | 17 | A | A | A | | | | | |
| T723 | | A31 | S | 18 | A | B | B | | | S | S | S |
| T724 | | A6 | A | | A | A | B | | | S | S | S |
| T725 | | A7 | A | | A | A | A | 505 | 555 | | | |
| T726 | | A8 | S | 18 | A | A | A | 527 | 550 | | | |
| T727 | | A9 | A | 20 | A | A | A | | | S | S | S |
| T728 | | B1 | S | | A | A | A | 525 | 552 | S | S | S |
| T729 | | B43 | S | | A | A | A | 531 | 560 | S | S | S |
| T73 | 12 | C1 | A | 28 | A | A | | | | S | A | S |
| T74 | 14 | C1 | A | 28 | A | A | | | | S | A | S |
| T75 | 15 | C1 | S | 14 | A | A | | | | S | S | S |
| T76 | 16 | C1 | S | 14 | A | A | | | | S | S | S |
| T77 | | C3 | S | 16 | A | A | | | | | | |
| T78 | 161 | C1 | S | 13 | A | A | | 470 | 485 | S | S | S |
| T79 | 162 | C1 | S | 16 | A | A | | | | S | S | S |
| T80 | | C3 | S | 17 | A | A | | | | | | |
| T81 | 163 | C1 | A | 26 | A | A | | | | S | S | S |
| T82 | 166 | C1 | A | 22 | A | A | | | | S | A | S |
| T83 | 167 | C1 | A | 27 | A | A | | | | S | S | S |
| T84 | 168 | C1 | A | 19 | A | A | | | | S | S | S |
| T85 | 169 | C1 | S | 15 | A | A | | 485 | 495 | S | S | S |
| T86 | | C3 | S | 17 | A | A | | 515 | 520 | | | |
| T87 | 17 | C1 | A | 28 | A | A | | 495 | 520 | S | S | S |
| T88 | 172 | C1 | A | 19 | A | A | | 504 | 516 | | | |
| T880 | 180 | C1 | A | 23 | A | A | B | 545 | 567 | S | S | S |
| T881 | 181 | C1 | A | 27 | A | B | B | 540 | 565 | S | A | S |
| T882 | 182 | C1 | A | 28 | A | A | B | 542 | 567 | S | A | S |
| T883 | 183 | C1 | A | 24 | A | B | B | 545 | 570 | S | A | S |
| T884 | 184 | C1 | A | 26 | A | A | A | | | S | S | S |
| T885 | 185 | C1 | A | 26 | A | A | A | 497 | 522 | S | S | S |

TABLE 16

| Test No. | Alloy No. | Step No. | Average crystal grain diameter after annealing step D0 (μm) | After recrystallization thermal treatment step: Average crystal grain diameter D1 (μm) | Precipitated particles: Average grain diameter (nm) | Precipitated particles: Proportion of particles in a range of 4 nm to 25 nm (%) | After recovery thermal treatment step: Characteristics of rolled material (0 degree direction): Tensile strength (N/mm$^2$) | Proof stress (N/mm$^2$) | Elongation (%) | Electric conductivity (% IACS) | Young's modulus (kN/mm$^2$) |
|---|---|---|---|---|---|---|---|---|---|---|---|
| T89 | 21 | C1 | | 3.8 | | | 527 | 511 | 9 | 35.2 | 117 |
| T90 | 22 | C1 | | 10.0 | 40.0 | 45 | 470 | 445 | 9 | 35.8 | 118 |
| T91 | | C3 | | 10.0 | | | 507 | 483 | 5 | 35.5 | 119 |
| T92 | 23 | C1 | | 1.9 | 3.2 | 30 | 548 | 530 | 4 | 35.2 | 120 |
| T93 | 24 | C1 | | 2.2 | 3.4 | 30 | 542 | 528 | 4 | 34.8 | 123 |
| T94 | 25 | C1 | | 5.0 | 15.0 | 85 | 510 | 492 | 8 | 36.8 | 118 |
| T95 | | C3 | | | | | 556 | 538 | 4 | 36.4 | 117 |
| T96 | 26 | C1 | | 8.5 | 18.0 | 85 | 457 | 436 | 9 | 39.2 | 118 |
| T97 | | C3 | | | | | 496 | 472 | 4 | 38.8 | 117 |
| T98 | 34 | C1 | | 9.0 | 27.0 | 65 | 453 | 430 | 9 | 37.8 | 118 |
| T100 | 28 | C1 | | 8.5 | 14.0 | 88 | 464 | 445 | 8 | 38.5 | 115 |
| T101 | 29 | C1 | | 5.0 | 15.0 | 85 | 506 | 483 | 7 | 36.5 | 122 |
| T102 | 30 | C1 | | 2.8 | 7.0 | 87 | 558 | 538 | 4 | 31.5 | 119 |
| T103 | 31 | C1 | | 9.3 | 27.0 | 60 | 446 | 431 | 8 | 41.5 | 117 |
| T105 | 35 | C1 | | 10.0 | 35.0 | 40 | 444 | 419 | 9 | 41.0 | 117 |
| T106 | 36 | C1 | | 7.5 | 19.0 | 70 | 453 | 430 | 9 | 41.6 | 116 |
| T107 | | C3 | | | | | 489 | 467 | 5 | 41.3 | 115 |
| T108 | 38 | C1 | | 1.8 | | | 550 | 522 | 3 | 34.8 | 121 |
| T109 | 39 | C1 | | 25.0 | | | 532 | 486 | 4 | 28.0 | 98 |
| T110 | 40 | C1 | | 3.8 | 12.0 | 90 | 584 | 555 | 5 | 29.8 | 105 |
| T111 | 41 | C1 | | 3.5 | 11.0 | 90 | 593 | 562 | 6 | 28.3 | 107 |
| T112 | 42 | C1 | | 2.8 | 7.0 | 90 | 600 | 570 | 5 | 28.4 | 113 |
| T113 | 43 | C1 | | 3.5 | 10.0 | 95 | 588 | 565 | 5 | 30.9 | 107 |
| T114 | 44 | C1 | | 3.2 | 8.0 | 94 | 581 | 557 | 7 | 31.1 | 113 |
| T115 | 45 | C1 | | 6.0 | 16.0 | 82 | 533 | 511 | 8 | 31.5 | 122 |
| T116 | 46 | C1 | | 6.0 | 14.0 | 85 | 540 | 512 | 6 | 32.6 | 108 |

TABLE 17

| Test No. | Alloy No. | Step No. | After recovery thermal treatment step: Balance index f2 | Balance index f21 | Characteristics of rolled material (90 degree direction): Tensile strength (N/mm$^2$) | Proof stress (N/mm$^2$) | 90 degree/0 degree tensile strength ratio | 90 degree/0 degree proof stress ratio | Bending workability: 90 degree direction Bad Way | 0 degree direction Good Way |
|---|---|---|---|---|---|---|---|---|---|---|
| T89 | 21 | C1 | 3408 | 3305 | 543 | 524 | 1.030 | 1.025 | A | S |
| T90 | 22 | C1 | 3065 | 2902 | 487 | 460 | 1.036 | 1.034 | S | S |
| T91 | | C3 | 3172 | 3022 | 530 | 503 | 1.045 | 1.041 | B | S |
| T92 | 23 | C1 | 3381 | 3270 | 590 | 565 | 1.077 | 1.066 | C | A |
| T93 | 24 | C1 | 3325 | 3239 | 590 | 566 | 1.089 | 1.072 | C | A |
| T94 | 25 | C1 | 3341 | 3223 | 524 | 505 | 1.027 | 1.026 | S | S |
| T95 | | C3 | 3489 | 3376 | 575 | 555 | 1.034 | 1.032 | S | S |
| T96 | 26 | C1 | 3119 | 2975 | 476 | 453 | 1.042 | 1.039 | S | S |
| T97 | | C3 | 3213 | 3058 | 520 | 495 | 1.048 | 1.049 | A | S |
| T98 | 34 | C1 | 3036 | 2882 | 470 | 443 | 1.038 | 1.030 | A | S |
| T100 | 28 | C1 | 3109 | 2982 | 484 | 463 | 1.043 | 1.040 | S | S |
| T101 | 29 | C1 | 3271 | 3122 | 524 | 502 | 1.036 | 1.039 | S | S |
| T102 | 30 | C1 | 3257 | 3140 | 585 | 562 | 1.048 | 1.045 | A | S |
| T103 | 31 | C1 | 3103 | 2999 | 466 | 448 | 1.045 | 1.039 | S | S |
| T105 | 35 | C1 | 3099 | 2924 | 464 | 435 | 1.045 | 1.038 | S | S |
| T106 | 36 | C1 | 3185 | 3023 | 470 | 444 | 1.038 | 1.033 | S | S |
| T107 | | C3 | 3300 | 3151 | 514 | 490 | 1.051 | 1.049 | A | S |
| T108 | 38 | C1 | 3342 | 3172 | 591 | 560 | 1.075 | 1.073 | C | B |
| T109 | 39 | C1 | 2928 | 2675 | 578 | 528 | 1.086 | 1.086 | C | B |
| T110 | 40 | C1 | 3347 | 3181 | 617 | 588 | 1.057 | 1.059 | B | S |
| T111 | 41 | C1 | 3344 | 3169 | 627 | 591 | 1.057 | 1.052 | B | A |
| T112 | 42 | C1 | 3357 | 3190 | 635 | 600 | 1.058 | 1.053 | B | S |
| T113 | 43 | C1 | 3432 | 3298 | 620 | 593 | 1.054 | 1.050 | B | A |
| T114 | 44 | C1 | 3467 | 3324 | 614 | 591 | 1.057 | 1.061 | B | A |
| T115 | 45 | C1 | 3231 | 3097 | 563 | 540 | 1.056 | 1.057 | A | A |
| T116 | 46 | C1 | 3268 | 3099 | 568 | 539 | 1.052 | 1.053 | B | S |

TABLE 18

| | | | After recovery thermal treatment step | | | | | | | | | |
|---|---|---|---|---|---|---|---|---|---|---|---|---|
| | | | Percentage | | Stress corrosion crack resistance | | | Spring bending elastic limit | | | | |
| Test | Alloy | Step | of stress relaxation | | Stress corrosion | Stress corrosion | Stress corrosion | 0 degree direction | 90 degree direction | Solderability | | |
| No. | No. | No. | | (%) | 1 | 2 | 3 | (N/mm$^2$) | (N/mm$^2$) | −1 | −2 | −11 |
| T89 | 21 | C1 | B | 34 | A | A | | 420 | 475 | | | |
| T90 | 22 | C1 | B | 33 | A | A | | 380 | 425 | | | |
| T91 | | C3 | B | 35 | A | A | | 440 | 470 | | | |
| T92 | 23 | C1 | C | 44 | A | A | | 480 | 515 | | | |
| T93 | 24 | C1 | A | 26 | A | B | | | | | | |
| T94 | 25 | C1 | B | 36 | A | A | | | | | | |
| T95 | | C3 | B | 37 | A | A | | | | | | |
| T96 | 26 | C1 | B | 33 | A | A | | 352 | 388 | | | |
| T97 | | C3 | B | 34 | A | A | | | | | | |
| T98 | 34 | C1 | A | 27 | A | A | | | | | | |
| T100 | 28 | C1 | B | 32 | A | A | | 355 | 390 | | | |
| T101 | 29 | C1 | B | 32 | A | A | | 405 | 450 | | | |
| T102 | 30 | C1 | C | 42 | A | B | | | | | | |
| T103 | 31 | C1 | C | 40 | A | A | | | | | | |
| T105 | 35 | C1 | B | 32 | A | A | | | | | | |
| T106 | 36 | C1 | B | 36 | A | A | | 348 | 387 | | | |
| T107 | | C3 | B | 37 | A | A | | | | | | |
| T108 | 38 | C1 | C | 50 | A | A | | | | | | |
| T109 | 39 | C1 | C | 70 | C | C | C | | | S | C | A |
| T110 | 40 | C1 | B | 34 | B | B | C | | | S | A | A |
| T111 | 41 | C1 | B | 35 | A | B | C | | | | | |
| T112 | 42 | C1 | B | 33 | A | B | B | | | | | |
| T113 | 43 | C1 | C | 46 | B | B | C | | | | | |
| T114 | 44 | C1 | B | 36 | A | B | B | | | | | |
| T115 | 45 | C1 | B | 35 | A | A | A | 500 | 522 | | | |
| T116 | 46 | C1 | B | 34 | A | B | B | | | | | |

The tensile strength, the proof stress and the elongation were measured using the methods regulated in JIS Z 2201 and JIS Z 2241, and the test specimens had a shape of No. 5 test specimen. The Young's modulus was computed from the stress-strain curve during the tensile test.

The electric conductivity was measured using an electric conductivity meter (SIGMATEST D2.068) manufactured by Foerster Japan Limited. Meanwhile, in the specification, "electric conduction" and "conduction" are used with the same meaning. In addition, since thermal conduction and electric conduction have a strong correlation, higher electric conductivity indicates more favorable thermal conduction.

The bending workability was evaluated using W bending at a bending angle of 90 degrees regulated in JIS H 3110. A bend test (W bend test) was carried out in the following manner. The bend radius (R) at the front end of a bent jig was set to 0.67 times (0.3 mm×0.67=0.201 mm, bend radius=0.2 mm, R/t=0.67), 0.5 times (0.3 mm×0.5=0.15 mm, bend radius=0.15 mm, R/t=0.5) and 0 times (0.3 mm×0=0 mm, bend radius=0 mm, R/t=0) of the thickness (t) of a material. Samples were taken in a direction forming 90 degrees with respect to the rolling direction which is called 'bad way' and in a direction forming 0 degrees with respect to the rolling direction which is called 'good way'. The bending workability was determined based on whether or not cracking was observed using a 20-times stereomicroscope, copper alloys in which the bend radius was 0.5 times the thickness of the material (R/t=0.5) and cracking did not occur were evaluated to be A, copper alloys in which the bend radius was 0.67 times the thickness of the material (R/t=0.67) and cracking did not occur were evaluated to be B, and copper alloys in which the bend radius was 0.67 times the thickness of the material (R/t=0.67) and cracking occurred were evaluated to be C. In particular, a material having favorable bending workability was evaluated to be S when cracking did not occur at a thickness of 0 times (R/t=0). Since the object of the application is the total balance such as strength and bending workability being excellent, the bending workability was strictly evaluated. Meanwhile, the bending workability satisfying R/t≤0.5 means that cracking do not occur in the bending test in which the bend radius is 0.5 times or less the thickness of the material (R/t=0.5).

The percentage of stress relaxation was measured in the following manner. A cantilever screw-type jig was used in the stress relaxation test of a material under test. The test specimens were taken in a direction forming 0 degrees (parallel) with respect to the rolling direction, and the shape of the test specimen was set to a sheet thickness of t×a width of 10 mm×a length of 60 mm. The stress loaded on the material under test was set to 80% of the 0.2% proof stress, and the test specimen was exposed for 1000 hours in an atmosphere at 150° C. The percentage of stress relaxation was obtained using Percentage of stress relaxation=(dislocation after opening/dislocation under stress load)×100(%).

In the invention, the percentage of stress relaxation is preferably small.

For the test specimens taken in parallel to the rolling direction, a percentage of stress relaxation of 30% or less was evaluated to be A (excellent), a percentage of stress relaxation in a range of more than 30% to 40% was evaluated to be B (unacceptable), and a percentage of stress relaxation of more than 40% was evaluated to be C (unacceptable, particularly poor). A percentage of stress relaxation of 18% or less was evaluated to be S (particularly excellent).

Meanwhile, for the rolled material produced in Manufacturing Steps A1, A11, A3, A31, A7, A8 and A9, Manufacturing Steps B1 and B43, and Manufacturing Steps C1 and C3, test specimens were also taken in a direction forming 90 degrees (perpendicular) to the rolling direction, and tested. For the above-described specimens, the average of the percentages of stress relaxation in both test specimens taken in a direction parallel to the rolling direction and test specimens taken in a direction perpendicular to the rolling direction was described in Tables 6, 9, 12, 15 and 18. The percentage of stress relaxation of the test specimens taken in a direction perpendicular to the rolling direction is larger than that of the test specimens taken in the parallel direction, that is, has poor stress relaxation characteristics.

The stress corrosion crack resistance was measured using a test container and a test solution regulated in JIS H 3250, and a solution obtained by mixing the same amounts of ammonia water and water.

First, mainly, a residual stress was added to a rolled material, and the stress corrosion crack resistance was evaluated. The test specimen bent into a W shape at R (radius 0.6 mm) that was twice the sheet thickness was exposed to an ammonia atmosphere, and evaluated using the method used in the evaluation of the bending workability. The evaluation was carried out using a test container and a test solution regulated in JIS H 3250. The test specimen was exposed to ammonia using a solution obtained by mixing the same amounts of ammonia water and water, pickled using sulfuric acid, the occurrence of cracking was investigated using a 10-times stereomicroscope, and the stress corrosion crack resistance was evaluated. Copper alloys in which cracking did not occur in 48-hour exposure were evaluated to be A as being excellent in terms of stress corrosion crack resistance, copper alloys in which cracking occurred in 48-hour exposure but cracking did not occur in 24-hour exposure were evaluated to be B as being favorable in terms of stress corrosion crack resistance (no practical problem), and copper alloys in which cracking occurred in 24-hour exposure were evaluated to be C as being poor in terms of stress corrosion crack resistance (practically somewhat problematic). The results are described in the column of stress corrosion 1 of the stress corrosion crack resistance in Tables 6, 9, 12, 15 and 18.

In addition, separately from the above-described evaluation, the stress corrosion crack resistance was evaluated using another method.

In another stress corrosion crack test, in order to investigate the sensitivity of stress corrosion crack against additional stress, a resin cantilever screw-type jig was used, a rolled material to which a bend stress as large as 80% of the proof stress was added was exposed to the ammonia atmosphere, and the stress corrosion crack resistance was evaluated from the percentage of stress relaxation. That is, when fine cracks occur, the rolled material cannot return to the original state, and, when the degree of the cracks increases, the percentage of stress relaxation increases, and therefore the stress corrosion crack resistance can be evaluated. Copper alloys in which the percentage of stress relaxation was 25% or less in 48-hour exposure were evaluated to be A as being excellent in terms of stress corrosion crack resistance, copper alloys in which the percentage of stress relaxation was more than 25% in 48-hour exposure but the percentage of stress relaxation was 25% or less in 24-hour exposure were evaluated to be B as being favorable in terms of stress corrosion crack resistance (no practical problem), and copper alloys in which the percentage of stress relaxation was more than 25% in 24-hour exposure were evaluated to be C as being poor in terms of stress corrosion crack resistance (practically somewhat problematic). The results are described in the column of stress corrosion 2 of the stress corrosion crack resistance in Tables 6, 9, 12, 15 and 18.

Meanwhile, the stress corrosion crack resistance required in the application is a characteristic with an assumption of high reliability and strict cases.

Furthermore, for another measurement of the stress corrosion crack resistance, the atmosphere of the telecommunication industry technical standard (CES M0010-4 amended on 1978. 2. 24.) was employed. That is, 107 g of ammonium chloride ($NH_4Cl$) was dissolved in 700 ml of distilled water, and the solution was adjusted using distilled water so that the total amount reached 1000 ml when pH reached 10.1 by adding a solution obtained by dissolving 60 g of sodium hydroxide (NaOH) in 250 ml of distilled water, thereby obtaining a test solution. The above-described test solution was provided to the bottom of a dedicator, and exposed at a location 70 mm away from the test specimen. The dedicator was left to stand at a location at room temperature of 20° C. to 22° C. for 72 hours. Meanwhile, the present test solution, the test apparatus and the test method are based on the methods described in ASTM B858-06 Standard Test Method for Ammonia Vapor Test for Determining Susceptibility to Stress corrosion Cracking in Copper Alloys. The stress corrosion crack resistance required in the application is based on an assumption of high reliability or stricter cases, and therefore the test specimens were exposed for 72 hours in the specification while exposed for 24 hours in the ASTM method.

Regarding the test specimens, similarly to what has been described above, in order to investigate the sensitivity of stress corrosion crack against additional stress, a resin cantilever screw-type jig was used, a rolled material to which a bend stress as large as 80% of the proof stress was added was exposed to the above-described atmosphere, and the stress corrosion crack resistance was evaluated from the percentage of stress relaxation. Under 72-hour exposure, copper alloys in which the percentage of stress relaxation was 15% or less were evaluated to be S as being particularly excellent in terms of stress corrosion crack resistance, copper alloys in which the percentage of stress relaxation was 30% or less were evaluated to be A as being favorable in terms of stress corrosion crack resistance, and copper alloys in which the percentage of stress relaxation was 45% or less were evaluated to be B as being favorable in terms of stress corrosion crack resistance (no practically problematic). In a case in which the percentage of stress relaxation was 45% or more and cracks were visually observed after pickling, copper alloys were evaluated to be C as being poor in terms of stress corrosion crack resistance (practically problematic) irrespective of the percentage of stress relaxation. The results were described in the column of stress corrosion 3 of the stress corrosion crack resistance in Tables 6, 9, 12, 15 and 18.

The spring bending elastic limit was measured using a method described in JIS H 3130, evaluated using a repeated deflection test, and the test was carried out until the permanent deflection amount exceeded 0.1 mm.

The solderability was evaluated using the meniscograph method. An SAT-5200 manufactured by PHESCA (RHESCA Co., Ltd.) was used as the test facility. Test specimens were taken in the rolling direction, and cut into t:0.3×W:10×L:25 (mm). Sn-3.5% Ag-0.7% Cu and pure Sn were used as solder. Acetone defatting-15% sulfuric acid washing→water washing→acetone defatting were carried out as pretreatments. The standard rosin flux (NA200 manufactured by Tamura Kaken Co., Ltd.) was used as the flux. The evaluation test was carried out under conditions of a solder bath temperature of 270° C., an immersion depth of 2 mm, an immersion rate of 15 mm/sec, and an immersion time of 15 seconds.

The solderability was evaluated using zero cross time. That is, the zero cross time refers to a time necessary for solder to be fully soaked after being immersed in a bath, and, when the zero cross time was 5 seconds or less, that is, the solder was fully soaked within 5 seconds after being immersed in the solder bath, the solderability was evaluated to be A as being not practically problematic, and, in a case in which the zero cross time was 2 seconds or less, the solderability was evaluated to be S as being particularly excellent. When the zero cross time exceeded 5 seconds, the solderability was evaluated to be C as being practically problematic. Meanwhile, the used specimen was obtained by carrying out finish rolling or washing using sulfuric acid after the final step of the recovery thermal treatment, polishing the surface using No. 800 polishing paper so as to obtain a non-oxidized surface, and leaving the surface to stand in an indoor environment for one day. Meanwhile, for Sn-3.5% Ag-0.7% Cu, a specimen obtained by leaving the surface to stand in an indoor environment for ten days was also used. In Tables 6, 9, 12, 15 and 18, "−1" indicates the test results in Sn-3.5% Ag-0.7% Cu after one day, "−2" indicates the test results in Sn-3.5% Ag-0.7% Cu after ten days, and "−11" indicates the test results in pure Sn after one day.

The average grain diameter of recrystallized grains was measured by selecting an appropriate magnification depending on the sizes of crystal grains in 600-times, 300-times and 150-times metal microscopic photographs, and using a quadrature method of the methods for estimating average grain size of wrought copper and copper-alloys in JIS H 0501. Meanwhile, twin crystals are not considered as crystal grains. Grains that could not be easily determined using a metal microscope were determined using an electron back scattering diffraction pattern (FE-SEM-EBSP) method. That is, a JSM-7000F manufactured by JEOL Ltd. was used as the FE-SEM, TSL solutions OIM-Ver. 5.1 was used for analysis, and the average crystal grain size was obtained from grain maps with analysis magnifications of 200 times and 500 times. The quadrature method (JIS H 0501) was used as the method for computing the average crystal grain diameter.

Meanwhile, a crystal grain is elongated due to rolling, but the volume of crystal grains rarely changes due to rolling. When the average values of the average crystal grain diameters measured using the respective quadrature methods are obtained in cross-sections obtained by cutting a plate material in parallel to the rolling direction and vertically to the rolling direction, it is possible to estimate the average crystal grain diameter in the recrystallization stage.

The average grain diameter of precipitates was obtained in the following manner. On transmission electron images obtained using 500,000-times and 150,000-times (the detection limits were 1.0 nm and 3 nm respectively) TEMs, the contrasts of precipitates were elliptically approximated using image analysis software "Win ROOF", the synergetic average values of the long axes and the short axes of all precipitated grains in a view were obtained, and the average value of the synergetic average values was considered as the average grain diameter. Meanwhile, the detection limits of the grain diameters were set to 1.0 nm and 3 nm respectively in measurements of 500,000 times and 150,000 times, grains below the detection limits were treated as noise, and were not included in the computation of the average grain diameter. Meanwhile, the average grain diameters were obtained at 500,000 times for grains as large as approximately 8 nm or less, and at 150,000 times for grains as large as approximately 8 nm or more. In the case of a transmission electron microscope, since the dislocation density is high in a cold-worked material, it is difficult to obtain the precise information of precipitates. In addition, since the sizes of precipitates do not change due to cold working, recrystallized grains before the cold finish rolling step and after the recrystallization thermal treatment step were observed. The grain diameters were measured at two places at ¼ sheet depth from the front and rear surfaces of the rolled material, and the values measured at the two places were averaged.

The test results will be described below.

(1) The copper alloy sheet which is the first invention alloy, and was obtained through cold finish rolling of a rolled material in which the average crystal grain diameter after the recrystallization thermal treatment step was 2.0 μm to 8.0 μm, the average particle diameter of precipitates was 4.0 nm to 25.0 nm or the proportion of the number of precipitates having a particle diameter in a range of 4.0 nm to 25.0 nm in the precipitates was 70% or more is excellent in terms of tensile strength, proof stress, Young's modulus, electric conductivity, bending workability, stress corrosion crack resistance, solderability and the like (refer to Test Nos. T8 and T66).

(2) The copper alloy sheet which is the second invention alloy, and was obtained through cold finish rolling of a rolled material in which the average crystal grain diameter after the recrystallization thermal treatment step was 2.0 μm to 8.0 μm, the average particle diameter of precipitates was 4.0 nm to 25.0 nm or the proportion of the number of precipitates having a particle diameter in a range of 4.0 nm to 25.0 nm in the precipitates was 70% or more is excellent in terms of tensile strength, proof stress, Young's modulus, electric conductivity, bending workability, stress corrosion crack resistance, solderability and the like (refer to Test Nos. T36 and T53).

(3) The copper alloy which is the third invention alloy, and was obtained through cold finish rolling or the recovery thermal treatment after cold rolling of a rolled material in which the average crystal grain diameter after the recrystallization thermal treatment step was 2.0 μm to 8.0 μm, the average particle diameter of precipitates was 4.0 nm to 25.0 nm or the proportion of the number of precipitates having a particle diameter in a range of 4.0 nm to 25.0 nm in the precipitates was 70% or more is excellent in terms of tensile strength, and favorable in terms of proof stress, Young's modulus, electric conductivity, bending workability, stress corrosion crack resistance, solderability and the like (refer to Test Nos. T720, T884 and the like).

(4) The copper alloy which is the fourth invention alloy, and was obtained through cold finish rolling or the recovery thermal treatment after cold rolling of a rolled material in which the average crystal grain diameter after the recrystallization thermal treatment step was 2.0 μm to 8.0 μm, the average particle diameter of precipitates was 4.0 nm to 25.0 nm or the proportion of the number of precipitates having a particle diameter in a range of 4.0 nm to 25.0 nm in the precipitates was 70% or more is excellent in terms of tensile strength, proof stress, Young's modulus, electric conductivity, bending workability, stress corrosion crack resistance, solderability and the like (refer to Test Nos. T696, T712, T880 and the like).

(5) The copper alloy sheets which are the first invention alloy, the second invention alloy, the third invention alloy and the fourth invention alloy, and were obtained through cold finish rolling of a rolled material in which the average crystal grain diameter after the recrystallization thermal treatment step was 2.0 μm to 8.0 μm, the average particle diameter of precipitates was 4.0 nm to 25.0 nm or the proportion of precipitates having a grain diameter of 4.0 nm to 25.0 nm in the precipitates was 70% or more have an electric conductivity of 29% IACS or more and a tensile strength of 500 N/mm$^2$ or more, satisfy 3200≤f2≤4100, have a ratio of the tensile strength in a direction forming 90 degrees with respect to the rolling direction to the tensile strength in a direction forming 0 degrees in a range of 0.95 to 1.05, and has a ratio of the proof stress in a direction forming 90 degrees with respect to the rolling direction to the proof stress in a direction forming 0 degrees in a range of 0.95 to 1.05. These copper alloy sheets are excellent in terms of tensile strength, proof stress, Young's modulus, electric conductivity, bending workability, stress corrosion crack resistance, solderability and the like (refer to Test Nos. T8, T36, T53, T66, T696 and T724)

(6) The copper alloy sheets which are the first invention alloy, the second invention alloy, the third invention alloy and the fourth invention alloy, and were obtained through cold finish rolling and a recovery thermal treatment of a rolled material in which the average crystal grain diameter after the recrystallization thermal treatment step was 2.0 μm to 8.0 μm, the average particle diameter of precipitates was 4.0 nm to 25.0 nm or the proportion of precipitates having a grain diameter of 4.0 nm to 25.0 nm in the precipitates was 70% or more have an electric conductivity of 29% IACS or more and a tensile strength of 500 N/mm$^2$ or more, satisfy 3200≤f2≤4100, have a ratio of the tensile strength in a direction forming 90 degrees with respect to the rolling direction to the tensile strength in a direction forming 0 degrees in a range of 0.95 to 1.05, and has a ratio of the proof stress in a direction forming 90 degrees with respect to the rolling direction to the proof stress in a direction forming 0 degrees in a range of 0.95 to 1.05. These copper alloy sheets are excellent in terms of tensile strength, proof stress, Young's modulus, electric conductivity, bending workability, solderability, stress corrosion crack resistance, spring bending elastic limit and the like (refer to Test Nos. T1, T2, T18, T22, T47, T48, T64, T690, T710, T76, T78, T883, T884 and the like).

(7) It is possible to obtain a copper alloy sheet described in the above-described (5) using manufacturing conditions which sequentially include the hot rolling step, the cold rolling step, the recrystallization thermal treatment step and the cold finish rolling step, and in which the hot rolling initial temperature of the hot rolling step is 800° C. to 940° C., the cooling rate of the copper alloy material in a temperature range of a temperature after final rolling of 650° C. to 350° C. is 1° C./second or more, the percentage of cold working in the cold rolling step is 55% or more, in the recrystallization thermal treatment step, the peak temperature Tmax (° C.) of the rolled material is 550≤Tmax≤790, the holding time tm (min) is 0.04≤tm≤2, and the thermal treatment index It is 460≤It≤580 (refer to Test Nos. T8, T36, T53, T66, T696 and T724).

(8) It is possible to obtain a copper alloy sheet described in the above-described (6) using manufacturing conditions which sequentially include the hot rolling step, the cold rolling step, the recrystallization thermal treatment step, the cold finish rolling step and the recovery thermal treatment step and in which the hot rolling initial temperature of the hot rolling step is 800° C. to 940° C., the cooling rate of the copper alloy material in a temperature range of a temperature after final rolling of 650° C. to 350° C. is 1° C./second or more, the percentage of cold working in the cold rolling step is 55% or more, in the recrystallization thermal treatment step, the peak temperature Tmax (° C.) of the rolled material is 550≤Tmax≤790, the holding time tm (min) is 0.04≤tm≤2, the thermal treatment index It is 460≤It≤580, in the recovery thermal treatment step, the peak temperature Tmax2 (° C.) of the rolled material is 160≤Tmax2≤650, the holding time tm2 (min) is 0.02≤tm≤2200, and the thermal treatment index It is 60≤It≤360 (refer to Test Nos. T1, T2, T18, T22, T47, T48, T64, T690, T710, T720, T76, T78, T883, T884 and the like).

In a case in which the invention alloy was used, the following results were obtained.

(1) In the example alloys of Manufacturing Step A in which a mass production facility was used and Manufacturing Step B in which an experimental facility was used, as long as the manufacturing conditions were similar, the metallic structures after the recrystallization thermal treatment after both steps had similar sizes of crystal grains and precipitates, had almost similar average grain diameters, and obtained almost similar characteristics (refer to Test Nos. T1, T12, T29, T40, T47, T56 and the like).

(2) In a case in which the manufacturing conditions are in the set condition ranges of the invention, the amount of Ni is 0.35% or more or 0.4% or more, and [Ni]/[P] is 7 or more, the percentage of stress relaxation is favorable (refer to Test Nos. T5, T31, T58, T65, T693 and the like).

(3) In a case in which the manufacturing conditions are in the set condition ranges of the invention, the percentage of stress relaxation is A or greater even when the amount of Ni is small (refer to Test Nos. T73, T87 and the like).

When Co and Fe are contained, the average crystal grain diameter becomes small, and the tensile strength and the proof stress become high, but the elongation is low, and the bending workability slightly deteriorates.

In a case in which the content of Zn is 8.5% or more, and the composition index f1 is 17 or more, high-strength alloys having a tensile strength of 550 N/mm$^2$ or more are obtained in almost all steps. On the other hand, the Young's modulus becomes slightly low, the electric conductivity, the bending workability and the stress corrosion crack resistance deteriorate. When the amount of Ni is 0.4% or more, [Ni]/[P] is set to 7 or more and 40 or less, and [Ni]/[Sn] is set to 0.55 or more and 1.9 or less, it is possible to suppress the deterioration of the above-described characteristics and the balance indexes f2 and f21 to the minimum extent (refer to Alloy Nos. 7 and the like/Test Nos. T690, T710, T880, T884 and the like).

(4) With a larger average crystal grain diameter such as in a range of 3.5 μm to 5.0 μm rather than in a range of 2 μm to 3.5 μm, and with Steps A3 and A31 rather than Steps A1 and A11, the tensile strength is slightly low, but the stress relaxation characteristics become slightly favorable (refer to Test Nos. T18, T19, T22, T23 and the like).

With a lower percentage of finish rolling, and with Steps A1 and A3 rather than Steps A11 and A31, the tensile strength is slightly low, but the ratios of the tensile strength and proof stress in the direction forming 0 degrees with respect to the rolling direction to the direction forming 90 degrees are closer to 1.0, and the stress relaxation characteristics become slightly favorable.

(5) When the average recrystallized grain diameter after the recrystallization thermal treatment step is in a range of 2.5 μm to 4.0 μm, the respective characteristics such as tensile strength, proof stress, electric conductivity, bending workability and stress corrosion crack resistance are favorable (refer to Test Nos. T1, T2, T18, T29, T47 and the like). In addition, when the average recrystallized grain diameter is in a range of 2.5 μm to 5.0 μm, the ratios of the tensile strength and proof stress in the direction forming 0 degree with respect to the rolling direction to the direction forming 90 degrees are in a range of 0.98 to 1.03, and the tensile strength and proof stress are almost isotropic (refer to Test Nos. T1, T14, T26, T29, T85 and the like).

(6) The average recrystallized grain diameter after the recrystallization thermal treatment step is smaller than 2.5 μm, and particularly, when the average recrystallized grain diameter is smaller than 2.0 μm, the bending workability deteriorates (Test Nos. T21, T32, T92 and the like). In addition, the ratios of the tensile strength and proof stress in the direction forming 0 degrees to the direction forming 90 degrees with respect to the rolling direction deteriorate. In addition, the stress relaxation characteristics also deteriorate.

When the average recrystallized grain diameter is smaller than 2.0 μm, the bending workability or isotropy does not significantly improve even when the percentage of cold working in the final cold finish rolling is low (refer to Test Nos. T28 and T46).

(7) When the average recrystallized grain diameter after the recrystallization thermal treatment step is larger than 8.0 μm, the tensile strength becomes low (refer to Test Nos. T7, T24, T35, T52, T90, T105 and the like).

(8) When the thermal treatment index It in the recrystallization thermal treatment step is smaller than 460, the average recrystallized grain diameter after the recrystallization thermal treatment step becomes small, and the bending workability and the percentage of stress relaxation deteriorate (refer to Test Nos. T4 and the like). In addition, when It is smaller than 460, the average grain diameter of the precipitated particles becomes small, and the bending workability deteriorates (refer to Test Nos. T4, T21, T32 and the like). In addition, the ratios of the tensile strength and proof stress in the direction forming 0 degrees to the direction forming 90 degrees with respect to the rolling direction deteriorate.

(9) When the thermal treatment index It in the recrystallization thermal treatment step is greater than 580, the average grain diameter of the precipitated particles after the recrystallization thermal treatment step becomes large, and the tensile strength and the electric conductivity degrade. In addition, the isotropy of tensile strength or proof stress deteriorates (refer to Test Nos. T7, T24, T35, T52 and the like).

(10) When the cooling rate after hot rolling is slower than the set condition range, the average grain diameter of the precipitated grains is slightly large, the precipitated grains form a non-uniform precipitation state, the tensile strength is low, and the stress relaxation characteristics deteriorate (refer to Test Nos. T13, T41, T57 and the like).

In the copper alloy sheets on which the thermal treatment is carried out with It of 565 and 566 near the upper limit of the condition range (460 to 580) of the thermal treatment index It in the recrystallization thermal treatment step, the average crystal grain diameter is slightly increased to approximately 5 μm, but the tensile strength is slightly low, the precipitated particles are uniformly distributed, and the stress relaxation characteristics are favorable (refer to Test Nos. T5, T6, T22, T23, T33, T34, T50, T51 and the like). When the percentage of cold working of final cold finish rolling is set to be high, the strength of the invention alloy rolled material of the application improves without impairing the bending workability and the stress relaxation characteristics (refer to Test Nos. T2, T19, T63, T80, T6, T23 and the like).

(11) In a case in which the temperature condition of the annealing step is 580° C. and four hours, or when the percentage of cold working in the second cold rolling step is smaller than the set condition range, the relationship of $D0 \leq D1 \times 4 \times (RE/100)$ is not satisfied, the precipitated particles after the recrystallization thermal treatment step become large, and the recrystallized grains turn into a mixed grain state in which large crystal grains and small crystal grains are mixed. As a result, the average crystal grain diameter becomes slightly large, the tensile strength or proof stress becomes anisotropic, and the bending workability deteriorates (refer to Test Nos. T17, T45 and the like).

(12) When the percentage of second cold rolling is low, the precipitated particles after the recrystallization thermal treatment step become large, and the recrystallized grains turn into a mixed grain state in which large crystal grains and small crystal grains are mixed. As a result, the average crystal grain diameter becomes slightly large, the tensile strength or proof stress becomes anisotropic, and the bending workability deteriorates (refer to Test Nos. T15, T43 and the like).

The Young's modulus is 100 $kN/mm^2$ or more for all alloys of the invention, but the Young's modulus is high as the content of Ni increases, or the content of Zn decreases. In addition, when the recovery thermal treatment is carried out, the Young's modulus becomes high. Comparative example alloy No. 39 failed to reach 100 $kN/mm^2$.

The solderability was excellent or favorable for all invention alloys. Only a few alloys decreased in the solderability after being left to stand for ten days, and the solderability became more favorable as the content of Ni increases, or the content of Zn decreases.

(13) When the copper alloy material after finish rolling is thermally treated under the condition corresponding to Sn plating, the stress relaxation characteristics, bending workability, balance indexes f2 and f21, elongation, isotropy, electric conductivity and the like of the copper alloy material improve. Even when the recovery thermal treatment is not carried out, favorable characteristics are provided (refer to Test Nos. T9, T25, T37 and the like).

(14) After the recovery thermal treatment, even when the copper alloy material is thermally treated under the condition corresponding to Sn plating, the characteristics, such as tensile strength, proof stress, isotropy, spring characteristics, Young's modulus, stress relaxation characteristics, bending workability, elongation, electric conductivity, corrosion resistance and balance indexes f2 and f21 as favorable as the characteristics of the copper alloy material before the recovery thermal treatment are maintained (refer to Test Nos. T10, T26, T38 and the like).

(15) Even when the final thermal treatment is carried out in a batch annealing format at 450° C. for four hours, as long as the average crystal grain diameter and the size of the precipitates are within the ranges regulated in the application, the tensile strength, proof stress, isotropy, spring characteristics, stress relaxation characteristics, elongation and balance indexes f2 and f21 become slightly poor compared with short-time annealing at a high temperature, but favorable characteristics are obtained (refer to Test Nos. T11, T27, T39 and the like).

(16) Even when the first cold rolling step and the annealing step are not carried out, and only the second cold rolling step and the recrystallization thermal treatment step are carried out (Step B43), since the metallic structure after the recrystallization thermal treatment step has similar crystal grains and similar sizes of precipitated grains, an average crystal grain diameter in a range of 2.0 μm to 8.0 μm, and an average particle diameter of the precipitates in a range of 4.0 nm to 25.0 nm, almost the same characteristics such as tensile strength, proof stress, isotropy, spring characteristics, Young's modulus, stress relaxation characteristics, bending workability, elongation, electric conductivity, corrosion resistance and balance indexes f2 and f21 as the characteristics of the alloy produced using a step including the first cold rolling step and the annealing step (Step B1) are obtained (refer to Test Nos. T12, T171, T56, T611 and the like).

The composition was as described below.

(1) When the contents of P and Co are larger than the condition range of the second invention alloy, since the intrinsic influences of P, Co and Fe become weak and the average grain diameter of the precipitated particles after the recrystallization thermal treatment step become small, the average crystal grain diameter becomes small, and the balance indexes f2 and f21 become small. The isotropy of tensile strength and proof stress, the bending workability and the percentage of stress relaxation deteriorate (refer to Alloy Nos. 23 and 24/Test Nos. T92, T93 and the like).

(2) When the contents of Zn and Sn are smaller than the condition ranges of the first and second invention alloys, since the average crystal grain diameter after the recrystallization thermal treatment step becomes large, the tensile strength becomes small, and the balance indexes f2 and f21 become small. In addition, the isotropy of tensile strength and proof stress deteriorates, the percentage of stress relaxation deteriorates, and the Young's modulus also becomes small (refer to Alloy Nos. 26 and 28/Test Nos. T96, T100 and the like). Particularly, the effect commensurate with the content of Ni cannot be obtained in spite of Ni being contained, and the stress relaxation characteristics are poor.

Since the balance indexes f2 and f21, the tensile strength and the stress relaxation characteristics are satisfied, the amount of Zn near 4.5 mass % is the boundary value (refer to Alloy Nos. 6, 16, 161, 162, 163 and the like).

Since the balance indexes f2 and f21, the tensile strength and the stress relaxation characteristics are satisfied, the amount of Sn near 0.4 mass % is the boundary value (refer to Alloy Nos. 7, 168, 184 and the like).

(3) When the content of Zn is larger than the condition range of the invention alloy, the balance indexes f2 and f21 become small, the electric conductivity, the isotropy of tensile strength and proof stress, the percentage of stress relaxation and the bending workability deteriorate. In addition, the stress corrosion crack resistance also deteriorates, and the Young's modulus becomes small (refer to Alloy No. 40/Test No. T110 and the like).

When the content of Sn is large, the electric conductivity becomes poor, and the bending workability is also not favorable (refer to Alloy No. 30/Test No. T102).

In alloys in which the amount of Ni exceeds 0.35 mass % and the stress relaxation characteristics are excellent, when the Ni/P value is outside a range of 7 to 40, and the Ni/Sn value is outside a preferred range of 0.55 to 1.9, the effect commensurate with the content of Ni cannot be obtained, and the stress relaxation characteristics are not favorable (refer to Alloy Nos. 29, 44, 45 and the like). When a lot of Ni is contained, the Young's modulus becomes high. Particularly, regarding the stress relaxation characteristics, Ni/Sn:0.55 and Ni/Sn:1.9 are considered to be one of the threshold values for alloys having a content of Zn of 8.5% or more and f1 of 17 or more (refer to Alloy Nos. 182, 184 and the like). Similarly, Ni/P:7 and Ni/P:40 are considered to be one of the threshold values (refer to Alloy Nos. 181, 185 and the like).

(4) When the composition index f1 is smaller than the condition range of the invention alloy, the average crystal grain diameter after the recrystallization thermal treatment step becomes large, the tensile strength is small, and the isotropy of tensile strength or proof stress is also poor. In addition, the percentage of stress relaxation is poor (refer to Test Nos. T103, T105, T106 and the like). Particularly, the effect commensurate with the content of Ni cannot be obtained even when 0.35% or more of Ni is contained, and the stress relaxation characteristics are poor. In addition, the value of the composition index f1 of approximately 11 is the boundary value for satisfying the balance indexes f2 and f21, the tensile strength and the stress relaxation characteristics (refer to Alloy No. 163 and the like). In addition, when the value of the composition index f1 exceeds 12, the balance indexes f2 and f21, the tensile strength and the stress relaxation characteristics become more favorable (refer to Alloy Nos. 166, 167 and the like).

(5) When the composition index f1 is greater than the condition range of the invention alloy, the electric conductivity is low, the balance indexes f2 and f21 are small, and the isotropy of tensile strength and proof stress and the bending workability are also poor. In addition, the Young's modulus is low, and the stress corrosion crack resistance and the percentage of stress relaxation are also poor (refer to Test Nos. T111, 112 and the like). In addition, the value of the composition index f1 of approximately 19 is the boundary value for satisfying the balance indexes f2 and f21, the electric conductivity, the bending workability, the Young's modulus, the stress corrosion crack resistance, the stress relaxation characteristics and the isotropy (refer to Alloy Nos. 183, 41, 42 and the like). Furthermore, when the value of the composition index f1 is smaller than 18, the balance indexes f2 and f21, the electric conductivity, the stress corrosion crack resistance, the stress relaxation characteristics, the isotropy of tensile strength and proof stress, and the bending workability become favorable (refer to Alloy Nos. 7, 8, 9 and the like).

As described above, even when the concentrations of Zn, Sn, Ni, P, Co and Fe are within the predetermined concentration ranges, if the value of the composition index f1 is outside a range of 11 to 19, it is not possible to satisfy all the balance indexes f2 and f21, the electric conductivity, the stress corrosion crack resistance, the stress relaxation characteristics and the isotropy.

(6) When 0.05 mass % of Cr is contained, the average crystal grain diameter becomes small, and the bending workability and the isotropy become poor (refer to Alloy No. 38/Test No. T108).

INDUSTRIAL APPLICABILITY

The copper alloy sheet for terminal and connector materials of the invention has high strength, high Young's modulus, favorable corrosion resistance, excellent balance among electric conductivity, tensile strength and elongation, excellent solderability, isotropic tensile strength and isotropic proof stress. Therefore, the copper alloy sheet for terminal and connector materials of the invention can be preferably applied as a constituent material or the like not only for connectors and terminals but also for relays, springs, switches, semiconductor use, lead frames, and the like.

The invention claimed is:

1. A copper alloy sheet for terminal and connector materials comprising:

4.5 mass % to 12.0 mass % of Zn;

0.40 mass % to 0.9 mass % of Sn;

0.01 mass % to 0.08 mass % of P;

0.52 mass % to 0.85 mass % of Ni; and any one or both of 0.005 mass % to 0.08 mass % of Co and 0.004 mass % to 0.03 mass % of Fe, with a remainder being Cu and inevitable impurities, wherein a content of Zn [Zn] (mass %), a content of Sn [Sn] (mass %), a content of P [P] (mass %), a content of Co [Co] (mass %) and a content of Ni [Ni] (mass %) have a relationship of $17 \leq [Zn]+7.5\times[Sn]+16\times[P]+10\times[Co]+3.5\times[Ni] \leq 19$ and have a relationship of $7 \leq [Ni]/[P] \leq 40$ and $0.6 \leq [Ni]/[Sn] \leq 1.9$, Zn and Sn form solid solution in a matrix, an average crystal grain diameter is in a range of 2.0 μm to 8.0 μm, an average particle diameter of circular or elliptical precipitates containing Ni—P compound is in a range of 4.0 nm to 25.0 nm or a proportion of the number of precipitates having a particle diameter in a range of 4.0 nm to 25.0 nm in the precipitates is 70% or more, an electric conductivity is 29% IACS or more, a percentage of stress relaxation is 30% or less at 150° C. for 1000 hours as stress relaxation resistance, bending workability is $R/t \leq 0.5$ at W bending, solderability is excellent, stress corrosion crack resistance is excellent, a Young's modulus is $100\times10^3$ N/mm$^2$ or more, and a 0.2% proof stress is greater than or equal to 480 N/mm$^2$ and less than or equal to 607 N/mm$^2$.

2. A copper alloy sheet for terminal and connector materials comprising:

8.5 mass % to 12.0 mass % of Zn;

0.40 mass % to 0.9 mass % of Sn;

0.01 mass % to 0.08 mass % of P;

0.40 mass % to 0.85 mass % of Ni; and any one or both of 0.005 mass % to 0.08 mass % of Co and 0.004 mass % to 0.03 mass % of Fe, with a remainder being Cu and inevitable impurities, wherein a content of Zn [Zn] (mass %), a content of Sn [Sn] (mass %), a content of P [P] (mass %), a content of Co [Co] (mass %) and a content of Ni [Ni] (mass %) have a relationship of $17 \leq [Zn]+7.5\times[Sn]+16\times[P]+10\times[Co]+3.5\times[Ni] \leq 19$ and have a relationship of $7 \leq [Ni]/[P] \leq 40$ and $0.55 \leq [Ni]/[Sn] \leq 1.9$, Zn and Sn form solid solution in a matrix, an average crystal grain diameter is in a range of 2.0 μm to 8.0 μm, an average particle diameter of circular or elliptical precipitates containing Ni—P compound is in a range of 4.0 nm to 25.0 nm or a proportion of the number of precipitates having a particle diameter in a range of 4.0 nm to 25.0 nm in the precipitates is 70% or more, an electric conductivity is 29% IACS or more, a percentage of stress relaxation is 30% or less at 150° C. for 1000 hours as stress relaxation resistance, bending workability is $R/t \leq 0.5$ at W bending, solderability is excellent, stress corrosion crack resistance is excellent, a Young's modulus is $100\times10^3$ N/mm$^2$ or more, and a 0.2% proof stress is greater than or equal to 480 N/mm$^2$ and less than or equal to 607 N/mm$^2$.

3. The copper alloy sheet for terminal and connector materials according to claim 1, wherein the copper alloy sheet for terminal and connector materials is manufactured using a manufacturing step including: a cold finish rolling step for cold-rolling a copper alloy material in which an average crystal grain diameter is in a range of 2.0 μm to 8.0 μm, an average particle diameter of circular or elliptical precipitates is in a range of 4.0 nm to 25.0 nm or a proportion of the number of precipitates having a particle diameter in a range of 4.0 nm to 25.0 nm in the precipitates is 70% or more, when the electric conductivity is represented by C (% IACS), tensile strength, proof stress and elongation in a direction forming 0 degrees with respect to a rolling direction are represented by Pw (N/mm$^2$), Py (N/mm$^2$) and L (%) respectively, $C \geq 29$, $Pw \geq 500$, $3200 \leq [Pw\times\{(100+L)/100\}\times C^{1/2}] \leq 4100$ or $C \geq 29$, $Py \geq 480$, $3100 \leq [Py\times\{(100+L)/100\}\times C^{1/2}] \leq 4000$ after the cold finish rolling step, a ratio of tensile strength in the direction forming 90 degrees with respect to the rolling direction to tensile strength in a direction forming 0 degrees with respect to the rolling direction is in a range of 0.95 to 1.05, or a ratio of proof stress in the direction forming 90 degrees with respect to the rolling direction to proof stress in a direction forming 0 degrees with respect to the rolling direction is in a range of 0.95 to 1.05.

4. The copper alloy sheet for terminal and connector materials according to claim 1, wherein the copper alloy sheet for terminal and connector materials is manufactured using a manufacturing step including: a cold finish rolling step for cold-rolling a copper alloy material in which an average crystal grain diameter is in a range of 2.0 μm to 8.0 μm, an average particle diameter of circular or elliptical precipitates is in a range of 4.0 nm to 25.0 nm or a proportion of the number of precipitates having a particle diameter in a range of 4.0 nm to 25.0 nm in the precipitates is 70% or more; and a recovery thermal treatment carried out after the cold finish rolling step, when the electric conductivity is represented by C (% IACS), tensile strength, proof stress and elongation in a direction forming 0 degrees with respect to a rolling direction are represented by Pw (N/mm$^2$), Py (N/mm$^2$) and L (%) respectively, $C \geq 29$, $Pw \geq 500$, $3200 \leq [Pw\times\{(100+L)/100\}\times C^{1/2}] \leq 4100$ or $C \geq 29$, $Py \geq 480$, $3100 \leq [Py\times\{(100+L)/100\}\times C^{1/2}] \leq 4000$ after the recovery thermal treatment step, a ratio of tensile strength in the direction forming 90 degrees with respect to the rolling direction to tensile strength in a direction forming 0 degrees with respect to the rolling direction is in a range of 0.95 to 1.05, or a ratio of proof stress in the direction forming 90 degrees with respect to the rolling direction to proof stress in a direction forming 0 degrees with respect to the rolling direction is in a range of 0.95 to 1.05.

5. The copper alloy sheet for terminal and connector materials according to claim 2, wherein the copper alloy sheet for terminal and connector materials is manufactured using a manufacturing step including: a cold finish rolling step for cold-rolling a copper alloy material in which an average crystal grain diameter is in a range of 2.0 μm to 8.0 μm, an average particle diameter of circular or elliptical precipitates is in a range of 4.0 nm to 25.0 nm or a proportion of the number of precipitates having a particle diameter in a range of 4.0 nm to 25.0 nm in the precipitates is 70% or more, when the electric conductivity is represented by C (% IACS), tensile strength, proof stress and elongation in a direction forming 0 degrees with respect to a rolling direction are represented by Pw (N/mm$^2$), Py (N/mm$^2$) and L (%) respectively, $C \geq 29$, $Pw \geq 500$, $3200 \leq [Pw\times\{$ $(100+L)/100\}\times C^{1/2}]\leq 4100$ or $C\geq 29$, $Py\geq 480$, $3100\leq [Py\times\{(100+L)/100\}\times C^{1/2}]\leq 4000$ after the cold finish rolling step, a ratio of tensile strength in the direction forming 90 degrees with respect to the rolling direction to tensile strength in a direction forming 0 degrees with respect to the rolling direction is in a range of 0.95 to 1.05, or a ratio of proof stress in the direction forming 90 degrees with respect to the rolling direction to proof stress in a direction forming 0 degrees with respect to the rolling direction is in a range of 0.95 to 1.05.

6. The copper alloy sheet for terminal and connector materials according to claim 2, wherein the copper alloy sheet for terminal and connector materials is manufactured using a manufacturing step including: a cold finish rolling step for cold-rolling a copper alloy material in which an average crystal grain diameter is in a range of 2.0 μm to 8.0 μm, an average particle diameter of circular or elliptical precipitates is in a range of 4.0 nm to 25.0 nm or a proportion of the number of precipitates having a particle diameter in a range of 4.0 nm to 25.0 nm in the precipitates is 70% or more; and a recovery thermal treatment carried out after the cold finish rolling step, when the electric conductivity is represented by C (% IACS), tensile strength, proof stress and elongation in a direction forming 0 degrees with respect to a rolling direction are represented by Pw ($N/mm^2$), Py ($N/mm^2$) and L (%) respectively, $C\geq 29$, $Pw\geq 500$, $3200\leq [Pw\times\{(100+L)/100\}\times C^{1/2}]\leq 4100$ or $C\geq 29$, $Py\geq 480$, $3100\leq [Py\times\{(100+L)/100\}\times C^{1/2}]\leq 4000$ after the recovery thermal treatment step, a ratio of tensile strength in the direction forming 90 degrees with respect to the rolling direction to tensile strength in a direction forming 0 degrees with respect to the rolling direction is in a range of 0.95 to 1.05, or a ratio of proof stress in the direction forming 90 degrees with respect to the rolling direction to proof stress in a direction forming 0 degrees with respect to the rolling direction is in a range of 0.95 to 1.05.

* * * * *